US010265959B2

(12) United States Patent
Koga

(10) Patent No.: US 10,265,959 B2
(45) Date of Patent: Apr. 23, 2019

(54) LIQUID EJECTING HEAD AND LIQUID EJECTING APPARATUS

(71) Applicant: FUJIFILM Corporation, Tokyo (JP)

(72) Inventor: Takehiko Koga, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/956,753

(22) Filed: Apr. 19, 2018

(65) Prior Publication Data

US 2018/0236766 A1 Aug. 23, 2018

Related U.S. Application Data

(63) Continuation of application No. PCT/JP2016/081482, filed on Oct. 24, 2016.

(30) Foreign Application Priority Data

Oct. 29, 2015 (JP) ..... 2015-212891
May 25, 2016 (JP) ..... 2016-104357

(51) Int. Cl.
*B41J 2/14* (2006.01)
*B41J 2/21* (2006.01)
(Continued)

(52) U.S. Cl.
CPC ..... *B41J 2/155* (2013.01); *B41J 2/1433* (2013.01); *B41J 2/14201* (2013.01);
(Continued)

(58) Field of Classification Search
CPC . B41J 2/155; B41J 2/2146; B41J 19/00; B41J 2/14233; B41J 2/14201; B41J 2/1433; B41J 2202/19; B41J 2202/12; B41J 2202/20
USPC ..... 347/49
See application file for complete search history.

(56) References Cited

U.S. PATENT DOCUMENTS 5,343,227 A 8/1994 Hirosawa et al.
2006/0209124 A1 9/2006 Komura
(Continued)

FOREIGN PATENT DOCUMENTS

JP H03227634 10/1991
JP H03290252 12/1991
(Continued)

OTHER PUBLICATIONS

"International Search Report (Form PCT/ISA/210) of PCT/JP2016/081482," dated Dec. 20, 2016, with English translation thereof, pp. 1-4.

(Continued)

*Primary Examiner* — Huan H Tran
*Assistant Examiner* — Alexander D Shenderov
(74) *Attorney, Agent, or Firm* — JCIPRNET

(57) ABSTRACT

A head module supporting member that supports head modules (200) and has a structure in which a longitudinal direction of the head module supporting member is a first direction, and a deflection suppressing unit (112) that has a structure in which a longitudinal direction of the deflection suppressing unit is the first direction, and is disposed on a top surface of the head module supporting member are included. The deflection suppressing unit is an elastic body. A deflection absorption unit (114) connected to the top surface of the head module supporting member, a head module supporting member connection unit (116) connected to an intermediate position of the deflection absorption unit and to the top surface of the head module supporting member, and a biasing force applying unit that applies a biasing force which deflects the deflection absorption unit in a deflection direction of the head module supporting member are included.

19 Claims, 27 Drawing Sheets

(51) Int. Cl.
*B41J 19/00* (2006.01)
*B41J 2/155* (2006.01)

(52) U.S. Cl.
CPC ..... *B41J 2/14233* (2013.01); *B41J 2/2146* (2013.01); *B41J 19/00* (2013.01); *B41J 2202/12* (2013.01); *B41J 2202/19* (2013.01); *B41J 2202/20* (2013.01)

(56) References Cited

U.S. PATENT DOCUMENTS

| | | | |
|---|---|---|---|
| 2012/0132350 | A1 | 5/2012 | Takamatsu |
| 2012/0227516 | A1 | 9/2012 | Weingartner |

FOREIGN PATENT DOCUMENTS

| | | |
|---|---|---|
| JP | 2004358826 | 12/2004 |
| JP | 2008290342 | 12/2008 |
| JP | 2009012346 | 1/2009 |
| JP | 2009279783 | 12/2009 |
| JP | 2011021475 | 2/2011 |
| WO | 2011021475 | 2/2011 |

OTHER PUBLICATIONS

"Written Opinion of the International Searching Authority (Form PCT/ISA/237) of PCT/JP2016/081482," dated Dec. 20, 2016, with English translation thereof, pp. 1-7.
"Search Report of European Counterpart Application" dated Sep. 19, 2018, p. 1-p. 6.

LIQUID EJECTING HEAD AND LIQUID EJECTING APPARATUS

CROSS-REFERENCE TO RELATED APPLICATIONS

The present application is a Continuation of PCT International Application No. PCT/JP2016/081482 filed on Oct. 24, 2016 claiming priority under 35 U.S.C. § 119(a) to Japanese Patent Applications No. 2015-212891 filed on Oct. 29, 2015 and No. 2016-104357 filed on May 25, 2016. Each of the above applications is hereby expressly incorporated by reference, in their entirety, into the present application.

BACKGROUND OF THE INVENTION

1. Field of the Invention

The present invention relates to a liquid ejecting head and a liquid ejecting apparatus, and particularly to a supporting structure of a line type head.

2. Description of the Related Art

A line type liquid ejecting head in which a plurality of ejecting elements are disposed over a length corresponding to the entire width of a recording medium is known as an ink jet method liquid ejecting head. A structure in which a plurality of head modules are disposed in a longitudinal direction of the liquid ejecting head is known as a line type head.

Herein, the entire width of the recording medium is the entire length of the recording medium in a width direction, which is a direction orthogonal to a relative moving direction of the recording medium and the liquid ejecting head. The width direction of the recording medium is parallel to the longitudinal direction of the liquid ejecting head.

The word "orthogonal" in the specification includes substantially being orthogonal, in which the same operation effect as in the case of intersecting at 90 degrees is achieved in the case of intersecting at an angle exceeding 90 degrees or in the case of intersecting at an angle falling short of 90 degrees.

The word "parallel" in the specification includes substantially being parallel, in which two directions intersect each other but the same operation effect as being parallel to each other is achieved. In addition, the word "the same" in the specification includes substantially being the same, in which there is a difference in a target configuration but the same operation effect as being the same can be obtained.

A problem of a full line type liquid ejecting head is deflection that occurs in a longitudinal direction, which is a gravity direction. For example, in a case where deflection in the gravity direction occurs due to the mass of the liquid ejecting head itself, the accuracy of landing positions of droplets on a recording medium declines. The line type liquid ejecting head is long in a longitudinal direction, and fixing points of a head supporting member that supports the liquid ejecting head are at both ends of the liquid ejecting head in the longitudinal direction.

For this reason, the head supporting member that supports the head is likely to deflect, and the landing positions of droplets on a recording medium can be shifted. In an ink jet recording apparatus that ejects an ink from a liquid ejecting head to form an image onto a recording medium, image quality declines due to an ink landing position shift.

A liquid ejecting apparatus including a liquid ejecting head having a shape that is long in a width direction of a recording medium is disclosed in JP2008-290342A. In the liquid ejecting head disclosed in JP2008-290342A, a plurality of head modules are supported from a side opposite to a direction where a liquid is ejected by a base member. The plurality of head modules are configured so as to be capable of adjusting a distance between a position in the middle of the base member in a longitudinal direction of the liquid ejecting head and the position of an auxiliary member corresponding to a position in the middle of the base member by using two of the auxiliary member and an adjusting mechanism, which are attached to the base member.

In the liquid ejecting head disclosed in JP2008-290342A, deflection caused by the mass of the long liquid ejecting head is made smaller by adjusting a tightening amount of a screw included in the adjusting mechanism and pulling up the position in the middle of the base member.

The liquid, the liquid ejecting head, the head module, and the longitudinal direction of the liquid ejecting head in the specification correspond to droplets, a droplet ejecting head array, a droplet ejecting head, and an X-direction respectively in JP2008-290342A.

A liquid ejecting head that extends over the entire width of a recording medium is disclosed in JP2009-279783A. The liquid ejecting head disclosed in JP2009-279783A has a structure in which a suspended unit hangs down from a suspending unit included in a mechanism unit, and a coil spring is interposed between the suspending unit and the suspended unit.

In the liquid ejecting head disclosed in JP2009-279783A, deformation stress, which is received by the liquid ejecting head due to the stiffness of the mechanism unit in the case of mounting the liquid ejecting head, is reduced by the suspended unit being elastically suspended on the suspending unit, and the positioning of the liquid ejecting head is realized with high accuracy.

The liquid ejecting head in the specification corresponds to an ink jet recording head or the liquid ejecting head disclosed in JP2009-279783A.

A line type liquid ejecting head is disclosed in JP1991-290252A (JP-H3-290252A). The liquid ejecting head disclosed in JP1991-290252A (JP-H3-290252A) includes a warping adjusting unit at a middle portion in a longitudinal direction, and the warping adjusting unit is configured so as to be capable of adjusting the warping of the liquid ejecting head in the longitudinal direction.

The liquid ejecting head in the specification corresponds to a recording head in JP1991-290252A (JP-H3-290252A).

SUMMARY OF THE INVENTION

However, the liquid ejecting head disclosed in JP2008-290342A adjusts the tightening amount of the screw included in the adjusting mechanism, and thus requires a step of adjusting the tightening amount of the screw and adjusting time.

The liquid ejecting head disclosed in JP2009-279783A suppresses a decline in the accuracy of positioning caused by deformation in the case of being rigidly coupled to the mechanism unit, but does not suppress deflection in the longitudinal direction. That is, the invention disclosed in JP2009-279783A has an object different from an object of the invention, which is easing deflection in the gravity direction.

The warping adjusting unit disclosed in JP1991-290252A (JP-H3-290252A) pushes the liquid ejecting head out by putting the liquid ejecting head under a pressure in the case of adjusting warping. By adjusting warping, deflection occurs in the liquid ejecting head and the position accuracy of the liquid ejecting head is impaired.

The invention is devised in view of such circumstances, and an object of the invention is to provide a liquid ejecting head and a liquid ejecting apparatus, in which deflection in a direction including a component of a gravity direction is eased and preferable liquid ejecting is realized.

In order to accomplish the object, the following aspects of the invention are provided.

According to a first aspect, there is provided a liquid ejecting head comprising a head module that includes an ejecting element ejecting a liquid, a head module supporting member that supports the head module with a head module supporting surface facing a gravity direction or a head module supporting surface in an obliquely downward direction having a component of the gravity direction, and has a structure in which a longitudinal direction of the head module supporting member is a first direction, and a deflection suppressing unit that has a structure in which a longitudinal direction of the deflection suppressing unit is the first direction, and is disposed on a top surface of the head module supporting member, which is a surface opposite to the head module supporting surface. The deflection suppressing unit comprises a deflection absorption unit that is an elastic body of which a longitudinal direction is a direction parallel to the first direction or a direction obliquely intersecting the first direction, and has both end portions in the longitudinal direction that are connected to both end portions of the top surface of the head module supporting member in the first direction, a head module supporting member connection unit of which one end is connected to an intermediate position between the both end portions of the deflection absorption unit in the first direction and the other end is connected to the top surface of the head module supporting member, and a biasing force applying unit that applies a biasing force, which is a force that deflects the deflection absorption unit in a deflection direction of the head module supporting member, to the deflection absorption unit.

According to the first aspect, by applying a biasing force to the deflection absorption unit which is the elastic body and deflecting the deflection absorption unit in the same direction as the deflection direction of the head module supporting member, a reaction of the deflection absorption unit acts on the head module supporting member and the deflection of the head module is eased. In addition, by applying an appropriate biasing force to the deflection absorption unit, the reaction of the deflection absorption unit that can ease the deflection of the head module can be caused.

According to a second aspect, in the liquid ejecting head of the first aspect, a configuration where the biasing force applying unit comprises a spring that is disposed between the deflection absorption unit and the head module supporting member connection unit, which is the spring of which one end is supported by the deflection absorption unit and the other end is supported by the head module supporting member connection unit, and applies the biasing force to the deflection absorption unit by a force of repulsion of the spring may be adopted.

According to the second aspect, a biasing force can be applied to the deflection absorption unit by the spring disposed between the deflection absorption unit and the head module supporting member connection unit, that is the spring of which one end is supported by the deflection absorption unit and the other end is supported by the head module supporting member connection unit.

An appropriate biasing force can be applied to the deflection absorption unit by appropriately selecting a spring constant.

According to a third aspect, in the liquid ejecting head of the first aspect, a configuration where the biasing force applying unit comprises a male screw that connects the head module supporting member and the head module supporting member connection unit together, and applies the biasing force to the deflection absorption unit by the male screw being inserted into a female threaded portion formed in the top surface of the head module supporting member and the male screw being tightened may be adopted.

According to the third aspect, a biasing force can be applied to the deflection absorption unit by the screw that connects the head module supporting member and the head module supporting member connection unit together. By adjusting an amount by which the screw is tightened, an appropriate biasing force can be applied to the deflection absorption unit.

According to a fourth aspect, a configuration where the liquid ejecting head of any one aspect of the first aspect to the third aspect further comprises an external flow path that is disposed outside the head module, and communicates with an internal flow path of the head module, and an external flow path accommodating unit that accommodates the external flow path, and is disposed on the top surface of the head module supporting member, wherein the deflection suppressing unit is disposed between the head module supporting member and the external flow path accommodating unit may be adopted.

According to the fourth aspect, a space for disposing the deflection suppressing unit and a structure for disposing the deflection suppressing unit are not required to be included, and thus a space-saving design of the liquid ejecting head is easy.

According to a fifth aspect, a configuration where the liquid ejecting head of any one aspect of the first aspect to the third aspect further comprises an external flow path that is disposed outside the head module, and communicates with an internal flow path of the head module, and an external flow path accommodating unit that accommodates the external flow path, and is disposed on the top surface of the head module supporting member, wherein the deflection suppressing unit is disposed on a surface of the external flow path accommodating unit, which is opposed to the top surface of the head module supporting member, may be adopted.

According to the fifth aspect, the surface of the external flow path accommodating unit, which is opposed to the top surface of the head module supporting member, can also serve as the deflection suppressing unit, and a space-saving design of the liquid ejecting head is easy.

According to a sixth aspect, in the liquid ejecting head of any one aspect of the first aspect to the fifth aspect, a configuration where the deflection absorption unit is disposed on a side of the head module supporting member in an opposite direction to the gravity direction and the biasing force applying unit applies the biasing force in a direction parallel to the gravity direction to the deflection absorption unit may be adopted.

According to the sixth aspect, the deflection of the liquid ejecting head having a component of the gravity direction is eased by disposing the deflection absorption unit on the side of the head module supporting member in the opposite direction to the gravity direction since the deflection of the liquid ejecting head depends largely on the effect of gravity.

According to a seventh aspect, in the liquid ejecting head of any one aspect of the first aspect to the fifth aspect, a configuration where the deflection suppressing unit comprises a first deflection absorption unit and a first head module supporting member connection unit are disposed in a direction intersecting the gravity direction, and a second deflection suppressing unit of which a second deflection absorption unit and a second head module supporting member connection unit are disposed in a direction intersecting the gravity direction and intersecting the direction where the first deflection absorption unit and the first head module supporting member connection unit are disposed, and the biasing force applying unit applies a first biasing force in a direction parallel to the disposition direction of the first deflection absorption unit and the first head module supporting member connection unit with respect to the first deflection absorption unit, and applies a second biasing force in a direction parallel to the disposition direction of the second deflection absorption unit and the second head module supporting member connection unit with respect to the second deflection absorption unit may be adopted.

According to the seventh aspect, by providing the deflection suppressing unit in each of the two directions intersecting each other and achieving a balance between reactions caused by using the two deflection suppressing units, the head module supporting member can be raised in the opposite direction to the gravity direction and the deflection of the head module supporting member, which is obliquely disposed with respect to the horizontal direction, in the gravity direction can be suppressed.

The disposition direction of the liquid ejecting head, which is a direction orthogonal to the liquid ejecting surface of the head module, is applicable to the direction intersecting the gravity direction of the seventh aspect.

According to an eighth aspect, in the liquid ejecting head of the seventh aspect, a configuration where the first deflection suppressing unit is disposed at a position spaced apart from an intersection point between a straight line passing through a centroid of the liquid ejecting head in a direction orthogonal to a liquid ejecting surface of the liquid ejecting head, and the top surface of the head module supporting member by a distance determined in advance in a second direction orthogonal to the first direction and parallel to the top surface of the head module supporting member, may be adopted.

According to the eighth aspect, the deflection of the liquid ejecting head, in which the head module supporting member is twisted, can be eased.

According to a ninth aspect, in the liquid ejecting head of the seventh aspect, a configuration where the deflection suppressing unit comprises a third deflection suppressing unit of which a third deflection absorption unit and a third head module supporting member connection unit are disposed in the direction intersecting the gravity direction, the third deflection suppressing unit being disposed so as to be spaced apart from the first deflection suppressing unit by a distance determined in advance in a second direction orthogonal to the first direction and parallel to the top surface of the head module supporting member, and the biasing force applying unit applies a third biasing force in a direction which is the same as the direction of the first biasing force may be adopted.

According to the ninth aspect, by adjusting a force generated by the first deflection suppressing unit and a force generated by the third deflection suppressing unit, the deflection of the liquid ejecting head, in which the head module supporting member is twisted, can be eased.

According to a tenth aspect, in the liquid ejecting head of the ninth aspect, a configuration where the third deflection suppressing unit is disposed at a position spaced apart from an intersection point between a straight line passing through a centroid of the liquid ejecting head in a direction orthogonal to a liquid ejecting surface of the liquid ejecting head, and the top surface of the head module supporting member by a distance determined in advance in the second direction orthogonal to the first direction and parallel to the top surface of the head module supporting member, may be adopted.

According to the tenth aspect, by adjusting a force generated by the first deflection suppressing unit and a force generated by the third deflection suppressing unit, a force that eases the deflection of the liquid ejecting head, in which the head module supporting member is twisted around a rotation axis passing through the centroid of the liquid ejecting head, which is a rotation axis in the direction parallel to the first direction, can be generated.

According to an eleventh aspect, in the liquid ejecting head of the seventh aspect or the eighth aspect, a configuration where the deflection suppressing unit comprises a fourth deflection suppressing unit of which a fourth deflection absorption unit and a fourth head module supporting member connection unit are disposed in a direction intersecting the gravity direction and intersecting the direction where the first deflection absorption unit and the first head module supporting member connection unit are disposed, the fourth deflection suppressing unit being disposed at a position opposed to the second deflection suppressing unit in the second direction orthogonal to the first direction and parallel to the top surface of the head module supporting member, and the biasing force applying unit applies a fourth biasing force in a direction parallel to the second biasing force, which is an opposite direction to the second biasing force, may be adopted.

According to the eleventh aspect, by adjusting a force generated by the second deflection suppressing unit and a force generated by the fourth deflection suppressing unit, the deflection of the liquid ejecting head, in which the head module supporting member is twisted, can be eased.

According to a twelfth aspect, in the liquid ejecting head of any one aspect of the first aspect to the eleventh aspect, a configuration where the deflection absorption unit is disposed on a side of the centroid of the liquid ejecting head in the opposite direction to the gravity direction may be adopted.

According to the twelfth aspect, the deflection of the liquid ejecting head having a component of the gravity direction is eased by disposing the deflection absorption unit on the side of the centroid of the liquid ejecting head in the opposite direction to the gravity direction since the deflection of the liquid ejecting head depends largely on the effect of gravity.

According to a thirteenth aspect, in the liquid ejecting head of any one aspect of the first aspect to the twelfth aspect, a configuration where the deflection suppressing unit comprises a moving mechanism that supports at least one of both ends of the head module supporting member in the longitudinal direction so as to be movable to an outside in the longitudinal direction of the head module supporting member may be adopted.

According to the thirteenth aspect, by making at least one of the both ends of the head module supporting member in the longitudinal direction movable to the outside in the longitudinal direction of the head module supporting member, the movement of at least one of the both ends of the head module supporting member in the longitudinal direction is not restricted in a case where the deflection of the liquid ejecting head in the gravity direction is eased.

Therefore, it can be avoided that the easing of deflection of the liquid ejecting head in the gravity direction, which is caused by restricting the movement of at least one of the both ends of the head module supporting member in the longitudinal direction, is restricted.

In the thirteenth aspect, by the moving mechanisms being included at the both ends of the head module supporting member in the longitudinal direction, the movement area of the head module supporting member can be made larger compared to a case where the moving mechanism is provided at one end of the head module supporting member in the longitudinal direction.

In the thirteenth aspect, by the moving mechanism being included at one end of the head module supporting member in the longitudinal direction, the structure of the head module supporting member is simpler compared to a case where the moving mechanisms are provided at the both ends of the head module supporting member in the longitudinal direction.

According to a fourteenth aspect, in the liquid ejecting head of any one aspect of the first aspect to the thirteenth aspect, a configuration where a plurality of the head modules are provided may be adopted.

According to the fourteenth aspect, the deflection of the liquid ejecting head including the plurality of head modules is eased.

According to a fifteenth aspect, in the liquid ejecting head of the fourteenth aspect, a configuration where the plurality of head modules are arranged in a line in the first direction may be adopted.

According to the fifteenth aspect, the deflection of the liquid ejecting head, in which the plurality of head modules are arranged in one line in the first direction, is eased.

According to a sixteenth aspect, in the liquid ejecting head of the fourteenth aspect or the fifteenth aspect, a configuration where the plurality of head modules are arranged in a line in the first direction over a length that is equal to or larger than an entire length of a recording medium, to which the liquid ejected from the head modules is applied, in the first direction, may be adopted.

According to the sixteenth aspect, the deflection of the liquid ejecting head, in which the plurality of head modules are arranged over the length corresponding to the entire width of the recording medium, is eased.

According to a seventeenth aspect, there is provided a liquid ejecting apparatus comprising a recording medium transporting unit that transports a recording medium and a liquid ejecting head that ejects a liquid to be applied to the recording medium. The liquid ejecting head includes the liquid ejecting head according to any one of the first aspect to the sixteenth aspect.

According to the seventeenth aspect, the same operation effect as the liquid ejecting head of any one of the first aspect to the sixteenth aspect can be obtained.

According to an eighteenth aspect, in the liquid ejecting apparatus of the seventeenth aspect, a configuration where the liquid ejecting head is disposed in a direction orthogonal to a direction where the recording medium is transported by the recording medium transporting unit as the first direction may be adopted.

According to a nineteenth aspect, in the liquid ejecting apparatus of the seventeenth aspect or the eighteenth aspect, a configuration where a plurality of the liquid ejecting heads are provided and the plurality of liquid ejecting heads are arranged in the direction where the recording medium is transported by the recording medium transporting unit may be adopted.

An ink jet recording apparatus that draws in an ink jet method is given as an example of the liquid ejecting apparatus of any one aspect of the seventeenth aspect to the nineteenth aspect.

According to the invention, by applying a biasing force to the deflection absorption unit, which is the elastic body, to deflect the deflection absorption unit in the same deflection direction as the deflection direction of the head module supporting member, the reaction of the deflection absorption unit acts on the head module supporting member, and the deflection of the head module is eased. In addition, the reaction of the deflection absorption unit that can ease the deflection of the head module can be caused by applying an appropriate biasing force to the deflection absorption unit.

DESCRIPTION OF THE PREFERRED EMBODIMENTS

Hereinafter, a preferable embodiment of the invention will be described in detail in accordance with accompanying drawings.

[Structure of Liquid Ejecting Head]

<Overall Configuration>

Figure 1:
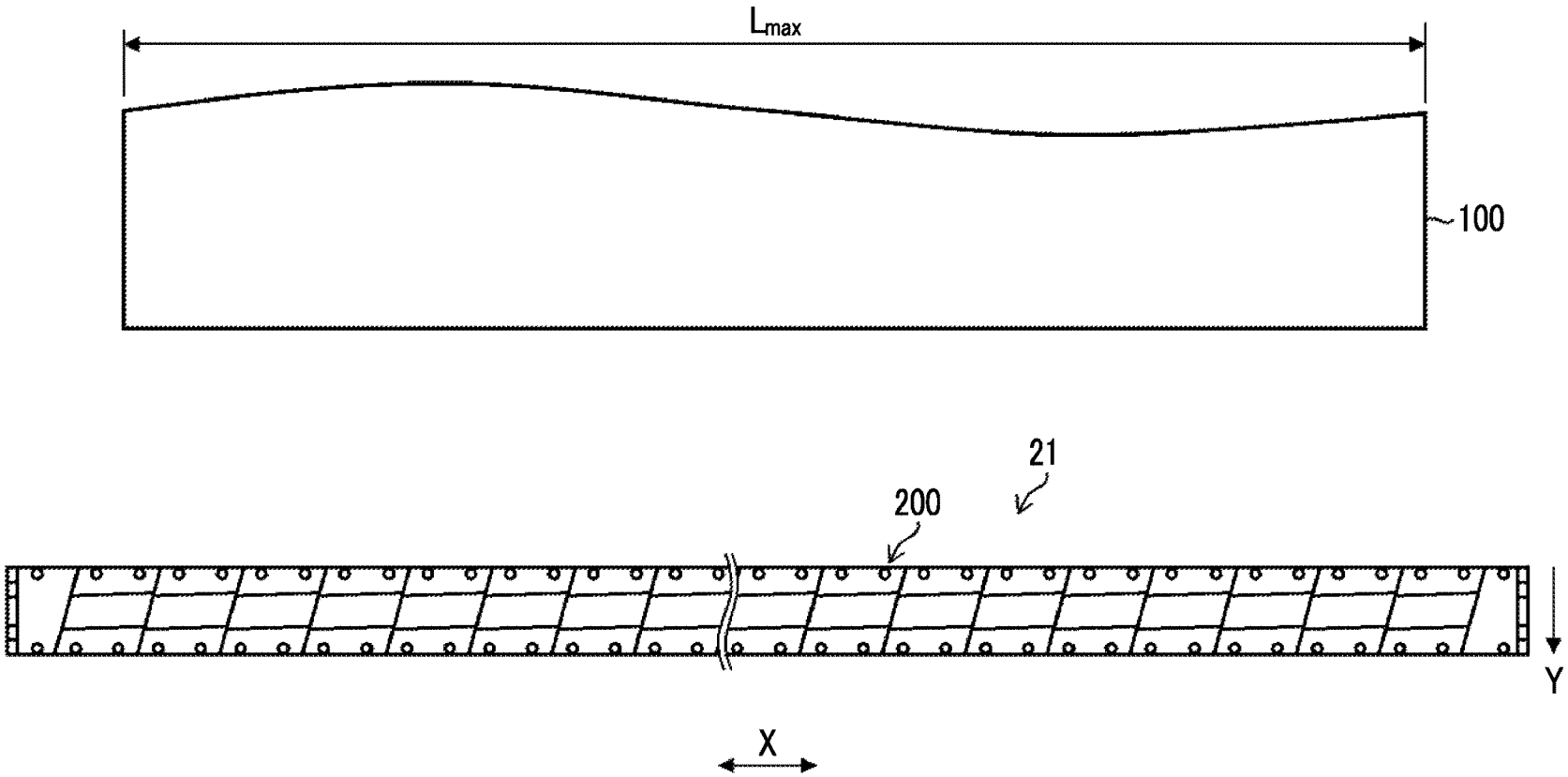
FIG. 1 is a perspective plan view illustrating a structure example of a liquid ejecting head.

FIG. 1 is a perspective plan view illustrating a structure example of a liquid ejecting head. A liquid ejecting head 21 illustrated in FIG. 1 has a structure in which a plurality of head modules 200 are joined together in a width direction of a recording medium 100, which is a direction orthogonal to a transporting direction of the recording medium 100.

The width direction of the recording medium 100 is illustrated with an arrow line with a reference sign X assigned. The transporting direction of the recording medium 100 is illustrated with an arrow line with a reference sign Y assigned. The width direction of the recording medium 100 or a disposition direction of the plurality of head modules corresponds to a first direction.

In the specification, the transporting direction of the recording medium 100 is referred to as a recording medium transporting direction, a medium transporting direction, or simply a transporting direction, in some cases. These words can be used interchangeably with each other as appropriate.

Figure 4:
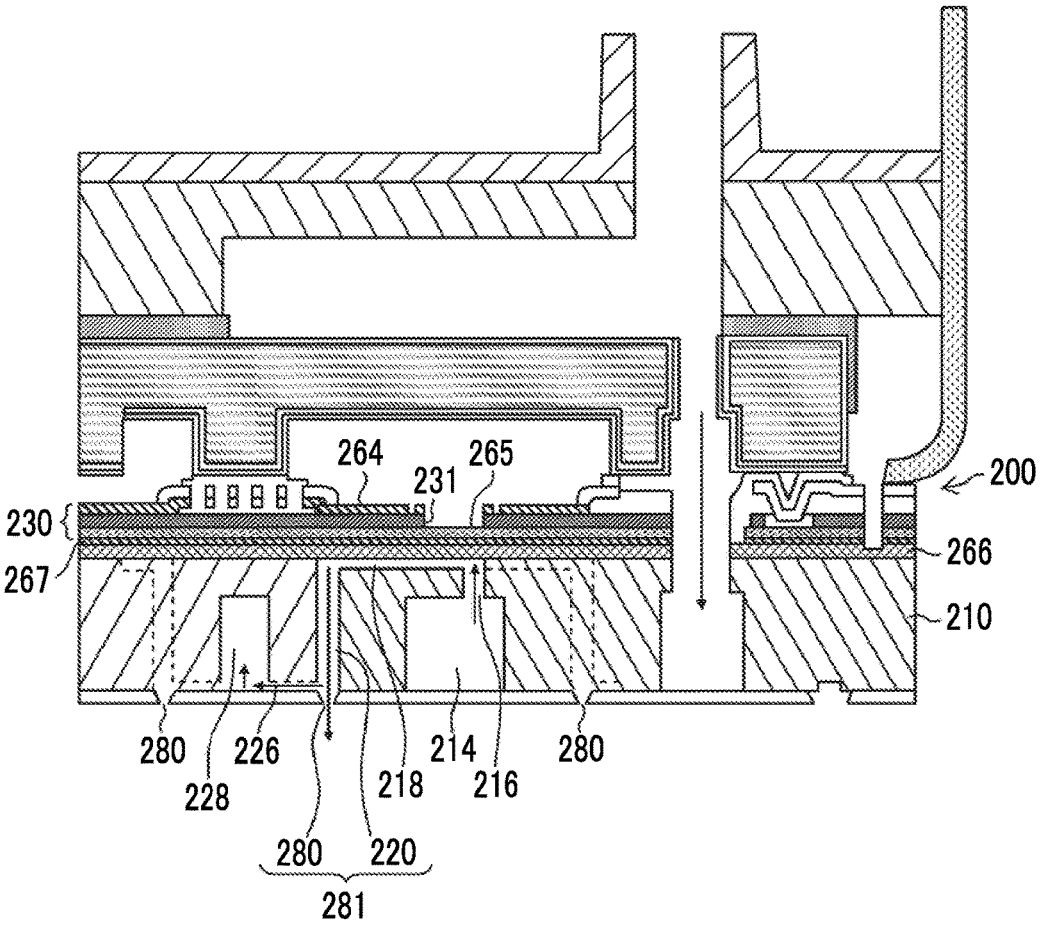
FIG. 4 is a sectional view illustrating an internal structure of the head module.

The liquid ejecting head 21 illustrated in FIG. 1 is a line type liquid ejecting head in which a plurality of nozzle units are arranged over a length that is equal to or larger than an entire length $L_{max}$ of the recording medium 100 in the width direction of the recording medium 100. The nozzle units which are not illustrated in FIG. 1 are illustrated in FIG. 4 with a reference sign 281 assigned.

The liquid ejecting head 21 illustrated in FIG. 1 is an embodiment of a liquid ejecting head in which the nozzle units are arranged in a line in the first direction over a length that is equal to or larger than the entire length of a recording medium, to which a liquid ejected from the head modules are applied, in the first direction.

The same structure is applicable to the plurality of head modules 200 configuring the liquid ejecting head 21. In addition, even a single head module 200 can function as the liquid ejecting head.

Although illustration is omitted in FIG. 1, the liquid ejecting head 21 includes a deflection suppressing unit. The deflection suppressing unit which is not illustrated in FIG. 1 eases the deflection of the liquid ejecting head 21 in a gravity direction. The gravity direction in FIG. 1 is a direction of penetrating the page from a front surface to a back surface. Details of the deflection suppressing unit will be described later.

<Structure of Head Module>

Figure 2:
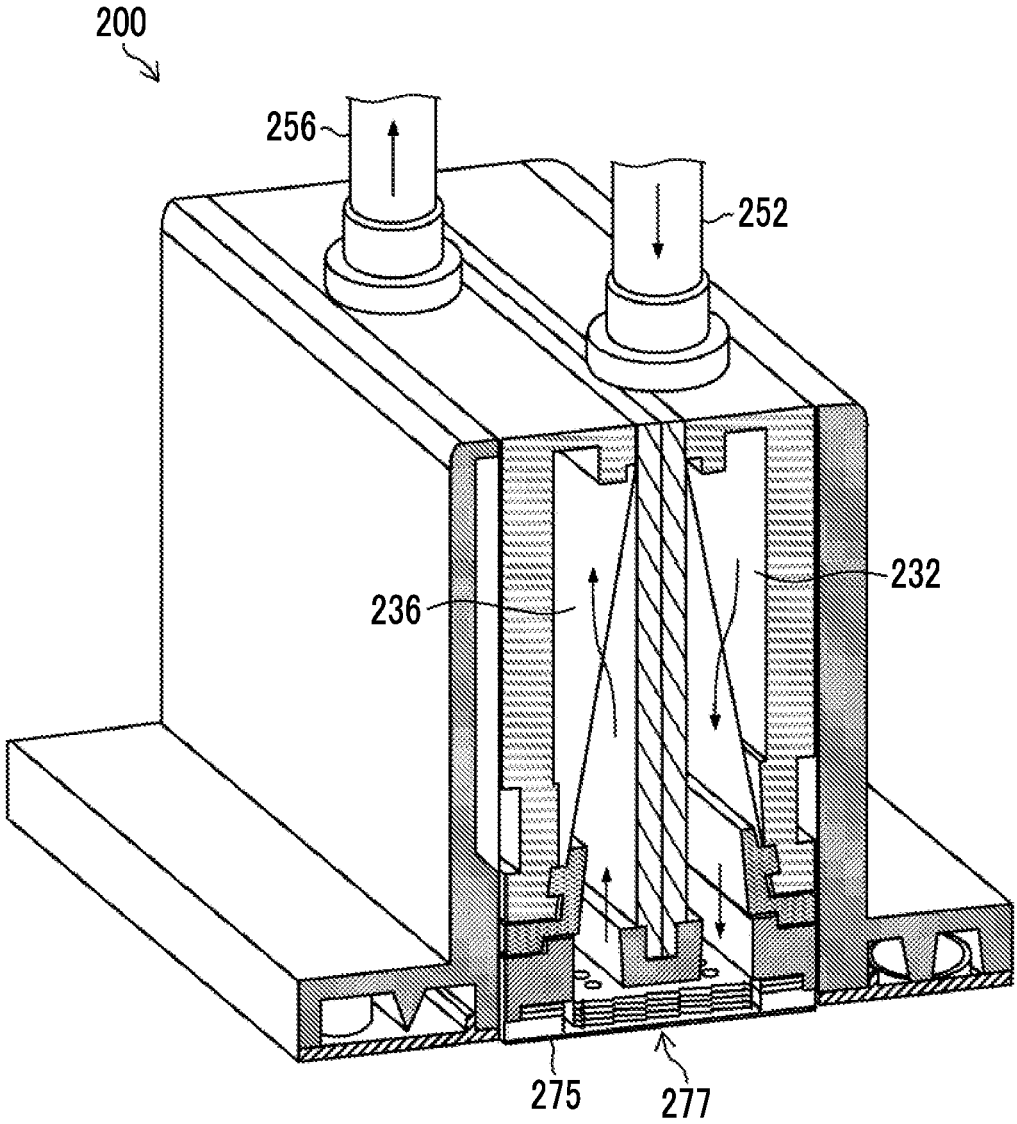
FIG. 2 is a perspective view of a head module and is a view including a partial sectional view.

FIG. 2 is a perspective view of the head module and is view including a partial sectional view. Hereinafter, configurations that are the same as the configurations described above will be assigned with the same reference signs and description thereof will be appropriately omitted.

An ink is an embodiment of a liquid in the specification, and the word "ink" and the word "liquid" can be appropriately switched. In addition, in the specification, the word "jetting" and the word "ejecting" can be regarded as synonyms, and the word "jetting" and the word "ejecting" can be appropriately switched.

The head modules 200 each have an ink supplying unit consists of an ink supplying chamber 232 and an ink circulation chamber 236 on a top surface of a nozzle plate 275 in FIG. 2, which is opposite to a liquid ejecting surface 277.

The ink supplying chamber 232 is connected to an ink tank (not illustrated) via a supply side individual flow path 252, and the ink circulation chamber 236 is connected to a collection tank (not illustrated) via a collection side individual flow path 256.

Figure 3:
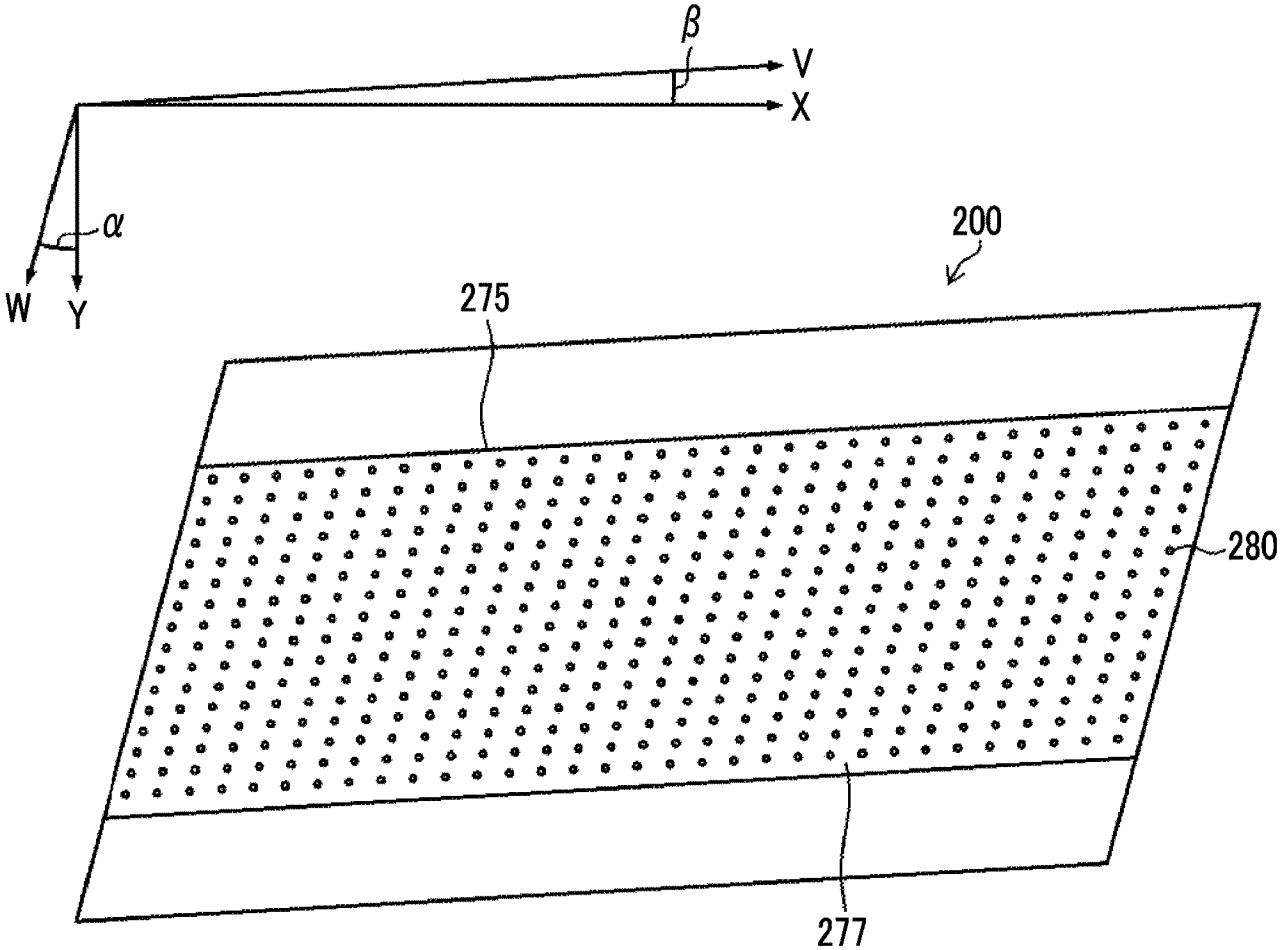
FIG. 3 is a perspective plan view of a liquid ejecting surface of the head module.

FIG. 3 is a perspective plan view of the liquid ejecting surface of the head module. Although the number of the nozzle openings 280 arranged in the liquid ejecting surface 277 is not exactly illustrated in FIG. 3, the plurality of nozzle openings 280 are arranged in the liquid ejecting surface 277 of one head module 200 with two-dimensional arrangement being applied.

The head modules 200 each have a planar shape of a parallelogram having an edge on a long side that has an inclination of an angle β with respect to the direction orthogonal to the recording medium transporting direction and extends in a V-direction and an edge on a short side that has an inclination of an angle α with respect to the recording medium transporting direction and extends in a W-direction. As for a column direction along the V-direction and a row direction along the W-direction, the plurality of nozzle openings 280 are arranged in a matrix.

The arrangement of the nozzle openings 280 is not limited to the form illustrated in FIG. 3, and the plurality of nozzle openings 280 may be arranged in the column direction along the direction orthogonal to the recording medium transporting direction and the row direction obliquely intersecting the direction orthogonal to the recording medium transporting direction.

The arrangement of the nozzle openings 280 in a matrix is the arrangement of the nozzle openings 280 in which arrangement intervals between the nozzle openings 280 are uniform in projected nozzle columns in the direction orthogonal to the recording medium transporting direction, which are obtained by projecting the plurality of nozzle openings 280 in the direction orthogonal to the recording medium transporting direction and arranging the plurality of nozzle openings 280 in the direction orthogonal to the recording medium transporting direction.

FIG. 4 is a sectional view illustrating an internal structure of the liquid ejecting head. A reference sign 214 indicates an ink supply path, a reference sign 218 indicates a pressure chamber, a reference sign 216 indicates an individual supply path connecting the pressure chamber 218 and an ink supply path 214 together, a reference sign 220 indicates a nozzle communication path connected from the pressure chamber 218 to one of the nozzle openings 280, and a reference sign 226 indicates a circulation individual flow path connecting the nozzle communication path 220 and a circulation common flow path 228. The pressure chamber 218 is called as a liquid chamber in some cases.

A diaphragm 266 is provided on a flow path structure 210 configuring the ink supply path 214, the individual supply path 216, the pressure chamber 218, the nozzle communication path 220, the circulation individual flow path 226, and the circulation common flow path 228. A piezoelectric element 230 formed in a structure where a lower electrode 265, a piezoelectric layer 231, and an upper electrode 264 are laminated is provided on the diaphragm 266 via an adhesive layer 267. The lower electrode 265 is called as a common electrode in some cases, and the upper electrode 264 is called as an individual electrode in some cases. The ink supply path 214, the individual supply path 216, the pressure chamber 218, the nozzle communication path 220, the circulation individual flow path 226, and the circulation common flow path 228 are configuration elements of an internal flow path.

The upper electrode 264 is an individual electrode that is patterned so as to correspond to the shape of the pressure chamber 218, and the piezoelectric element 230 is provided for each pressure chamber 218.

The ink supply path 214 is connected to the ink supplying chamber 232 illustrated in FIG. 2, and an ink is supplied from the ink supply path 214 to the pressure chamber 218 via the individual supply path 216. Due to the applying of a drive voltage to the upper electrode 264 of the piezoelectric element 230 provided for the corresponding pressure chamber 218 according to input image data, the piezoelectric element 230 and the diaphragm 266 deform and thus the volume of the pressure chamber 218 changes. Due to a pressure change accompanying the volume change, an ink is jetted from the nozzle opening 280 via the nozzle communication path 220.

By controlling the driving of the piezoelectric element 230 corresponding to each of the nozzle openings 280 according to dot arrangement data generated from input image data, an ink can be jetted from each of the nozzle openings 280.

By transporting the recording medium 100 at a constant speed in the recording medium transporting direction while controlling a timing at which an ink is jetted from each of the nozzle openings 280 in accordance with a transporting speed, a desirable image can be recorded onto the recording medium 100.

The planar shape of the pressure chamber 218 provided so as to correspond to each of the nozzle openings 280 is a substantially square, an outlet to the nozzle opening 280 is provided at one of both corners on a diagonal line, and the individual supply path 216, which is an inlet of a supplied ink, is provided at the other corner. The illustration of the planar shape of the pressure chamber 218 is omitted.

The planar shape of the pressure chamber is not limited to a square. The planar shape of the pressure chamber can take a variety of forms including a quadrangle such as a diamond and a rectangle, a polygonal shape such as a pentagon and a hexagon, a circle, and an ellipse.

A circulation outlet is formed in a nozzle unit 281 including the nozzle opening 280 and the nozzle communication path 220, and the nozzle unit 281 communicates with the circulation individual flow path 226 via the circulation outlet. In an ink in the nozzle communication path 220 and in the nozzle opening 280, an ink which is not used in jetting is collected on the circulation common flow path 228 via the circulation individual flow path 226.

The circulation common flow path 228 is connected to the ink circulation chamber 236 illustrated in FIG. 2. Thus, the thickening of an ink in the vicinity of the nozzle opening 280 during non jetting is prevented by collecting an ink on the circulation common flow path 228 at all times through the circulation individual flow path 226.

A form, in which one nozzle unit 281, a flow path such as the pressure chamber 218 which communicates with one nozzle unit 281, and the piezoelectric element 230 corresponding to the nozzle unit 281 are included, is given as an embodiment of an ejecting element included in the head module.

The word "nozzle opening" and the word "nozzle unit" in the specification can be used interchangeably with each other as appropriate.

The piezoelectric element 230 having a structure of being separated individually so as to correspond to each of the nozzle units 281 is given as an example of the piezoelectric element 230. Without a doubt, a structure in which the piezoelectric layer 231 is integrally formed with the plurality of nozzle units 281, an individual electrode is formed so as to correspond to each of the nozzle units 281, and an active region is formed for each of the nozzle units 281 may be applied.

A thermal method, in which a heater is included inside the pressure chamber 218 as a pressure generating element instead of the piezoelectric element, a drive voltage is supplied to the heater to generate heat, and an ink in the pressure chamber 218 is jetted from the nozzle opening 280 with a film boiling phenomenon, may be applied.

[The Description of Deflection Suppressing Unit]

First Embodiment

Figure 5:
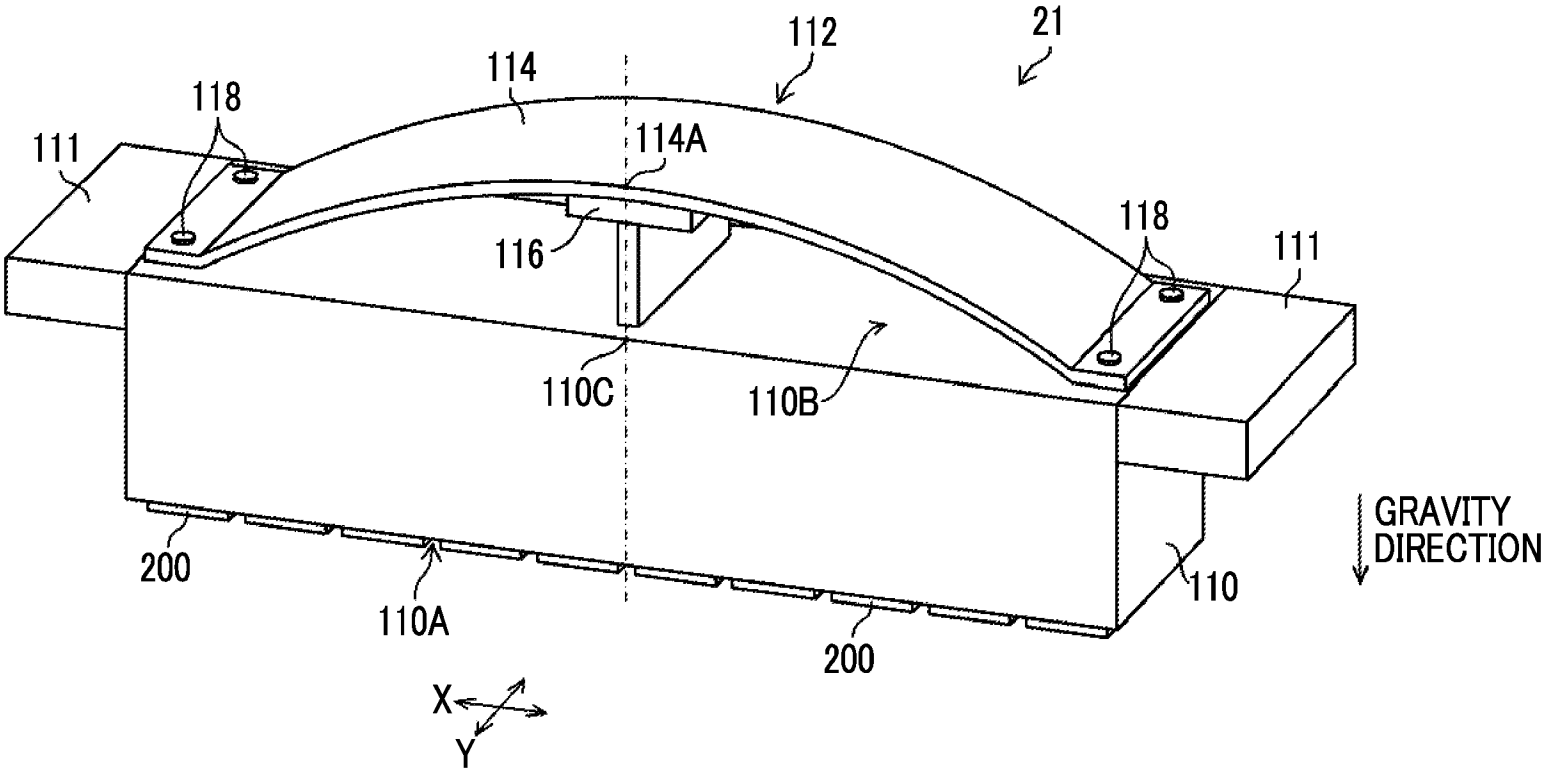
FIG. 5 is a schematic view illustrating a configuration of a deflection suppressing unit according to a first embodiment.

FIG. 5 is a schematic view illustrating a configuration of a deflection suppressing unit according to a first embodiment. For convenience of illustration, the number of the head modules 200 is smaller in FIG. 5 than in FIG. 1. The same also applies to views subsequent to FIG. 6.

The description of the deflection of the liquid ejecting head in the gravity direction will be made in the embodiment. The same applies to a second embodiment to a fifth embodiment of which the description is to be made. In the following description, a deflection direction of the liquid ejecting head can be used interchangeably with the gravity direction.

As illustrated in FIG. 5, the plurality of head modules 200 arranged in the longitudinal direction of the liquid ejecting head 21 illustrated in FIG. 1 are supported by a head module supporting surface 110A of a head module supporting member 110 of which the illustration is omitted in FIG. 1.

Figure 8:
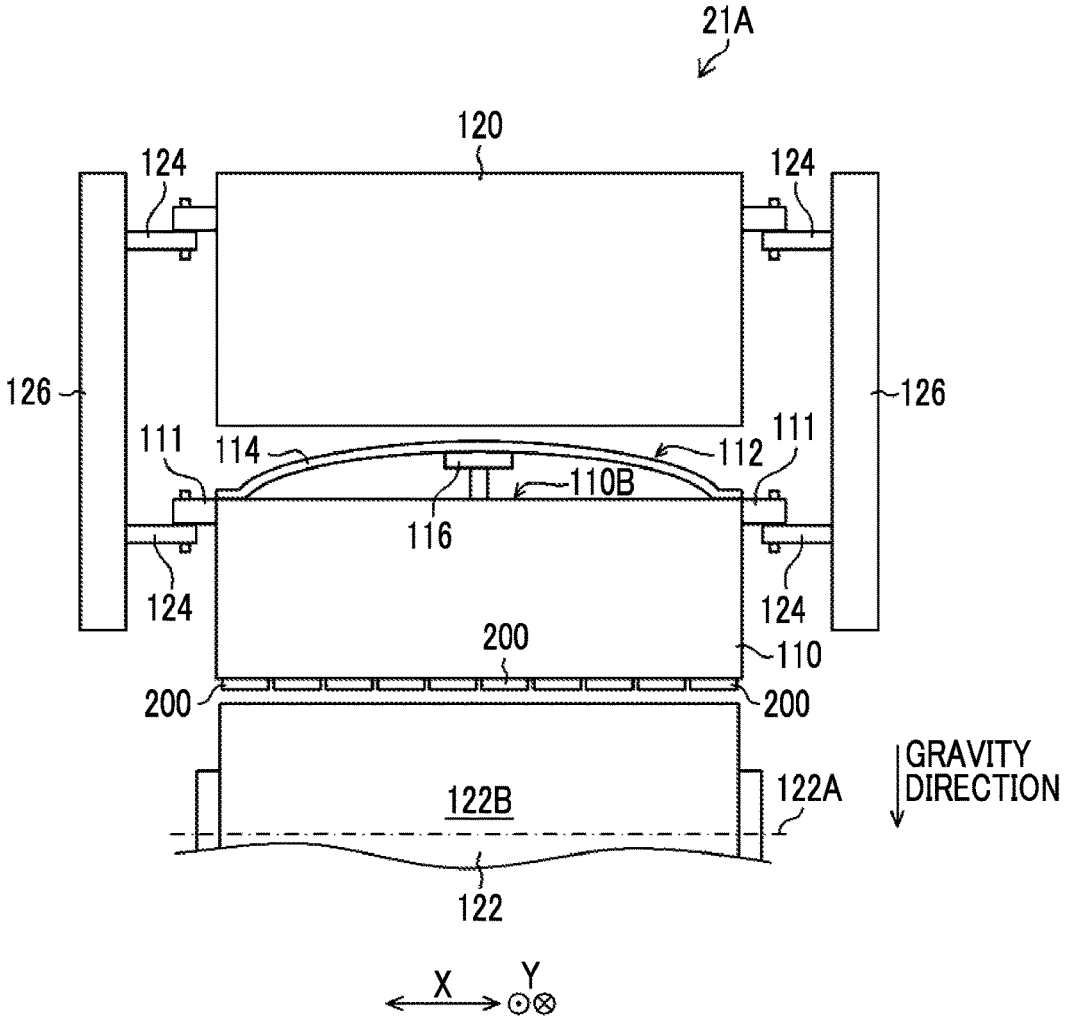
FIG. 8 is a schematic view illustrating a configuration of a deflection suppressing unit according to a second embodiment.

Attachment units 111 are provided at both ends of the head module supporting member 110 in the longitudinal direction. The attachment units 111 of the head module supporting member 110 are attached to a main body frame which is not illustrated in FIG. 5. The main body frame is illustrated in FIG. 8 with a reference sign 126 assigned. The longitudinal direction of the liquid ejecting head corresponds to the first direction.

A deflection suppressing unit 112 is attached to a top surface 110B of the head module supporting member 110 illustrated in FIG. 5. The top surface 110B of the head module supporting member 110 is a surface opposite to the head module supporting surface 110A in the gravity direction.

The deflection suppressing unit 112 illustrated in FIG. 5 includes a sacrifice member 114 and an intermediate connection unit 116. The sacrifice member 114 is an embodiment of a deflection absorption unit. The intermediate connection unit 116 is an embodiment of a head module supporting member connection unit.

The sacrifice member 114 has a curved shape which projects in an opposite direction to a deflection direction of the head module supporting member 110. Herein, the deflection direction of the head module supporting member 110 can be used interchangeably with the deflection direction of the liquid ejecting head 21.

The deflection direction of the head module supporting member 110 illustrated in FIG. 5 is the gravity direction. An elastic body is applied to the sacrifice member 114. For example, a metal material, a resin material, or a composite material of a metal material and a resin material can be applied to the sacrifice member 114.

Both end portions of the sacrifice member 114 in the longitudinal direction are connected to the head module supporting member 110 by screws 118. A space in which the sacrifice member 114 is deflected in a direction of the head module supporting member 110 is provided for the sacrifice member 114 at an intermediate position in the longitudinal direction between the head module supporting member 110 and the sacrifice member. Herein, the intermediate position is any position between the both ends in a longitudinal direction of the sacrifice member 114. Both end portions of the sacrifice member 114 in the longitudinal direction are within an area where the both ends of the sacrifice member 114 in the longitudinal direction are included, and are within an area having a distance determined in advance from the both ends of the sacrifice member 114 in the longitudinal direction to the inside. The distance determined in advance is determined from a perspective of connecting the sacrifice member 114 and the head module supporting member 110 together.

At the intermediate position in the longitudinal direction, the sacrifice member 114 is connected to the head module supporting member 110 via the intermediate connection unit 116. The longitudinal direction of the sacrifice member 114 is parallel to the longitudinal direction of the liquid ejecting head 21 illustrated in FIG. 5 with the reference sign X assigned.

A middle position 114A in the longitudinal direction of the sacrifice member 114 is given as an example of the intermediate position between the both ends of the sacrifice member 114 in the longitudinal direction. In FIG. 5, a form in which the intermediate connection unit 116 is connected to the sacrifice member 114 at the middle position 114A in the longitudinal direction of the sacrifice member 114 is illustrated. The middle position 114A in the longitudinal direction of the sacrifice member 114 is a position on a boundary in a case where the sacrifice member 114 is bisected in the longitudinal direction.

As illustrated in FIG. 5, one end of the intermediate connection unit 116 is connected to the sacrifice member 114. The other end of the intermediate connection unit 116 is connected to the head module supporting member 110. A connecting position of the intermediate connection unit 116 to the head module supporting member 110 is an intermediate position between the both ends of the head module supporting member 110 in the longitudinal direction.

At a middle position 110C in the longitudinal direction, the head module supporting member 110 illustrated in FIG. 5 is connected to the intermediate connection unit 116. The longitudinal direction of the head module supporting member 110 is parallel to the longitudinal direction of the liquid ejecting head 21 illustrated in FIG. 5 with the reference sign X assigned. The middle position 110C in the longitudinal direction of the head module supporting member 110 is a positioned on a boundary in a case where the head module supporting member 110 is bisected in the longitudinal direction.

A member having plasticity in the gravity direction is applied to the intermediate connection unit 116.

Although the sacrifice member 114 having a length corresponding to the entire length of the head module supporting member 110 in a traverse direction of the liquid ejecting head 21 is given as an example in FIG. 5, the entire length of the sacrifice member 114 in the traverse direction of the liquid ejecting head 21 can be appropriately changed according to conditions such as the performance of the sacrifice member 114 and a space for attaching the sacrifice member 114.

A known connecting technique, such as tightening by a screw and adhesion, is applicable to connection between the sacrifice member 114 and the intermediate connection unit 116. It is sufficient that the connection between the sacrifice member 114 and the intermediate connection unit 116 does not become broken.

Similarly, a known connecting technique, such as tightening by a screw and adhesion, is applicable to connection between the head module supporting member 110 and the intermediate connection unit 116. It is sufficient that the connection between the head module supporting member 110 and the intermediate connection unit 116 does not become broken.

Figure 6:
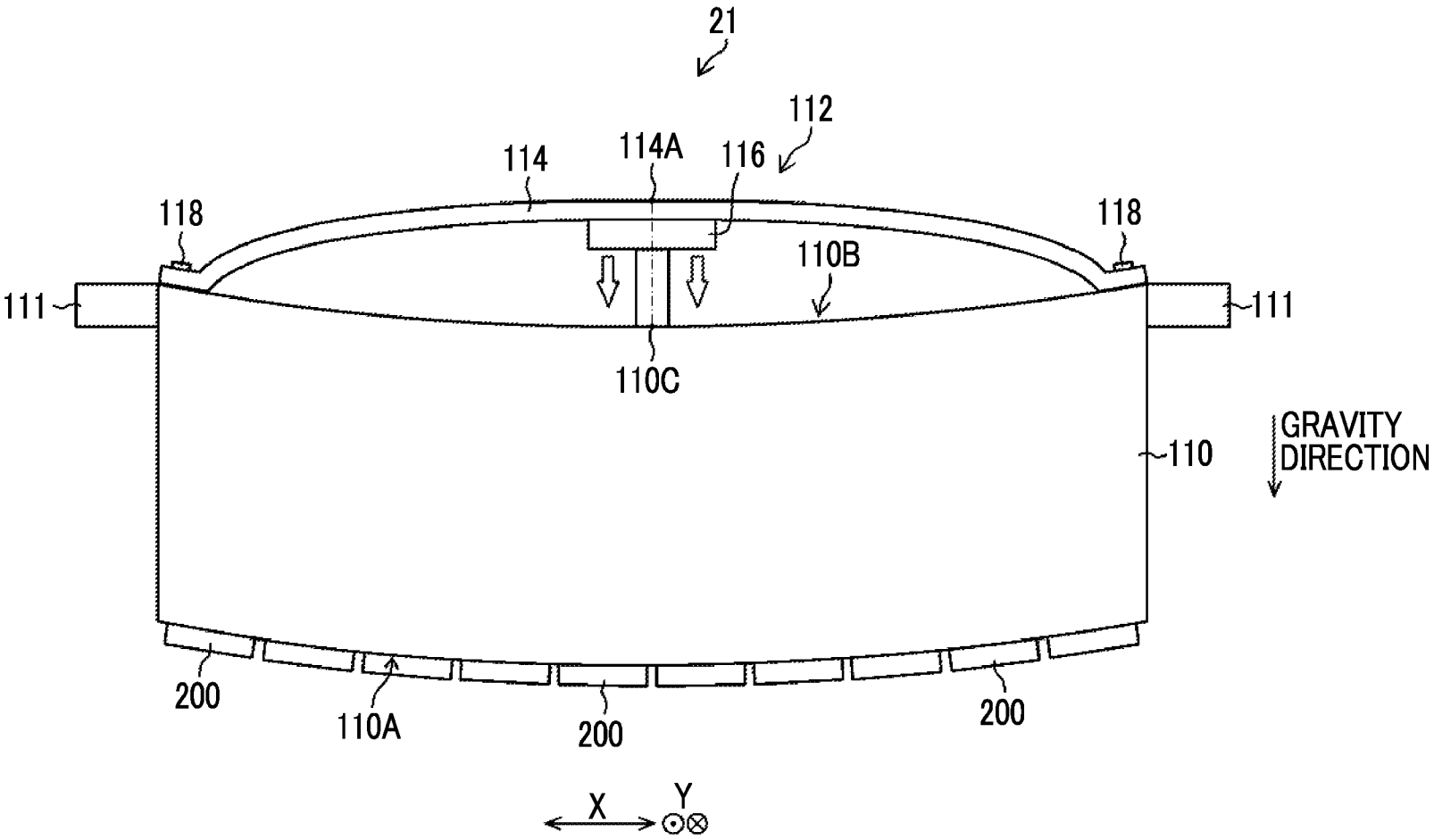
FIG. 6 is a schematic view in the case of connecting the deflection suppressing unit illustrated in FIG. 5 to a head module supporting member.
Figure 7:
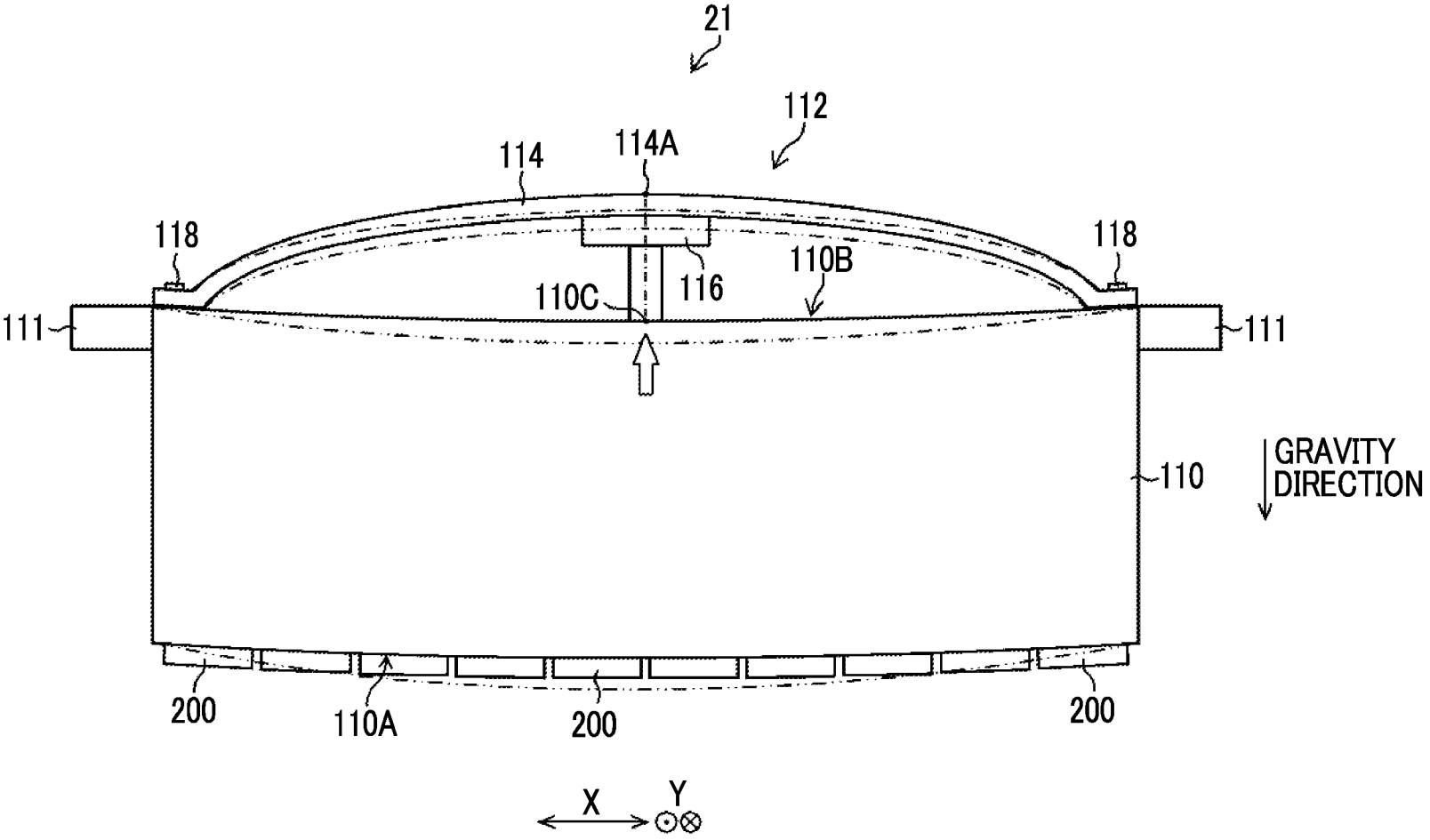
FIG. 7 is a schematic view in a state where the deflection suppressing unit illustrated in FIG. 5 is connected to the head module supporting member.

Next, the description of operation of the deflection suppressing unit 112 will be made. FIG. 6 is a schematic view in the case of connecting the deflection suppressing unit illustrated in FIG. 5 to the head module supporting member. FIG. 7 is a schematic view in a state where the deflection suppressing unit illustrated in FIG. 5 is connected to the head module supporting member.

As illustrated in FIG. 6, in a case where the intermediate connection unit 116 connected to the sacrifice member 114 is connected to the head module supporting member 110 deflected in the deflection direction of the head module supporting member 110, the intermediate connection unit 116 applies a biasing force in the same direction as the deflection direction of the head module supporting member 110 to the sacrifice member 114.

Consequently, deflection occurs in the sacrifice member 114 in the same direction as the head module supporting member 110. Downward arrow lines illustrated in FIG. 6 indicate the biasing force applied to the sacrifice member 114.

For example, if a biasing force is applied to the sacrifice member 114 in the deflection direction of the head module supporting member 110, the intermediate connection unit 116 is brought into contact with the top surface 110B of the head module supporting member 110, and the intermediate connection unit 116 is connected to the top surface 110B of the head module supporting member 110 in a case where the intermediate connection unit 116 has a length in the gravity direction which allows the intermediate connection unit not to reach the top surface 110B of the head module supporting member 110 in a state where a biasing force is not applied to the sacrifice member 114 in the deflection direction of the head module supporting member 110, the sacrifice member 114 in which deflection occurs in the same direction as the head module supporting member 110 is realized.

As illustrated in FIG. 7, in a case where the intermediate connection unit 116 is connected to the head module supporting member 110 in a state where the sacrifice member 114 is deflected in the same direction as the deflection direction of the head module supporting member 110, the intermediate connection unit 116 receives a reaction from the sacrifice member 114 in an opposite direction to the deflection direction of the head module supporting member 110. An upward arrow line illustrated in FIG. 7 indicates the reaction from the sacrifice member 114 received by the head module supporting member 110 via the intermediate connection unit 116, which is the reaction in the opposite direction to the original deflection direction of the head module supporting member 110.

As a result, by the head module supporting member 110 receiving the reaction in the opposite direction to the deflection in the gravity direction, the deflection of the head module supporting member 110 in the gravity direction is eased.

By easing the deflection of the head module supporting member 110 in the gravity direction in this manner, the deflection of a liquid ejecting head 21A in the gravity direction is eased.

By appropriately determining the modulus of elasticity of the sacrifice member 114 according to the deflection amount of the liquid ejecting head 21 in the gravity direction with the displacement amount of the sacrifice member 114 fixed, or appropriately adjusting the modulus of elasticity of the sacrifice member 114 and the displacement amount of the sacrifice member 114, the deflection of the liquid ejecting head 21 is eased so as to be kept at a certain level or lower since a reaction caused by the sacrifice member 114 is proportional to the modulus of elasticity of the sacrifice member 114 and the displacement amount of the sacrifice member 114.

Two-dot chain lines of FIG. 7 indicate, from above, the sacrifice member 114 illustrated in FIG. 6, the top surface 110B of the head module supporting member 110, and the head module supporting surface 110A of the head module supporting member 110, respectively.

<Operation Effect of First Embodiment>

In the liquid ejecting head according to the first embodiment, the head module supporting member that supports the liquid ejecting head is raised in the opposite direction to the deflection direction of the liquid ejecting head as a reaction in the opposite direction to the deflection direction of the liquid ejecting head acts on the head module supporting member, which is caused in a case where a biasing force is applied to the sacrifice member 114, that is an elastic body, to deflect the sacrifice member 114 in the deflection direction of the liquid ejecting head. Therefore, the deflection of the liquid ejecting head in which the sacrifice member 114, that is the elastic body, is used can be eased.

In a case where the sacrifice member 114, which is an elastic body, is used, the biasing force determined in advance is applied to deflect the sacrifice member 114, which is an elastic body. By doing so, the determined reaction can act on the head module supporting member and adjustment is not required.

The deflection suppressing unit 112 is advantageous in that a space-saving design is easy since the deflection suppressing unit is attached to the top surface of the head module supporting member 110.

A deflection easing function of the deflection suppressing unit 112 is advantageous in that accuracy management is easy since the deflection suppressing unit is closed in a unit in which the liquid ejecting head 21 is disposed. That is, as the sacrifice member 114 deflects, the deflection suppressing unit 112 improves the attached position accuracy of the head module supporting member 110 and the head modules 200.

An ink jet recording apparatus that forms a color image includes a liquid ejecting head for each color. In a case where a plurality of liquid ejecting heads are included for each color, the plurality of liquid ejecting heads are disposed in parallel in a direction orthogonal to the transporting direction of the recording medium. The direction orthogonal to the transporting direction of the recording medium is synonymous with the longitudinal direction of the liquid ejecting head.

Since clearances between the liquid ejecting heads in the traverse direction are small, it is often difficult to attach the deflection suppressing unit 112 to the outside of the liquid ejecting head, such as an area between the liquid ejecting heads. For example, it is difficult to provide an auxiliary frame, which is added to a head supporting member, on the outside of the liquid ejecting heads to attach the deflection suppressing unit 112 to the auxiliary frame.

The deflection suppressing unit 112 described in the embodiment can be attached to the top surface 110B of the head module supporting member 110 and the deflection suppressing unit 112 can be attached in a space on the top surface 110B of the head module supporting member 110, as illustrated in FIG. 5 to FIG. 7.

Although a form in which the deflection suppressing unit 112 and the sacrifice member 114 are disposed in the direction parallel to the longitudinal direction of the liquid ejecting head is given as an example in the embodiment, the deflection suppressing unit 112 and the sacrifice member 114 may be disposed in an oblique direction to the longitudinal direction of the liquid ejecting head.

The oblique direction to the longitudinal direction of the liquid ejecting head includes at least one of an oblique direction with respect to a horizontal plane or an oblique direction to a plane parallel to the horizontal plane.

Second Embodiment

FIG. 8 is a schematic view illustrating a configuration of a deflection suppressing unit according to a second embodiment. In the second embodiment, the description of a form in which the deflection suppressing unit 112 is disposed between the head module supporting member 110 and the manifold housing 120 will be made. In FIG. 8, the illustration of some reference signs, out of the reference signs shown in FIG. 5 to FIG. 7, is omitted.

The deflection suppressing unit 112 illustrated in the first embodiment is applicable to the deflection suppressing unit according to the second embodiment, of which the description is to be made.

A member assigned with a reference sign 122 in FIG. 8 is a recording medium transporting unit that transports a recording medium. The recording medium transporting unit 122 illustrated in FIG. 8 is a transporting drum which has a cylindrical shape and has a rotation axis 122A extending in a direction parallel to the longitudinal direction of the liquid ejecting head 21A, and is a transporting drum that transports a recording medium along a circumferential surface 122B by holding the recording medium on the circumferential surface 122B and rotating. The illustration of the recording medium is omitted in FIG. 8. A structure called trunk may be included in the drum.

Both ends of the liquid ejecting head 21A illustrated in FIG. 8 in the longitudinal direction are connected to a main body frame 126 via connection members 124.

The manifold housing 120 is disposed on the top surface 110B of the head module supporting member 110. The deflection suppressing unit 112 is disposed between the head module supporting member 110 and the manifold housing 120.

The manifold housing 120 is a housing accommodating a liquid flow path such as a manifold. Although illustration is omitted, the manifold housing 120 accommodates a drive circuit substrate in which a drive voltage supplied to the liquid ejecting head 21A is generated, in addition to the liquid flow path such as a manifold. The manifold housing 120 is an embodiment of an external flow path accommodating unit.

Herein, the manifold is a liquid flow path that temporarily stores a liquid to be supplied to each of the head modules 200. Each of the head modules 200 communicates with a supply flow path and a supply side manifold via the supply side individual flow path 252 illustrated in FIG. 2. The manifold communicates with a liquid tank. In addition, a collection flow path that communicates with the collection side individual flow path 256 illustrated in FIG. 2 and a collection side manifold may be included. The supply flow path, the supply side manifold, the collection flow path, and the collection side manifold are configuration elements of an external flow path.

Electronic components configuring the drive circuit in which a drive voltage is generated are mounted on the drive circuit substrate. The drive circuit substrate is electrically connected to electric wiring of each of the head modules 200 illustrated in FIG. 8 via a flexible substrate and a connector.

In the liquid ejecting head 21A illustrated in FIG. 8, flow paths and wiring are disposed between the head module supporting member 110 and the manifold housing 120 but there is a space at an intermediate position between the both ends of the head module supporting member 110 in the traverse direction.

Therefore, in the liquid ejecting head 21A, the deflection suppressing unit 112 can be disposed in the space between the head module supporting member 110 and the manifold housing 120.

For convenience of illustration, the illustration of a flow path between the flow path accommodated inside the manifold housing 120 and the head modules 200 and a wiring member that electrically connects the drive circuit substrate accommodated inside the manifold housing 120 and the head module 200 together is omitted in FIG. 8.

<Operation Effect of Second Embodiment>

In the liquid ejecting head according to the second embodiment, the sacrifice member 114 which is an elastic body is used and thus the deflection of the liquid ejecting head can be eased as in the first embodiment.

It is not required to include a space for disposing the deflection suppressing unit 112 or a structure for disposing the deflection suppressing unit 112 by disposing the deflection suppressing unit 112 between the head module supporting member 110 and the manifold housing 120, and thus a space-saving design of the liquid ejecting head is easy.

The deflection suppressing unit 112 described in the second embodiment is effective in a case where edge parts of the liquid ejecting heads are concentrated such as a case where the four liquid ejecting heads described above are disposed closely to each other.

Although the transporting drum is given as an example of the recording medium transporting unit 122 in the embodiment, other transporting forms such as a transporting belt and a nip roller can be applied to the recording medium transporting unit 122.

Third Embodiment

Figure 9:
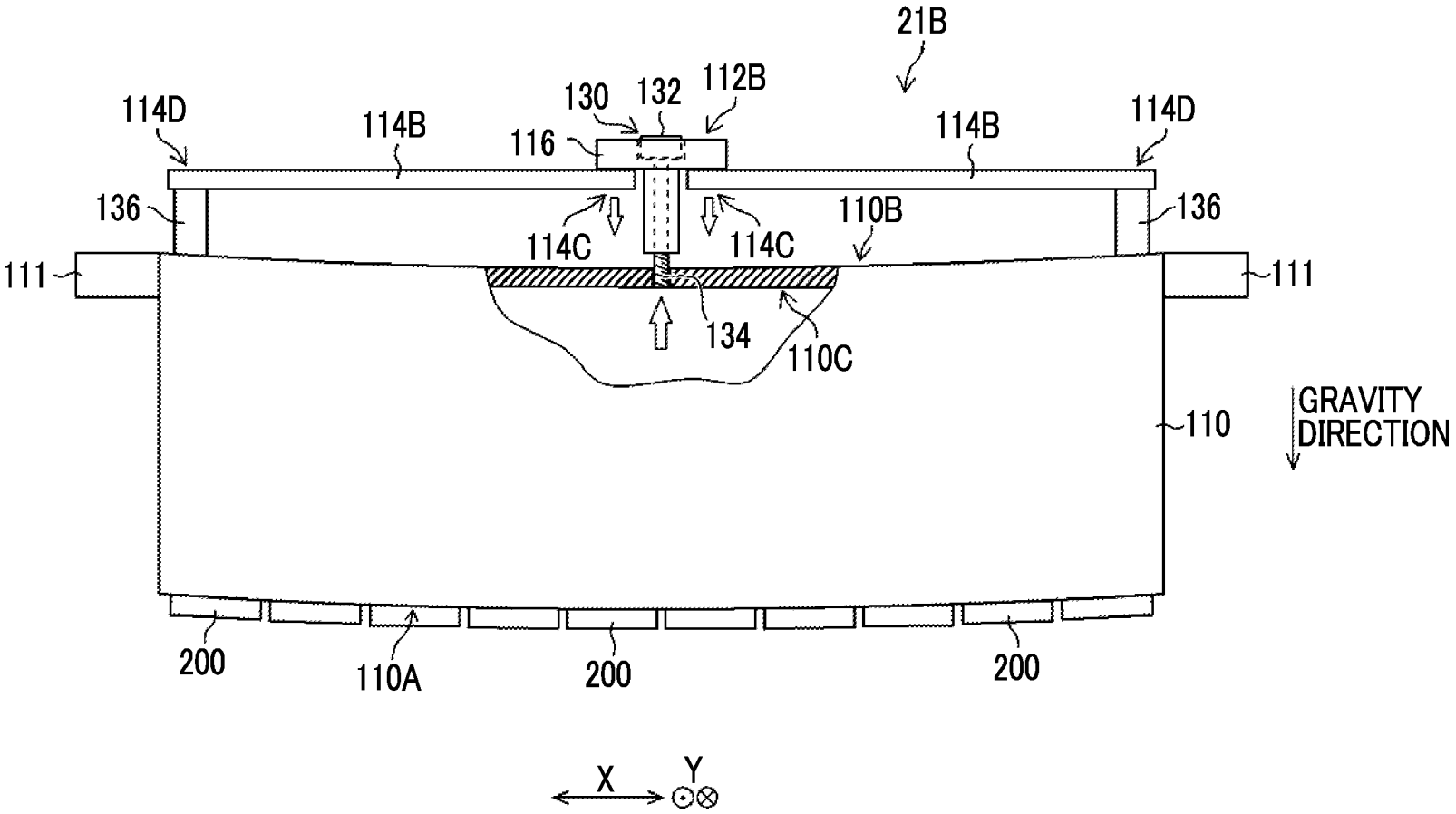
FIG. 9 is a schematic view illustrating a configuration of a deflection suppressing unit according to a third embodiment.

FIG. 9 is a schematic view illustrating a configuration of a deflection suppressing unit according to a third embodiment. In the embodiment and a fourth embodiment of which the description is to be made next, the description of a specific example of the biasing force described in the first embodiment will be made in detail.

In a deflection suppressing unit 112B included in a liquid ejecting head 21B illustrated in FIG. 9, the intermediate connection unit 116 and the head module supporting member 110 are connected to each other by a screw 130 inserted in the intermediate connection unit 116. The screw 130 corresponds to a male screw.

Figure 10:
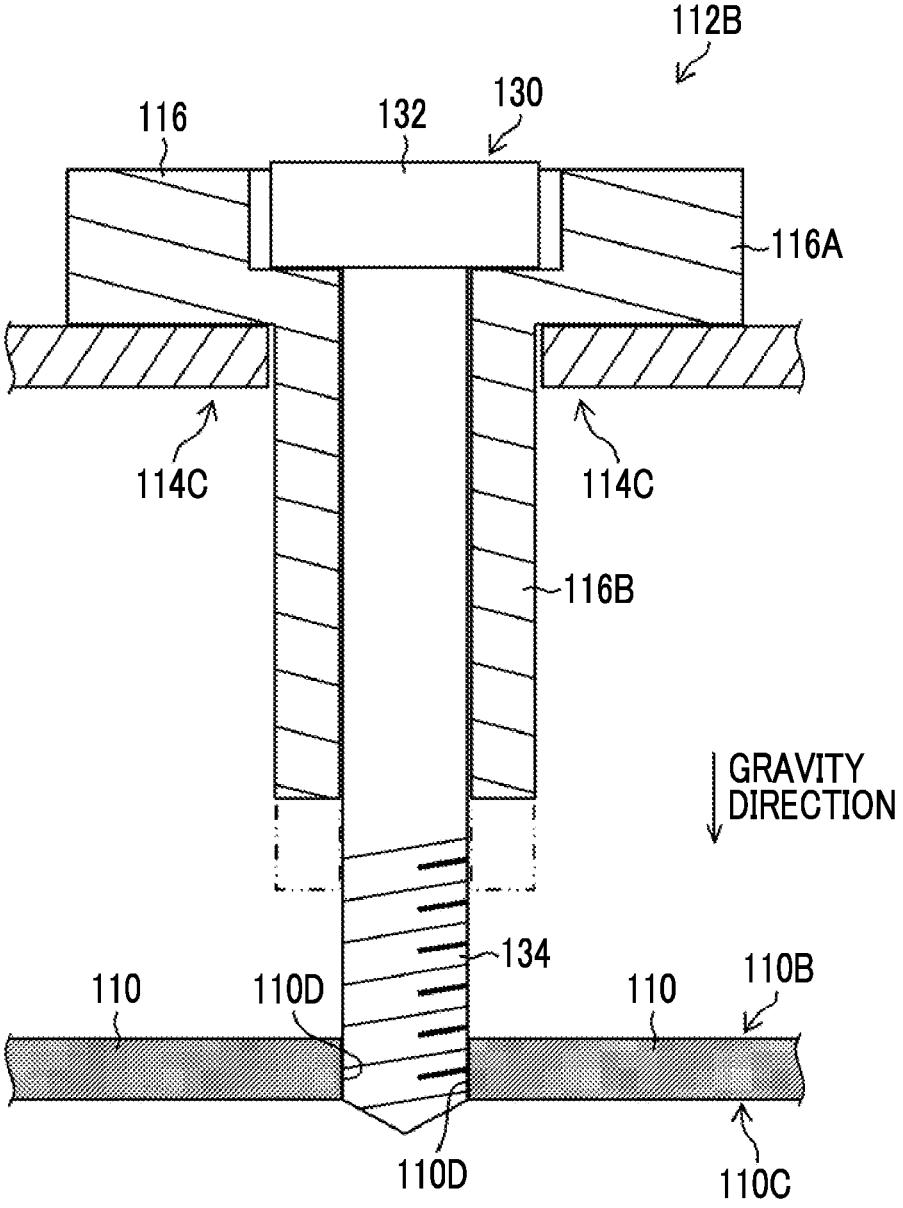
FIG. 10 is a sectional view illustrating a connecting structure between an intermediate connection unit and a head module supporting member which are illustrated in FIG. 9.

FIG. 10 is a sectional view illustrating a connecting structure between the intermediate connection unit and the head module supporting member which are illustrated in FIG. 9, and is an enlarged view of a connecting position between the head module supporting member and the intermediate connection unit. As illustrated in FIG. 10, a head portion 132 of the screw 130 is inserted into a horizontal portion 116A of the intermediate connection unit 116, and a threaded portion 134 is inserted into a vertical portion 116B of the intermediate connection unit 116.

The threaded portion 134 of the screw 130 is inserted into a female threaded portion 110D formed in the top surface 110B of the head module supporting member 110.

In a case where the screw 130 is tightened, a portion of the threaded portion 134 inserted into the top surface 110B of the head module supporting member 110 increases and deflection in the gravity direction, which is the deflection direction of the head module supporting member 110, occurs in the sacrifice member 114B illustrated in FIG. 9. Downward arrow lines illustrated in FIG. 9 show a biasing force which is a force acting on the sacrifice member 114B in the gravity direction.

In a case where deflection in the gravity direction occurs in the sacrifice member 114B, the intermediate connection unit 116 receives a reaction in an opposite direction to the deflection direction of the sacrifice member 114B from the sacrifice member 114. The reaction received by the intermediate connection unit 116 from the sacrifice member 114 acts on the head module supporting member 110. Then, the head module supporting member 110 receives a force in the opposite direction to the deflection direction of the sacrifice member 114B, and the deflection of the head module supporting member 110 is eased.

An upward arrow line shown in FIG. 9 shows a reaction that acts on the head module supporting member 110 and is received from the sacrifice member 114B.

By easing the deflection of the head module supporting member 110 in this manner, the deflection of the liquid ejecting head 21A in the gravity direction is eased.

The liquid ejecting head 21B illustrated in FIG. 9 can adjust the deflection amount of the sacrifice member 114B by adjusting an amount by which the screw 130 is tightened. In other words, the screw 130 function as a biasing force applying unit that applies a biasing force to the sacrifice member 114B.

By making an amount by which the screw 130 is tightened relatively larger, the deflection amount of the sacrifice member 114B in the deflection direction of the head module supporting member 110 can be made larger, and the level of a biasing force applied to the sacrifice member 114B can be made larger.

By making an amount by which the screw 130 is tightened relatively smaller, the deflection amount of the sacrifice member 114B in the deflection direction of the head module supporting member 110 can be made smaller, and the level of a biasing force applied to the sacrifice member 114B can be made smaller. Two-dot chain lines illustrated in FIG. 10 show a case where an amount by which the screw 130 is tightened is made relatively larger and a biasing force is made relatively larger.

The sacrifice member 114B illustrated in FIG. 9 has a structure of being bisected in the longitudinal direction. Each of tip portions 114C of the bisected sacrifice member 114B is connected to the intermediate connection unit 116. In addition, each of base end portions 114D of the bisected sacrifice member 114B is connected to the head module supporting member 110 via an end portion connecting member 136.

The end portion connecting member 136 forms a space between the sacrifice member 114B and the top surface 110B of the head module supporting member 110 in the gravity direction. By forming the space between the sacrifice member 114B and the top surface 110B of the head module supporting member 110 in the gravity direction, collision between the sacrifice member 114B and the top surface 110B of the head module supporting member 110 can be avoided in a case where the sacrifice member 114B is deflected in the gravity direction.

The sacrifice member 114 illustrated in FIG. 5 may be applied to the sacrifice member 114B illustrated in FIG. 9. The structure of the sacrifice member 114B to which the end portion connecting member 136 illustrated in FIG. 9 is connected is an embodiment of a curved structure in which the sacrifice member projects in the opposite direction to the deflection direction of the liquid ejecting head.

<Operation Effect of Third Embodiment>

In the liquid ejecting head according to the third embodiment, the deflection of the liquid ejecting head can be eased by the sacrifice member 114B which is an elastic body as in the first embodiment.

The screw 130 connecting the intermediate connection unit 116 and the top surface 110B of the head module supporting member 110 together is applied as means for applying a biasing force to the sacrifice member 114B. By adjusting an amount by which the screw 130 is tightened, the level of a biasing force applied to the sacrifice member 114B can be adjusted according to the deflection amount of the liquid ejecting head.

Fourth Embodiment

Figure 11:
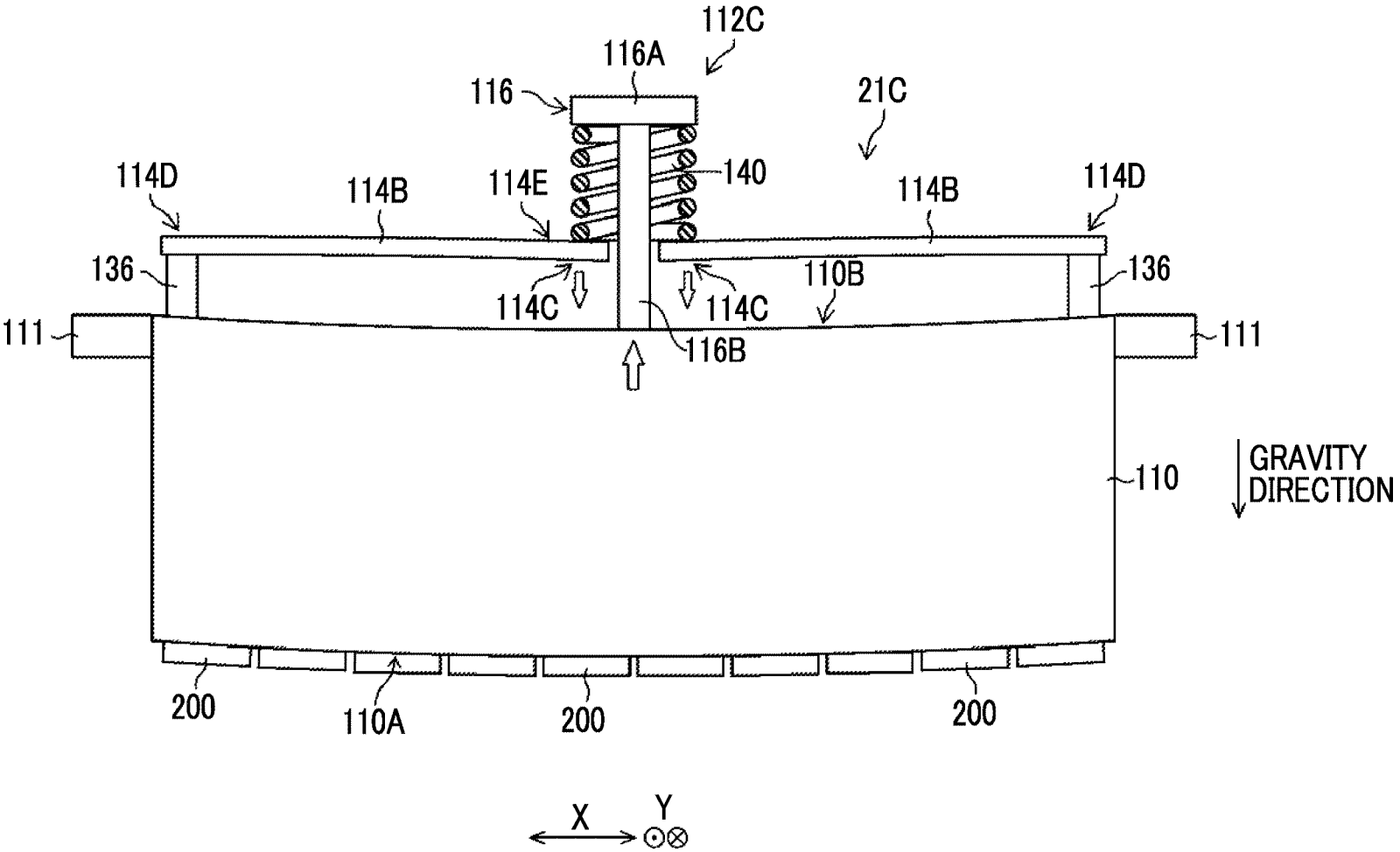
FIG. 11 is a schematic view illustrating a configuration of a deflection suppressing unit according to a fourth embodiment.

FIG. 11 is a schematic view illustrating a configuration of a deflection suppressing unit according to the fourth embodiment. A deflection suppressing unit 112C included in a liquid ejecting head 21C according to the fourth embodiment includes a compression spring 140 as means for applying a biasing force that deflects the sacrifice member 114B in the deflection direction of the head module supporting member 110.

In the deflection suppressing unit 112C illustrated in FIG. 11, the compression spring 140 is disposed between a top surface 114E of the sacrifice member 114B and the horizontal portion 116A of the intermediate connection unit 116. The vertical portion 116B of the intermediate connection unit 116 is inserted into a hollow portion of the compression spring 140.

In a case where the compression spring 140 is not compressed, that is, in a biasing force non-application state where a biasing force is not applied to the sacrifice member 114B, the intermediate connection unit 116 has a length in the gravity direction, which allows the vertical portion 116B and the top surface 110B of the head module supporting member 110 not to come into contact with each other.

In a case where the compression spring 140 is compressed and the intermediate connection unit 116 is connected to the head module supporting member 110, the force of repulsion in the gravity direction is generated in the compression spring 140. The force of repulsion of the compression spring 140 acts on, and thus deflection in the deflection direction of the head module supporting member 110, which is deflection in the gravity direction, occurs in the sacrifice member 114B.

Downward arrow lines illustrated in FIG. 11 show a biasing force that acts on the sacrifice member 114B, which is a force in the deflection direction of the head module supporting member 110.

In a case where a biasing force acts on the sacrifice member and deflection in the deflection direction of the head module supporting member 110 occurs in the sacrifice member 114B, the intermediate connection unit 116 receives a reaction in the opposite direction to the deflection direction of the sacrifice member 114B. The reaction received by the intermediate connection unit 116 from the sacrifice member 114 acts on the head module supporting member 110. Then, the head module supporting member 110 receives a force in the opposite direction to the deflection direction of the sacrifice member 114B, and the deflection of the head module supporting member 110 is eased.

An upward arrow line illustrated in FIG. 11 shows a force in the opposite direction to the deflection direction of the sacrifice member 114B, which acts on the head module supporting member 110.

By easing the deflection of the head module supporting member 110 in this manner, the deflection of the liquid ejecting head 21C in the gravity direction is eased.

The liquid ejecting head 21C illustrated in FIG. 11 can adjust the deflection amount of the sacrifice member 114B in the gravity direction by the spring constant of the compression spring 140 being changed. In other words, an appropriate biasing force is applied to the sacrifice member 114B by making the spring constant of the compression spring 140 an appropriate value corresponding to the deflection of the head module supporting member 110.

Deflection can be eased such that the deflection of the head module supporting member 110 in the gravity direction is made to stay within a certain range by using the compression spring 140 of which the spring constant is relatively large in a case where the deflection of the head module supporting member 110 in the gravity direction is relatively large and using the compression spring 140 of which the spring constant is relatively small in a case where the deflection of the head module supporting member 110 in the gravity direction is relatively small.

A coil spring is given as an example of the compression spring 140 illustrated in FIG. 11. The sacrifice member 114 illustrated in FIG. 5 may be applied to the sacrifice member 114B illustrated in FIG. 11.

<Operation Effect of Fourth Embodiment>

In the liquid ejecting head according to the fourth embodiment, the deflection of the liquid ejecting head can be eased by the sacrifice member 114B which is an elastic body, as in the first embodiment.

The compression spring 140 is applicable as means for applying a biasing force to the sacrifice member 114B. A biasing force according to the deflection amount of the liquid ejecting head is applied to the sacrifice member 114B by making the spring constant of the compression spring an appropriate value according to the deflection amount of the liquid ejecting head.

Fifth Embodiment

Figure 12:
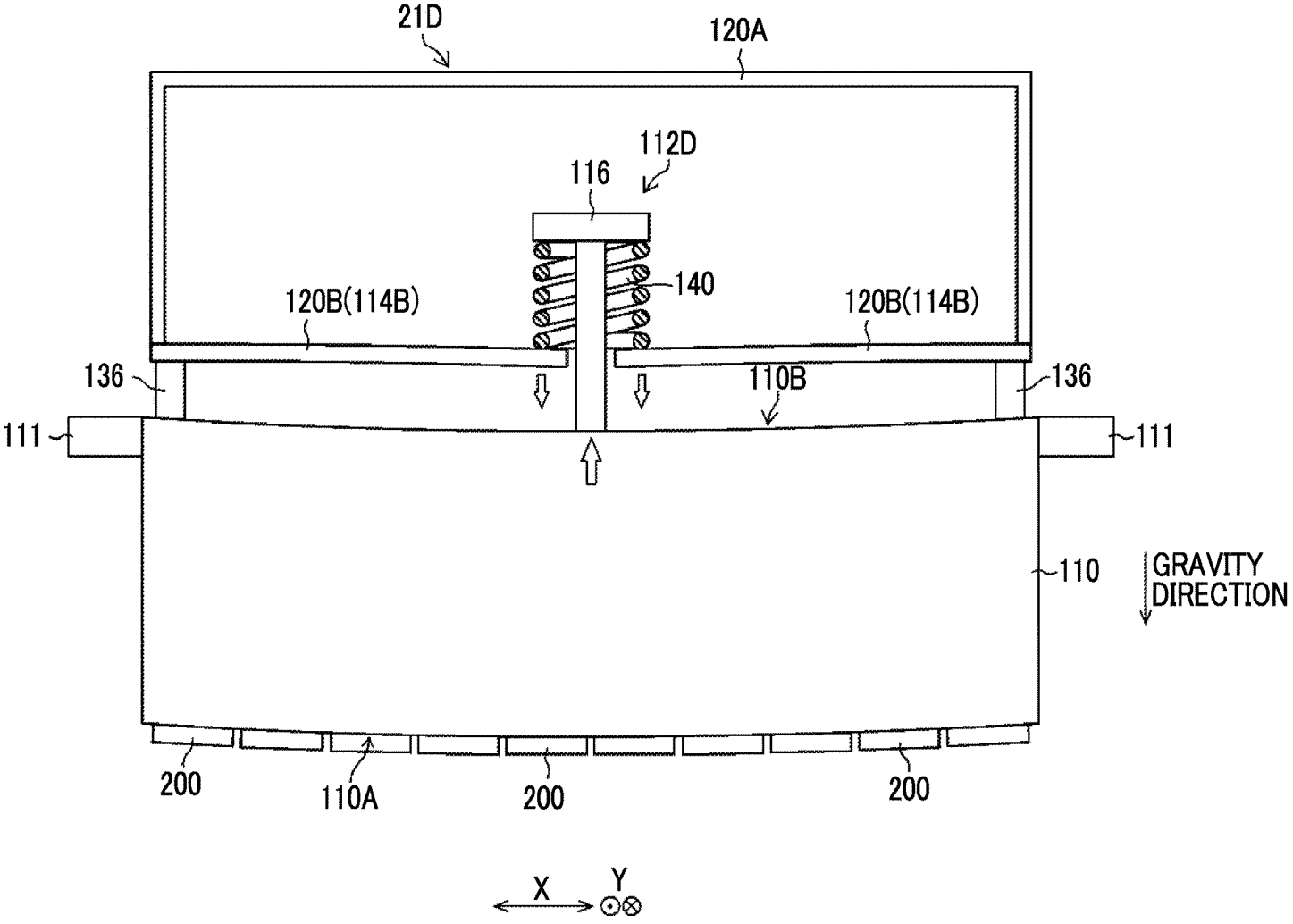
FIG. 12 is a schematic view illustrating a configuration of a deflection suppressing unit according to a fifth embodiment.

FIG. 12 is a schematic view illustrating a configuration of a deflection suppressing unit according to the fifth embodiment. A liquid ejecting head 21D illustrated in FIG. 12 also has a function of the deflection suppressing unit in the manifold housing.

A bottom plate 120B of the manifold housing 120A illustrated in FIG. 12 also serves as the sacrifice member 114B of the deflection suppressing unit 112D. The structure and function of the deflection suppressing unit 112D illustrated in FIG. 12 are the same as the structure and function of the deflection suppressing unit 112C described in the fourth embodiment. Herein, the description of the structure and function of the deflection suppressing unit 112D is omitted.

In FIG. 12, the illustration of a flow path, such as a manifold, and a drive circuit substrate, which are accommodated in the manifold housing 120A, is omitted. The bottom plate 120B of the manifold housing 120A corresponds to a surface opposed to the top surface of the head module supporting member of the external flow path accommodating unit.

Although the deflection suppressing unit 112D having the same structure as the deflection suppressing unit 112C described in the fourth embodiment is illustrated in FIG. 12, the same structure as the deflection suppressing unit 112 described in the first embodiment or the same structure as the deflection suppressing unit 112C described in the third embodiment may be applied to the deflection suppressing unit 112D.

Although a form in which the manifold housing also has the function of the deflection suppressing unit is given as an example in the embodiment, another member which does not require the accuracy of disposition position in a unit in which the liquid ejecting head is disposed may also have a function of the deflection suppressing unit.

<Operation Effect of Fifth Embodiment>

In the liquid ejecting head according to the fifth embodiment, the deflection of the liquid ejecting head can be eased by the sacrifice member 114B which is an elastic body, as in the first embodiment.

By another member such as the manifold housing also having the function of the deflection suppressing unit, the space of the unit in which the liquid ejecting head or the liquid ejecting head is disposed can be saved.

Sixth Embodiment

Figure 13:
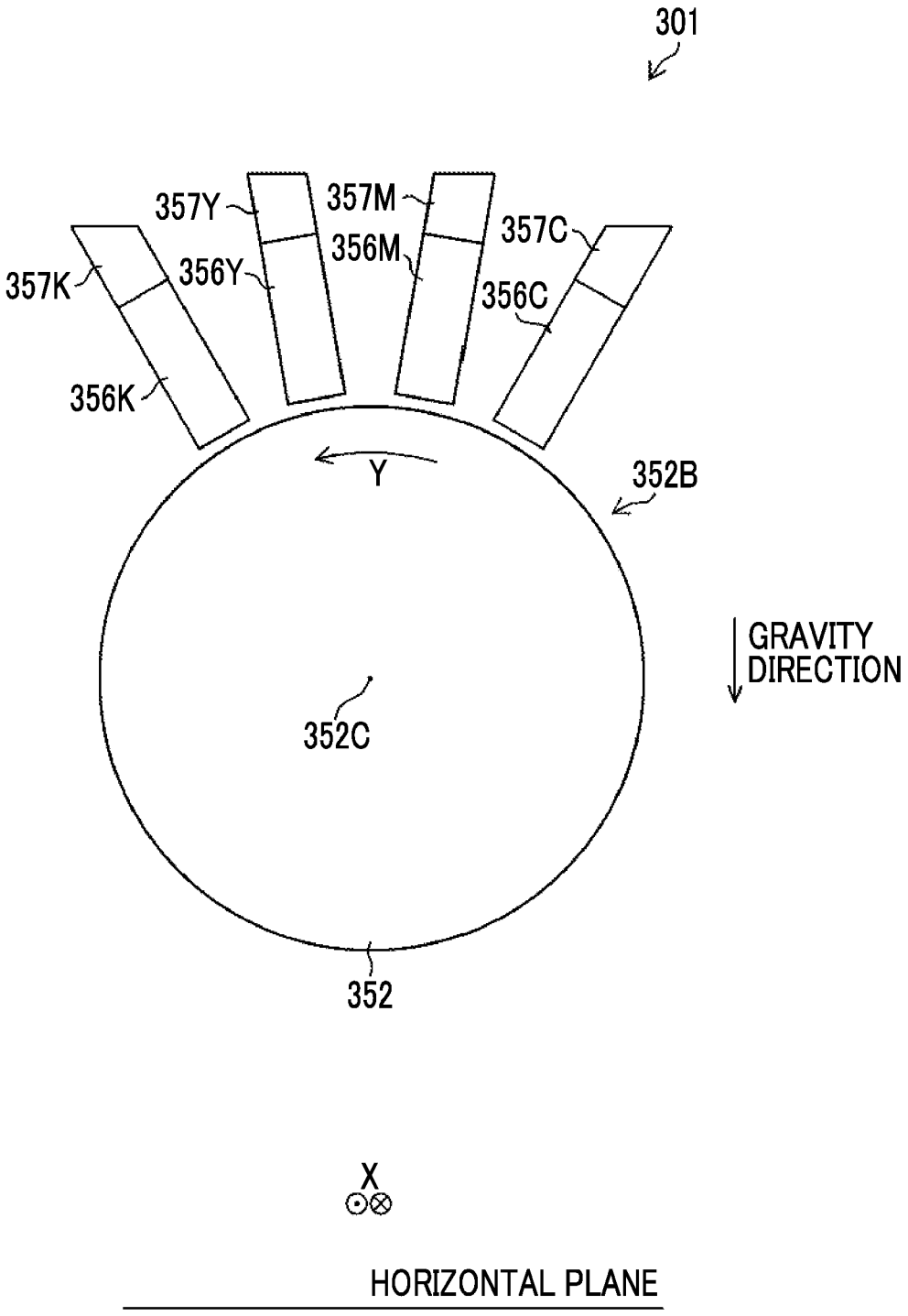
FIG. 13 is a schematic view illustrating a configuration of a liquid ejecting apparatus including a plurality of liquid ejecting heads, each of which includes a deflection suppressing unit according to a sixth embodiment is included.

Next, the description of a sixth embodiment will be made. In the sixth embodiment, the description of easing of deflection of the liquid ejecting head disposed in the oblique direction with respect to the horizontal plane will be made. FIG. 13 is a schematic view illustrating a configuration of a liquid ejecting apparatus including the plurality of liquid ejecting heads each of which includes a deflection suppressing unit according to the sixth embodiment.

An ink jet recording apparatus 301 illustrated in FIG. 13 is an ink jet recording apparatus that forms a color image onto a recording medium (not illustrated) by using each color of ink such as cyan, magenta, yellow, and black. The ink jet recording apparatus 301 illustrated in FIG. 13 can be applied to an image forming unit 318 in an ink jet recording apparatus 300 illustrated in FIG. 17.

The ink jet recording apparatus 301 includes an ink jet head 356C that ejects a cyan ink, an ink jet head 356M that ejects a magenta ink, an ink jet head 356Y that ejects a yellow ink, and an ink jet head 356K that ejects a black ink.

In the specification, C is used to indicate cyan in some cases. M is used to indicate magenta in some cases. Y is used to indicate yellow in some cases. K is used to indicate black in some cases.

The ink jet head is an embodiment of the liquid ejecting head. In the embodiment, the ink jet head and the liquid ejecting head can be used interchangeably with each other as appropriate.

The ink jet head 356C, the ink jet head 356M, the ink jet head 356Y, and the ink jet head 356K are disposed in a direction orthogonal to the transporting direction of the recording medium, which is assigned with the reference sign X, as a longitudinal direction. The longitudinal direction corresponds to the first direction.

The ink jet head 356C, the ink jet head 356M, the ink jet head 356Y, and the ink jet head 356K are disposed in the transporting direction of the recording medium, which is assigned with the reference sign Y, that is, the ink jet head 356C, the ink jet head 356M, the ink jet head 356Y, and the ink jet head 356K are disposed in this order.

The same structure as the liquid ejecting head 21 of which the description is made with the use of FIG. 1 to FIG. 4 is applicable to the ink jet head 356C, the ink jet head 356M, the ink jet head 356Y, and the ink jet head 356K illustrated in FIG. 13.

The ink jet head 356C includes a deflection suppressing unit 357C. The deflection suppressing unit 357C applies a force to the ink jet head 356C in the opposite direction to the gravity direction and eases the deflection of the ink jet head 356C.

The ink jet head 356M includes a deflection suppressing unit 357M. The deflection suppressing unit 357M applies a force to the ink jet head 356M in the opposite direction to the gravity direction and eases the deflection of the ink jet head 356M.

The ink jet head 356Y includes a deflection suppressing unit 357Y. The deflection suppressing unit 357Y applies a force to the ink jet head 356Y in the opposite direction to the gravity direction and eases the deflection of the ink jet head 356Y.

The ink jet head 356K includes a deflection suppressing unit 357K. The deflection suppressing unit 357K applies a force to the ink jet head 356K in the opposite direction to the gravity direction and eases the deflection of the ink jet head 356K.

The ink jet recording apparatus 301 illustrated in FIG. 13 includes a transporting drum 352 as means for transporting a recording medium. The transporting drum 352 illustrated in FIG. 13 corresponds to a drawing drum 352 illustrated in FIG. 17.

The transporting drum 352 illustrated in FIG. 13 has a cylindrical shape. A reference sign 352C shown in FIG. 13 is a center axis of the transporting drum 352, and is a rotation axis of the transporting drum 352.

The ink jet head 356C, the ink jet head 356M, the ink jet head 356Y, and the ink jet head 356K are disposed at positions where a distance to an outer circumferential surface 352B of the transporting drum 352 is constant.

Next, the description of the deflection suppressing unit 357C, the deflection suppressing unit 357M, the deflection suppressing unit 357Y, and the deflection suppressing unit 357K will be made in detail.

Figure 14:
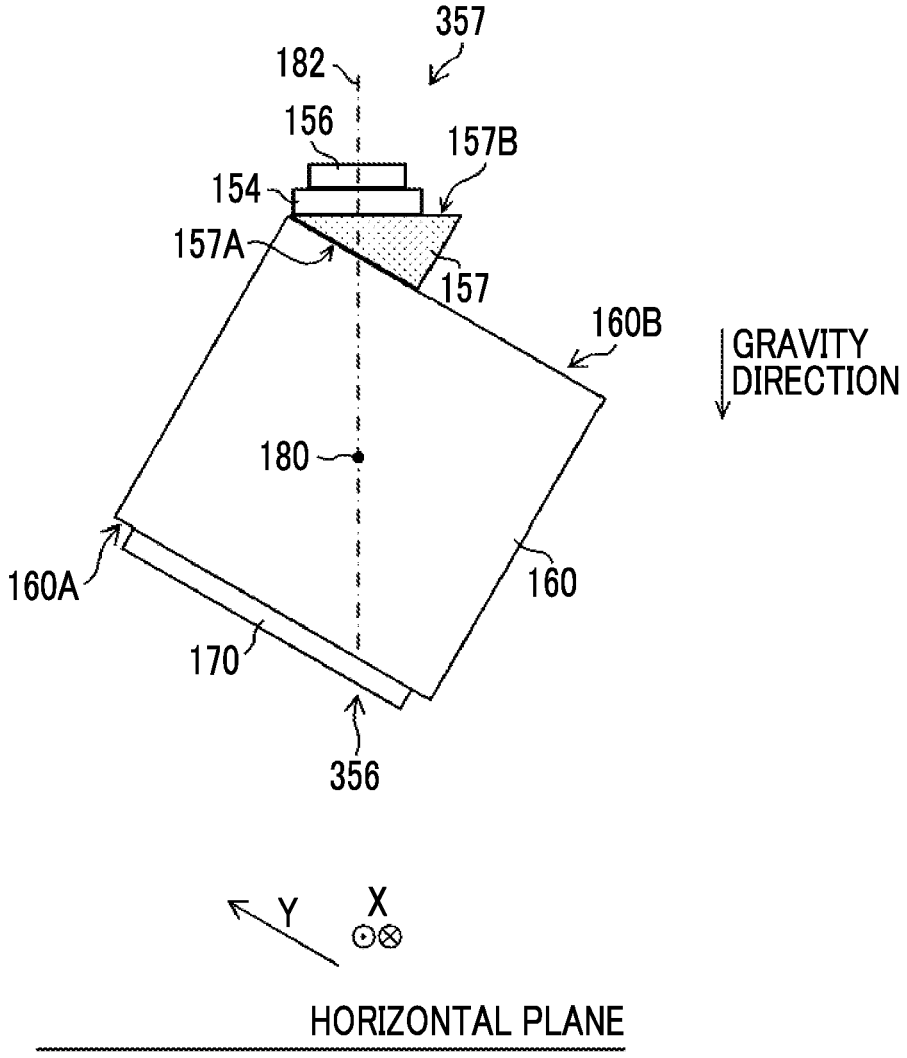
FIG. 14 is a schematic view illustrating a configuration of the deflection suppressing unit according to the sixth embodiment.

FIG. 14 is a schematic view illustrating a configuration of the deflection suppressing unit according to the sixth embodiment. Since the same configuration is applicable to the deflection suppressing unit 357C, the deflection suppressing unit 357M, the deflection suppressing unit 357Y, and the deflection suppressing unit 357K illustrated in FIG. 13, the deflection suppressing unit 357C, the deflection suppressing unit 357M, the deflection suppressing unit 357Y, and the deflection suppressing unit 357K illustrated in FIG. 13 are represented by a deflection suppressing unit which is indicated with a reference sign 357 in FIG. 14.

Similarly, the ink jet head 356C, the ink jet head 356M, the ink jet head 356Y, and the ink jet head 356K illustrated in FIG. 13 are represented by an ink jet head which is indicated with a reference sign 356 in FIG. 14.

The deflection suppressing unit 357 illustrated in FIG. 14 includes a sacrifice member 154 and an intermediate connection unit 156. Since the structure and function of the sacrifice member 154 and the structure and function of the intermediate connection unit 156 are the same as the structure and function of the sacrifice member and the structure and function of the intermediate connection unit, which are described from the first embodiment to the fifth embodiment, description thereof will be omitted.

The deflection suppressing unit 357 illustrated in FIG. 14 includes an angle adjusting member 157. The angle adjusting member 157 is a member that converts a top surface 160B of a head module supporting member 160 to a surface parallel to the horizontal plane.

That is, a bottom surface 157A of the angle adjusting member 157 is parallel to the top surface 160B of the head module supporting member 160. In addition, a top surface 157B of the angle adjusting member 157 is parallel to the horizontal plane.

In other words, the angle adjusting member 157 functions as a supporting member that supports the sacrifice member 154 so as to be parallel to the horizontal plane. An example in which the end portion connecting member 136 illustrated in FIG. 9 and FIG. 11 is replaced is given as a disposition example of the angle adjusting member 157.

A reference sign 180 shown in FIG. 14 is the centroid of the liquid ejecting head 356. A straight line illustrated with a one-dot chain line assigned with a reference sign 182 is a perpendicular line of the sacrifice member 154, which passes through an intersection point between a bisector that bisects the length of the sacrifice member 154 in the traverse direction and a bisector that bisects the length of the sacrifice member 154 in the longitudinal direction, and is a straight line parallel to the gravity direction.

The sacrifice member 154 has disposition in which the straight line 182 passes through the centroid 180 of the liquid ejecting head 356. It is preferable that a connecting position between the intermediate connection unit 156 and the head module supporting member 160 be on the straight line 182.

In the liquid ejecting head 356 illustrated in FIG. 14, a reaction acts on the head module supporting member 160 in the opposite direction to the gravity direction and the head module supporting member 160 is raised in the opposite direction to the gravity direction by deflecting the sacrifice member 154 supported by the angle adjusting member 157 in the gravity direction.

A reference sign 170 shown in FIG. 14 is a head module. The head module 170 corresponds to the head module 200 illustrated in FIG. 5. A surface assigned with a reference sign 160A illustrated in FIG. 14 is a head module supporting surface, and corresponds to the head module supporting surface 110A illustrated in FIG. 5.

The ink jet head 356C, the ink jet head 356M, the ink jet head 356Y, and the ink jet head 356K illustrated in FIG. 13 each include an angle adjusting member corresponding to the angle of the liquid ejecting surface with respect to the horizontal plane.

<Operation Effect of Sixth Embodiment>

In the liquid ejecting head according to the sixth embodiment, the deflection of the liquid ejecting head in the gravity direction, which has disposition in which the liquid ejecting surface is inclined with respect to the horizontal plane, can be eased by the sacrifice member 154 which is an elastic body.

Seventh Embodiment

Figure 15:
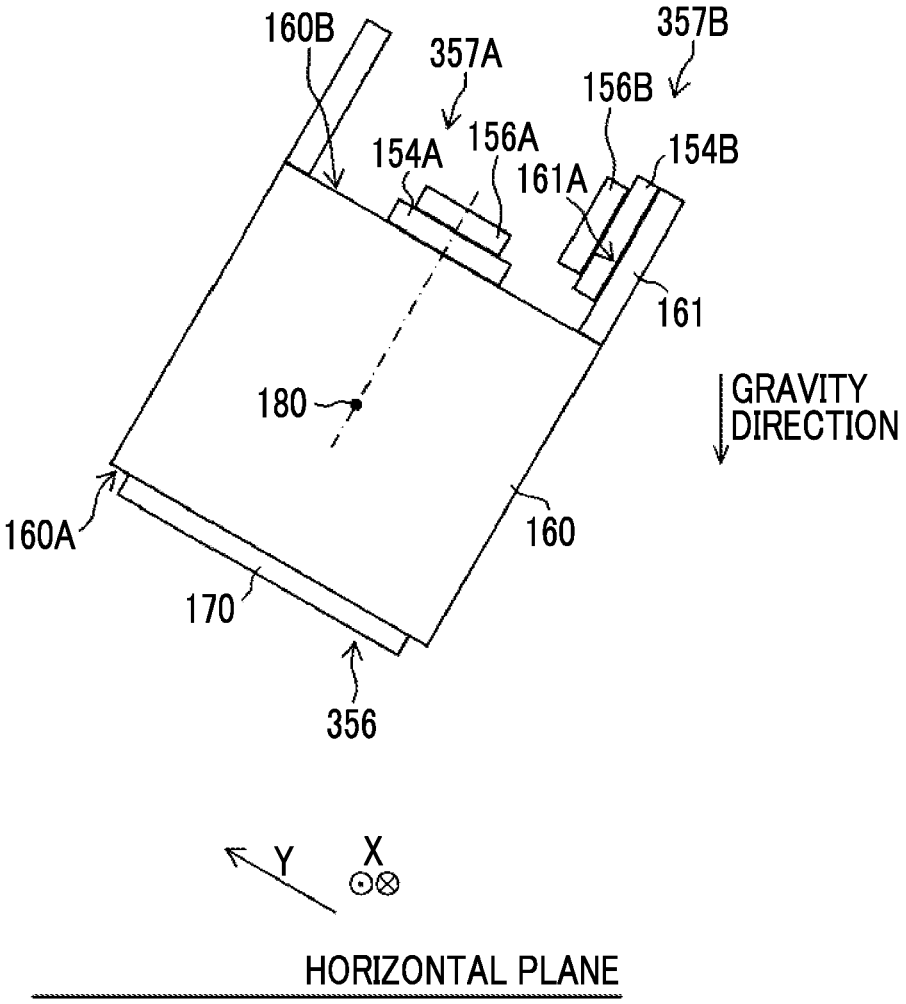
FIG. 15 is a schematic view illustrating a configuration of a deflection suppressing unit according to a seventh embodiment.

FIG. 15 is a schematic view illustrating a configuration of a deflection suppressing unit according to a seventh embodiment. In FIG. 15, a configuration which is the same as or is similar to FIG. 14 will be assigned with the same reference sign and description thereof will be appropriately omitted.

The deflection suppressing unit according to the seventh embodiment illustrated in FIG. 15 includes a first deflection suppressing unit 357A including a first sacrifice member 154A and a first intermediate connection member 156A and a second deflection suppressing unit 357B including a second sacrifice member 154B and a second intermediate connection member 156B. The deflection suppressing unit including the first deflection suppressing unit 357A and the second deflection suppressing unit 357B is an embodiment of the deflection suppressing unit.

The first sacrifice member 154A is an embodiment of a first deflection absorption unit. The first intermediate connection member 156A is an embodiment of a first head module supporting member connection unit. The second sacrifice member 154B is an embodiment of a second deflection absorption unit. The second intermediate connection member 156B is an embodiment of a second head module supporting member connection unit.

A one-dot chain line illustrated in FIG. 15 is a straight line that passes through the centroid 180 of the liquid ejecting head 356, is a straight line that passes through a position where the entire length of the head module supporting member 160 in the traverse direction is bisected and a position where the entire length of the head module supporting member 160 in the longitudinal direction is bisected, and is a straight line parallel to a direction orthogonal to the top surface 160B of the head module supporting member 160.

The first deflection suppressing unit 357A illustrated in FIG. 15 has disposition in which the one-dot chain line illustrated in FIG. 15 passes through the position where the entire length in the traverse direction is bisected and the position where the entire length in the longitudinal direction is bisected.

The first deflection suppressing unit 357A is connected to the top surface 160B of the head module supporting member 160. The second deflection suppressing unit 357B is connected to a rib 161. The rib 161 is a plate-shaped member joined to the top surface 160B of the head module supporting member 160.

The rib 161 has a second deflection suppressing unit attached surface 161A orthogonal to the top surface 160B of the head module supporting member 160. The second deflection suppressing unit 357B is connected to the second deflection suppressing unit attached surface 161A of the rib 161.

In FIG. 15, the structure of the first deflection suppressing unit 357A and the structure of the second deflection suppressing unit 357B are illustrated in a simplified manner. The structure of the deflection suppressing unit 112 illustrated in FIG. 6 and the structure of the deflection suppressing unit 112B illustrated in FIG. 9 are applicable to the first deflection suppressing unit 357A and the second deflection suppressing unit 357B.

The traverse direction of the first sacrifice member 154A of the first deflection suppressing unit 357A illustrated in FIG. 15 is a direction parallel to the top surface 160B of the head module supporting member 160. The traverse direction of the second sacrifice member 154B of the second deflection suppressing unit 357B is the direction orthogonal to the top surface 160B of the head module supporting member 160.

That is, the first deflection suppressing unit 357A and the second deflection suppressing unit 357B have disposition in which the traverse direction of the first sacrifice member 154A of the first deflection suppressing unit 357A and the traverse direction of the second sacrifice member 154B of the second deflection suppressing unit 357B are orthogonal to each other.

In addition, the longitudinal direction of the first sacrifice member 154A of the first deflection suppressing unit 357A and the longitudinal direction of the second sacrifice member 154B of the second deflection suppressing unit 357B are directions parallel to the longitudinal direction of the head module supporting member, which is shown with the reference sign X assigned.

That is, the first deflection suppressing unit 357A and the second deflection suppressing unit 357B have disposition in which the longitudinal direction of the first sacrifice member 154A of the first deflection suppressing unit 357A and the longitudinal direction of the second sacrifice member 154B of the second deflection suppressing unit 357B are parallel to each other.

Figure 16:
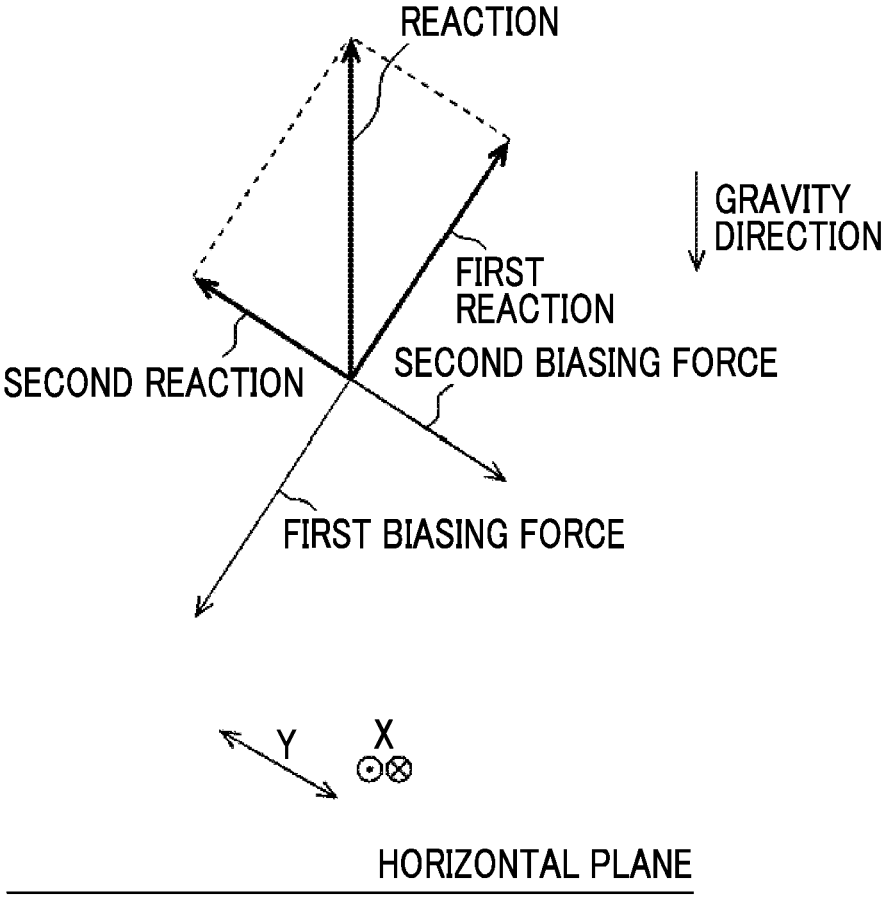
FIG. 16 is an explanatory view of a deflection easing function of the deflection suppressing unit according to the seventh embodiment.

FIG. 16 is an explanatory view of the deflection easing function of the deflection suppressing unit according to the seventh embodiment. In FIG. 16, elements which are the same as or are similar to FIG. 15 will be assigned with the same reference signs, and description thereof will be appropriately omitted.

A biasing force in a direction orthogonal to the top surface 160B of the head module supporting member 160, which is an obliquely downward direction with respect to the horizontal plane, is applied to the first sacrifice member 154A illustrated in FIG. 15. A first biasing force applied to the first sacrifice member 154A illustrated in FIG. 15 is shown in FIG. 16.

The direction of the first biasing force is a direction parallel to the disposition direction of the first sacrifice member 154A and the first intermediate connection member 156A.

The first sacrifice member 154A causes a first reaction in the opposite direction to the first biasing force shown in FIG. 16. The first reaction shown in FIG. 16 is a force that raises the top surface 160B of the head module supporting member 160 in the direction orthogonal to the top surface 160B of the head module supporting member 160, which is an obliquely upward direction with respect to the horizontal plane, via the first intermediate connection member 156A illustrated in FIG. 15.

A biasing force in a direction orthogonal to the second deflection suppressing unit attached surface 161A of the rib 161, which is the obliquely downward direction with respect to the horizontal plane, is applied to the second sacrifice member 154B. A second biasing force applied to the second sacrifice member 154B illustrated in FIG. 15 is shown in FIG. 16.

The direction of the second biasing force is a direction parallel to the disposition direction of the second sacrifice member 154B and the second intermediate connection member 156B.

The second sacrifice member 154B causes a second reaction facing the opposite direction to the second biasing force shown in FIG. 16. The second reaction shown in FIG. 16 is a force that raises the second deflection suppressing unit attached surface 161A of the rib 161 in a direction orthogonal to the second deflection suppressing unit attached surface 161A of the rib 161, which is an obliquely upward direction with respect to the horizontal plane, via the second intermediate connection member 156B illustrated in FIG. 15.

By causing the first reaction shown in FIG. 16, which is caused by the first deflection suppressing unit 357A, and the second reaction shown in FIG. 16, which is caused by the second deflection suppressing unit 357B illustrated in FIG. 15, to act on the head module supporting member 160 illustrated in FIG. 15, a resultant force of the first reaction and the second reaction shown in FIG. 16, which is a reaction in the opposite direction to the gravity direction, acts on the head module supporting member and the head module supporting member 160 illustrated in FIG. 15 is raised in the opposite direction to the gravity direction.

Although a form in which the deflection suppressing unit is included in each of two directions orthogonal to each other is given as an example in the embodiment, a disposition relationship of the two deflection suppressing units is not limited to being orthogonal to each other. Insofar as a reaction obtained by the two deflection suppressing units are in the gravity direction and the opposite direction thereto, a disposition relationship of the two deflection suppressing units may be two directions intersecting each other.

<Operation Effect of Seventh Embodiment>

In the deflection suppressing unit according to the seventh embodiment, the head module supporting member can be raised in the opposite direction to the gravity direction, and the deflection of the head module supporting member, which is obliquely disposed with respect to a horizontal direction, in the gravity direction can be eased by providing the deflection suppressing unit in each of the two directions intersecting each other and achieving a balance between reactions caused by the two deflection suppressing units.

Although the liquid ejecting head in which the head modules are arranged in a line in longitudinal direction of the liquid ejecting head is described in the first embodiment to the seventh embodiment, arrangement in which the positions of the adjacent head modules are changed in the traverse direction of the liquid ejecting head can also be adopted.

Also in a liquid ejecting head including one long head module, the deflection suppressing unit can ease deflection in the deflection direction of the liquid ejecting head.

A form in which one intermediate connection unit is included in one sacrifice member is given as an example in the first embodiment to the seventh embodiment, a plurality of intermediate connection units can be included in one sacrifice member. For example, in a case where a plurality of positions where deflection is likely to occur are perceived in advance, a form in which an intermediate connection unit is included at each of the plurality of positions where deflection is likely to occur can be adopted.

In addition, a form in which an intermediate connection unit is included at each of a position where the deflection suppressing unit is trisected in the longitudinal direction and a position where the deflection suppressing unit is quartered in the longitudinal direction can also be adopted. One or a plurality of intermediate connection units may be included in each of the plurality of head modules.

The first embodiment to the seventh embodiment can be appropriately combined. For example, a combination of the first embodiment, the second embodiment, or the fifth embodiment can be adopted. In addition, a combination of the third embodiment, the second embodiment, or the fifth embodiment, or a combination of the fourth embodiment, the second embodiment, or the fifth embodiment can also be adopted.

Eighth Embodiment

[Description of Technical Problem]

Figure 18:
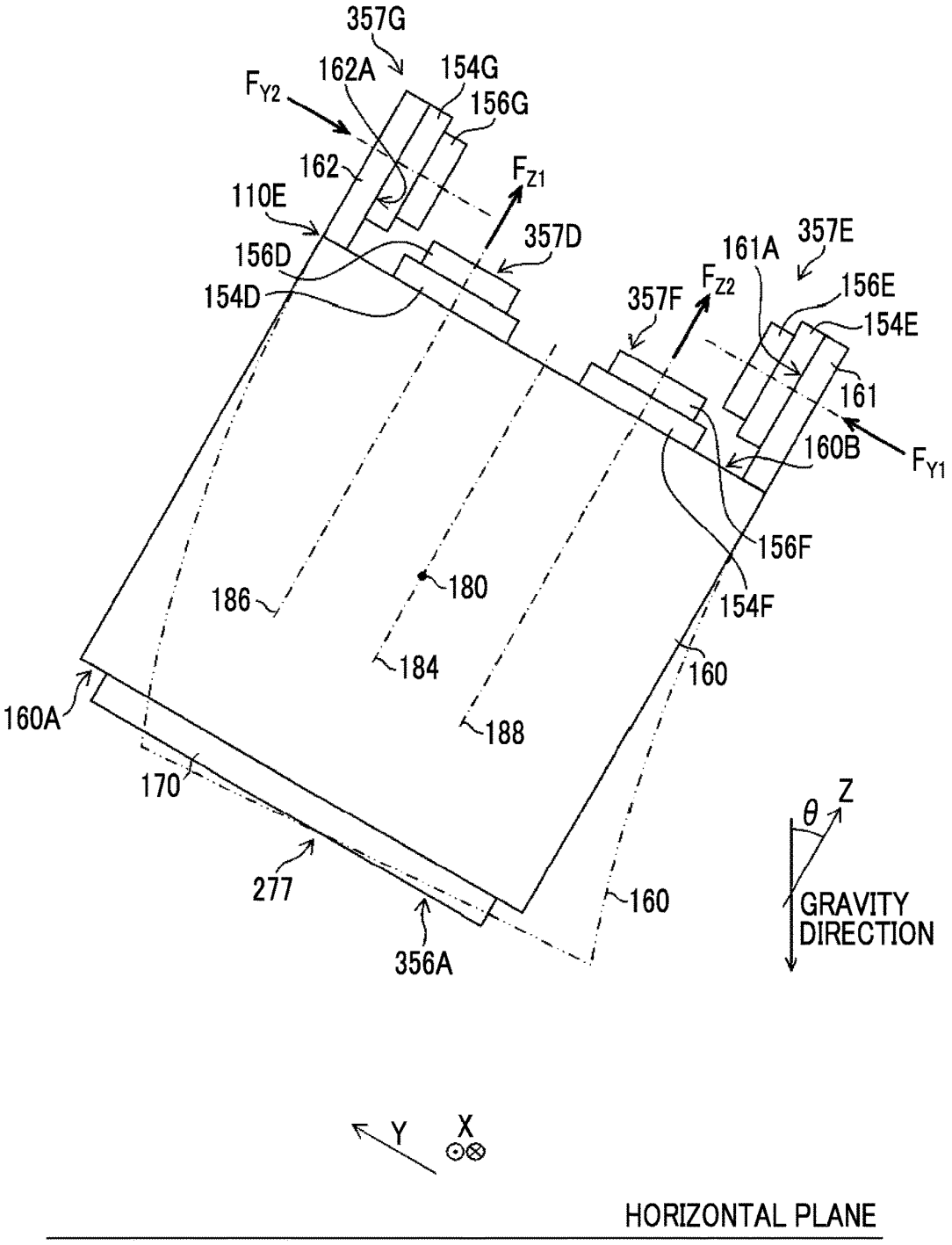
FIG. 18 is an explanatory view of a deflection easing function of a deflection suppressing unit according to an embodiment of an eighth embodiment.

First, the description of technical problems solved by a deflection suppressing unit according to an eighth embodiment will be made. FIG. 18 is an explanatory view of a deflection easing function of a deflection suppressing unit according to an embodiment of the eighth embodiment.

Figure 22:
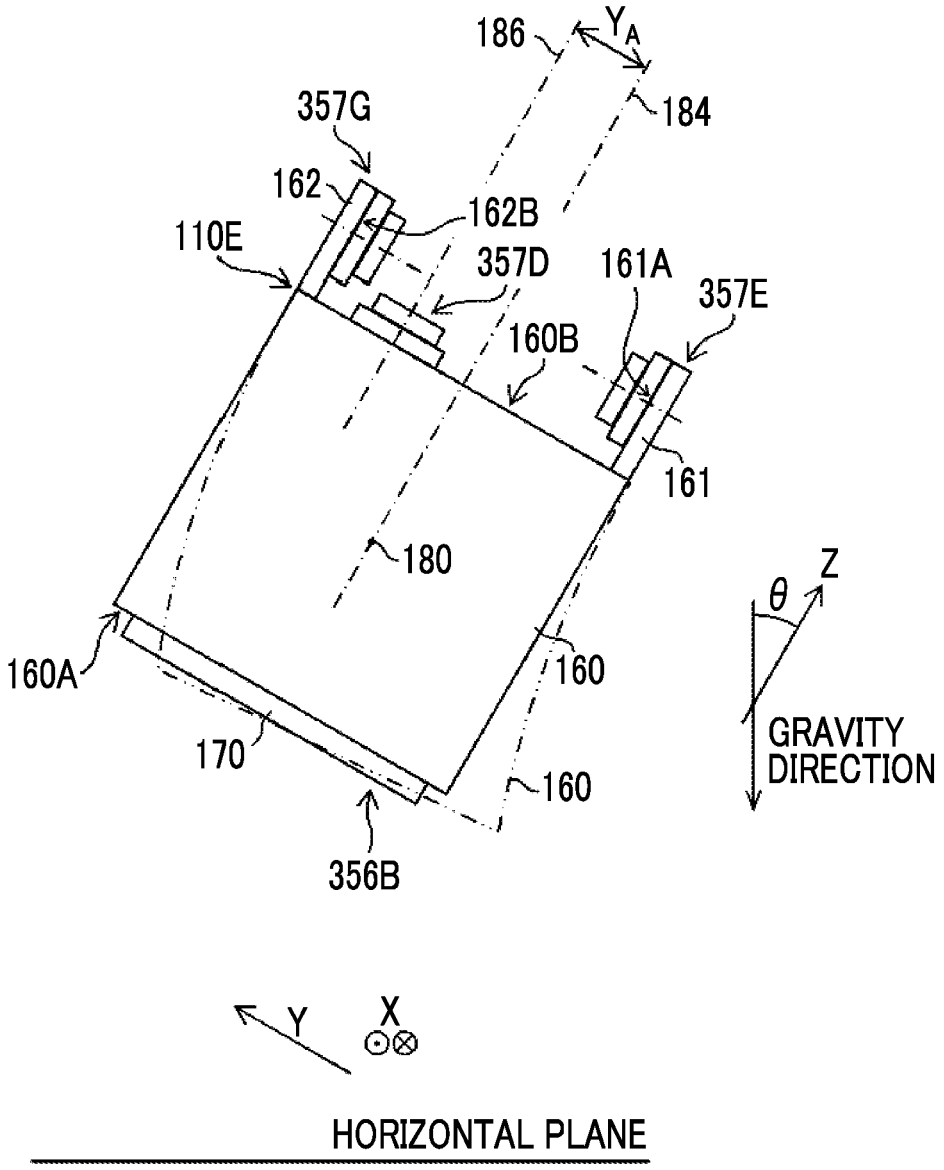
FIG. 22 is an explanatory view of a deflection easing function of a deflection suppressing unit according to a modification example of the eighth embodiment.

A Z-direction shown in FIG. 18 and FIG. 22 indicates the direction orthogonal to the top surface 160B of the head module supporting member 160. A reference sign θ shown in FIG. 18 indicates an angle formed of the direction orthogonal to the top surface 160B of the head module supporting member 160 with respect to the gravity direction, which is the disposition angle of the liquid ejecting head 356A. The direction orthogonal to the top surface 160B of the head module supporting member 160 can be used interchangeably with a direction orthogonal to the liquid ejecting surface 277.

As illustrated in FIG. 18, the deflection of the liquid ejecting head 356A, which is disposed such that the liquid ejecting surface 277 is obliquely inclined with respect to the horizontal plane, in the longitudinal direction is complicated. Deflection occurs in the liquid ejecting head 356A illustrated in FIG. 18 in a direction orthogonal to the longitudinal direction of the liquid ejecting head 356A, which is a direction having a component of the gravity direction.

As illustrated with two-dot chain lines in FIG. 18, deflection, in which a portion of the liquid ejecting head 356A on a lower side of a position 110E where the head module supporting member 110 is fixed is twisted, occurs. Hereinafter, the description of easing of the deflection described above will be made in detail.

[Configuration of Deflection Suppressing Unit]

The liquid ejecting head 356A illustrated in FIG. 18 includes a first deflection suppressing unit 357D, a second deflection suppressing unit 357E, a third deflection suppressing unit 357F, and a fourth deflection suppressing unit 357G The structures of the first deflection suppressing unit 357D, the second deflection suppressing unit 357E, the third deflection suppressing unit 357F, and the fourth deflection suppressing unit 357G are illustrated in FIG. 18 in a simplified manner.

The same structure as the structure of the deflection suppressing unit 112 illustrated in FIG. 6 or the same structure as the structure of the deflection suppressing unit 112B illustrated in FIG. 9 is applicable to the first deflection suppressing unit 357D, the second deflection suppressing unit 357E, the third deflection suppressing unit 357F, and the fourth deflection suppressing unit 357G The first deflection suppressing unit 357D illustrated in FIG. 18 includes a first sacrifice member 154D and a first intermediate connection member 156D. The same structure as the first sacrifice member 154A illustrated in FIG. 15 is applicable to the first sacrifice member 154D.

The same structure as the first intermediate connection member 156A illustrated in FIG. 15 is applicable to the first intermediate connection member 156D illustrated in FIG. 18. The first deflection suppressing unit 357D illustrated in FIG. 18 is different from the first deflection suppressing unit 357A illustrated in FIG. 15 in terms of disposition on the top surface 160B of the head module supporting member 160.

Specifically, the first deflection suppressing unit 357D illustrated in FIG. 18 is disposed at a position where an intersection point between a bisector that bisects the length of the first sacrifice member 154D in the traverse direction and a bisector that bisects the length of the first sacrifice member 154D in the longitudinal direction passes through a straight line 186 that does not pass through the centroid 180 of the liquid ejecting head 356, which is the straight line 186 in the direction orthogonal to the top surface 160B of the head module supporting member 160.

The second deflection suppressing unit 357E illustrated in FIG. 18 includes a second sacrifice member 154E and a second intermediate connection member 156E. The same structure as the second sacrifice member 154B illustrated in FIG. 15 is applicable to the second sacrifice member 154E. The same structure as the second intermediate connection member 156B illustrated in FIG. 15 is applicable to the second intermediate connection member 156E illustrated in FIG. 18.

The second deflection suppressing unit 357E illustrated in FIG. 18 is disposed on the second deflection suppressing unit attached surface 161A of the rib 161 as in the second deflection suppressing unit 357B illustrated in FIG. 15. That is, the second deflection suppressing unit 357E illustrated in FIG. 18 has the same structure, disposition, and functions as the second deflection suppressing unit 357B illustrated in FIG. 15.

The third deflection suppressing unit 357F illustrated in FIG. 18 includes a third sacrifice member 154F and a third intermediate connection member 156F. The same structure as the first sacrifice member 154D is applicable to the third sacrifice member 154F. The same structure as the first intermediate connection member 156D is applicable to the third intermediate connection member 156F.

The third deflection suppressing unit 357F is disposed on the top surface 160B of the head module supporting member 160. The third deflection suppressing unit 357F is disposed at a position where an intersection point between a bisector that bisects the length of the third sacrifice member 154F in the traverse direction and a bisector that bisects the length of the third sacrifice member 154F in the longitudinal direction passes through a straight line 188 that does not pass through the centroid 180 of the liquid ejecting head 356A, which is the straight line 188 in the direction orthogonal to the top surface 160B of the head module supporting member 160.

The third deflection suppressing unit 357F is disposed at a position on an upstream side of the first deflection suppressing unit 357D in the transporting direction of the recording medium, which is shown with the reference sign Y. The illustration of a recording medium is omitted in FIG. 18. The third deflection suppressing unit 357F is disposed on a position below the first deflection suppressing unit 357D in the gravity direction.

Herein, the transporting direction of the recording medium, which is shown in FIG. 18 with the reference sign Y, is the transporting direction of the recording medium in the liquid ejecting head 356A, and is a direction parallel to the liquid ejecting surface 277 of the liquid ejecting head 356A.

The transporting direction of the recording medium shown in FIG. 18 is a direction parallel to a direction tangential to an outer circumferential surface of the transporting drum 352 illustrated in FIG. 13. The same also applies to the transporting direction of the recording medium, which is shown in FIG. 22 with the reference sign Y. The transporting direction of the recording medium, which is shown in FIG. 18 with the reference sign Y, is an embodiment of a second direction.

The fourth deflection suppressing unit 357G includes a fourth sacrifice member 154G and a fourth intermediate connection member 156G The same structure as the second sacrifice member 154E is applicable to the fourth sacrifice member 154G The same structure as the second intermediate connection member 156E is applicable to the fourth intermediate connection member 156G.

The fourth deflection suppressing unit 357G is disposed on a fourth deflection suppressing unit attached surface 162A of a rib 162 disposed at a position which is opposed to the rib 161.

The first sacrifice member 154D illustrated in FIG. 18 is an embodiment of the first deflection absorption unit. The first intermediate connection member 156D is an embodiment of the first head module supporting member connection unit. The second sacrifice member 154E is an embodiment of the second deflection absorption unit. The second intermediate connection member 156E is an embodiment of the second head module supporting member connection unit. The third sacrifice member 154F is an embodiment of a third deflection absorption unit. The third intermediate connection member 156F is an embodiment of a third head module supporting member connection unit. The fourth sacrifice member 154G is an embodiment of a fourth deflection absorption unit. The fourth intermediate connection member 156G is an embodiment of a fourth head module supporting member connection unit.

[Function of Deflection Suppressing Unit]

A first reaction $F_{Z1}$ shown in FIG. 18 is a force that raises the head module supporting member 160 in the direction orthogonal to the top surface 160B of the head module supporting member 160, which is the obliquely upward direction with respect to the horizontal plane, with the first deflection suppressing unit 357D being used.

A third reaction $F_{Z2}$ shown in FIG. 18 is a force that raises the head module supporting member 160 in the direction orthogonal to the top surface 160B of the head module supporting member 160, which is the obliquely upward direction with respect to the horizontal plane, with the third deflection suppressing unit 357F being used.

A direction indicated by a reference sign Z shown in FIG. 18 is the direction orthogonal to the top surface 160B of the head module supporting member 160 and the obliquely upward direction with respect to the horizontal plane. In the liquid ejecting head 356A, the liquid ejecting surface 277 and the top surface 160B of the head module supporting member 160 are parallel to each other.

A second reaction $F_{Y1}$ is a force that raises the head module supporting member 160 in the direction orthogonal to the second deflection suppressing unit attached surface 161A of the rib 161, which is the obliquely upward direction with respect to the horizontal plane, with the second deflection suppressing unit 357E being used.

A fourth reaction $F_{Y2}$ is a force that pushes the head module supporting member 160 in a direction orthogonal to the fourth deflection suppressing unit attached surface 162A of the rib 162, which is the obliquely downward direction with respect to the horizontal plane, with the fourth deflection suppressing unit 357G being used.

A direction indicated by the reference sign Y shown in FIG. 18 is the direction orthogonal to the second deflection suppressing unit attached surface 161A of the rib 161, which is the obliquely upward direction with respect to the horizontal plane. An opposite direction to the direction indicated by the reference sign Y shown in FIG. 18 is the direction orthogonal to the fourth deflection suppressing unit attached surface 162A of the rib 162, which is the obliquely downward direction with respect to the horizontal plane.

A top surface 160B of the head module supporting member 160 and the second deflection suppressing unit attached surface 161A of the rib 161 are orthogonal to each other. Similarly, the top surface 160B of the head module supporting member 160 and the fourth deflection suppressing unit attached surface 162A of the rib 162 are orthogonal to each other.

By adjusting a balance between the first reaction $F_{Z1}$ and the third reaction $F_{Z2}$ in the case of easing deflection, the complicated deflection of the liquid ejecting head 356A shown in FIG. 18 is eased in the longitudinal direction of the liquid ejecting head 356A.

For example, by making the first reaction $F_{Z1}$>the third reaction $F_{Z2}$, the liquid ejecting head 356A can be rotated about a rotation axis, which passes through the centroid 180 of the liquid ejecting head 356A and is in a direction parallel to the longitudinal direction of the liquid ejecting head 356, in a clockwise direction in FIG. 18.

Then, the orientation of the liquid ejecting surface 277 facing a downstream side of the transporting direction of the recording medium due to complicated deflection in the longitudinal direction of the liquid ejecting head 356A is corrected.

A value obtained by subtracting the magnitude $|F_{Z2}|$ of the third reaction $F_{Z2}$ from the magnitude $|F_{Z1}|$ of the first reaction $F_{Z1}$ is relatively large. As a result of adjusting the first reaction $F_{Z1}$ and the third reaction $F_{Z2}$, the liquid ejecting head 356A can be rotated more widely in the clockwise direction in FIG. 18.

In a case where a distance between the first deflection suppressing unit 357D and the third deflection suppressing unit 357F in the transporting direction of the recording medium is relatively large, the moment of a force acting on the liquid ejecting head 356A is large and the liquid ejecting head 356A can be rotated more widely in the clockwise direction in FIG. 18.

In addition, the second reaction $F_{Y1}$ and the fourth reaction $F_{Y2}$ are adjusted as the first reaction $F_{Z1}$ and the third reaction $F_{Z2}$ are adjusted. A form in which the fourth deflection suppressing unit 357G illustrated in FIG. 18 is not adjusted and the fourth reaction $F_{Y2}$ does not act on can also be adopted.

In FIG. 18, the illustration of the first biasing force that causes the first reaction $F_{Z1}$ and the second biasing force that causes the second reaction $F_{Y1}$, a third biasing force that causes the third reaction $F_{Z2}$, and a fourth biasing force that causes the fourth reaction $F_{Y2}$ is omitted.

The first biasing force and the second biasing force are shown in FIG. 16. The third biasing force has a direction parallel to the first biasing force, and has the same orientation as the first biasing force. The third biasing force is a force in the same direction as the first biasing force. The fourth biasing force has a direction parallel to the second biasing force and has an orientation opposite to the second biasing force.

[Description of Relationship Between Disposition Angle of Liquid Ejecting Head and Force Required for Deflection Easing]

Next, the description of the disposition angle of the ink jet head and a force required for deflection easing will be made. Each of the ink jet head 356C, the ink jet head 356M, the ink jet head 356Y, and the ink jet head 356K illustrated in FIG. 13 has a different disposition angle with respect to the horizontal plane.

In a case where the disposition angle of the ink jet head differs, a force required for deflection easing varies according to the disposition angle of the ink jet head. A relationship between the disposition angle of the ink jet head and a force required for deflection easing is derived in advance, and the first reaction $F_{Z1}$, the second reaction $F_{Y1}$, the third reaction $F_{Z2}$, and the fourth reaction $F_{Y2}$ shown in FIG. 18 can be adjusted according to the disposition angle of the ink jet head by using the relationship between the disposition angle of the ink jet head and a force required for deflection easing.

Figure 19:
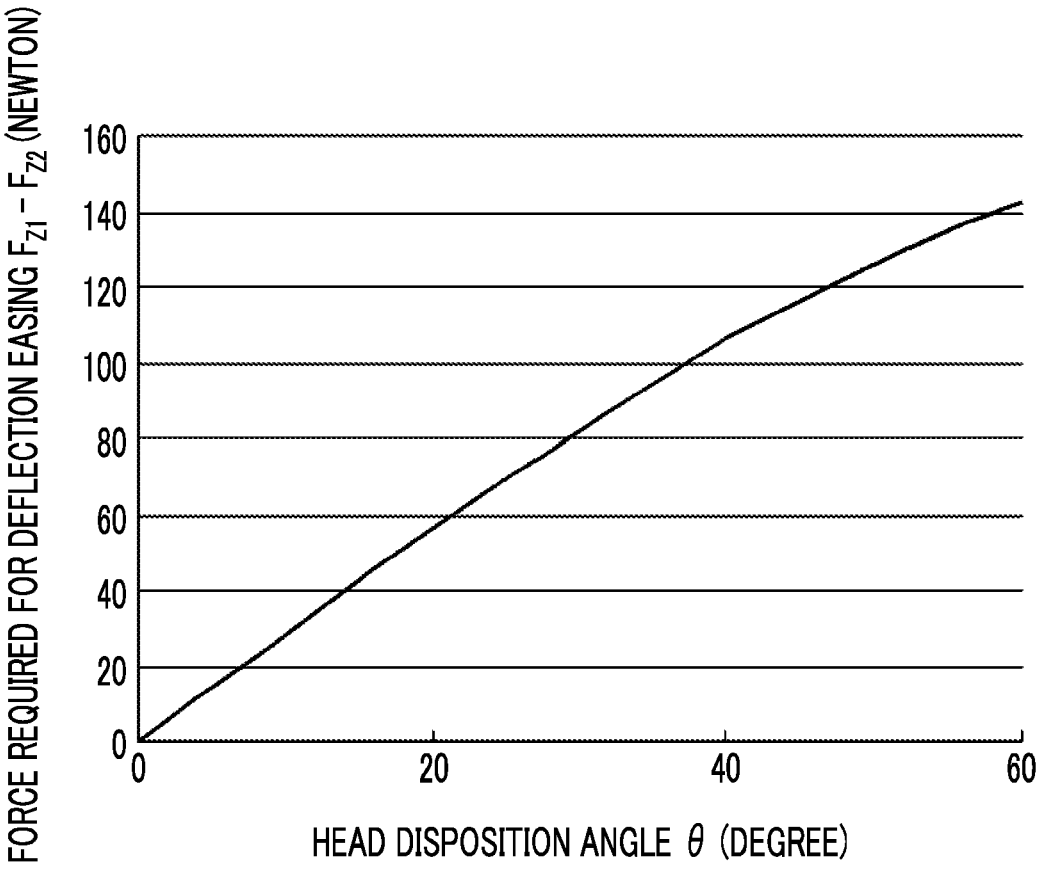
FIG. 19 is a graph showing a relationship between a disposition angle of an ink jet head and a force required for deflection easing.

FIG. 19 is a graph showing a relationship between the disposition angle of the ink jet head and a force required for deflection easing. A horizontal axis of the graph shown in FIG. 19 is the disposition angle of the ink jet head. The unit of the horizontal axis of the graph shown in FIG. 19 is the degree. A vertical axis of the graph shown in FIG. 19 is a value obtained by subtracting the magnitude $|F_{Z2}|$ of the third reaction $F_{Z2}$ from the magnitude $|F_{Z1}|$ of the first reaction $F_{Z1}$ shown in FIG. 18. The unit of the vertical axis of the graph shown in FIG. 19 is the newton.

Figure 20:
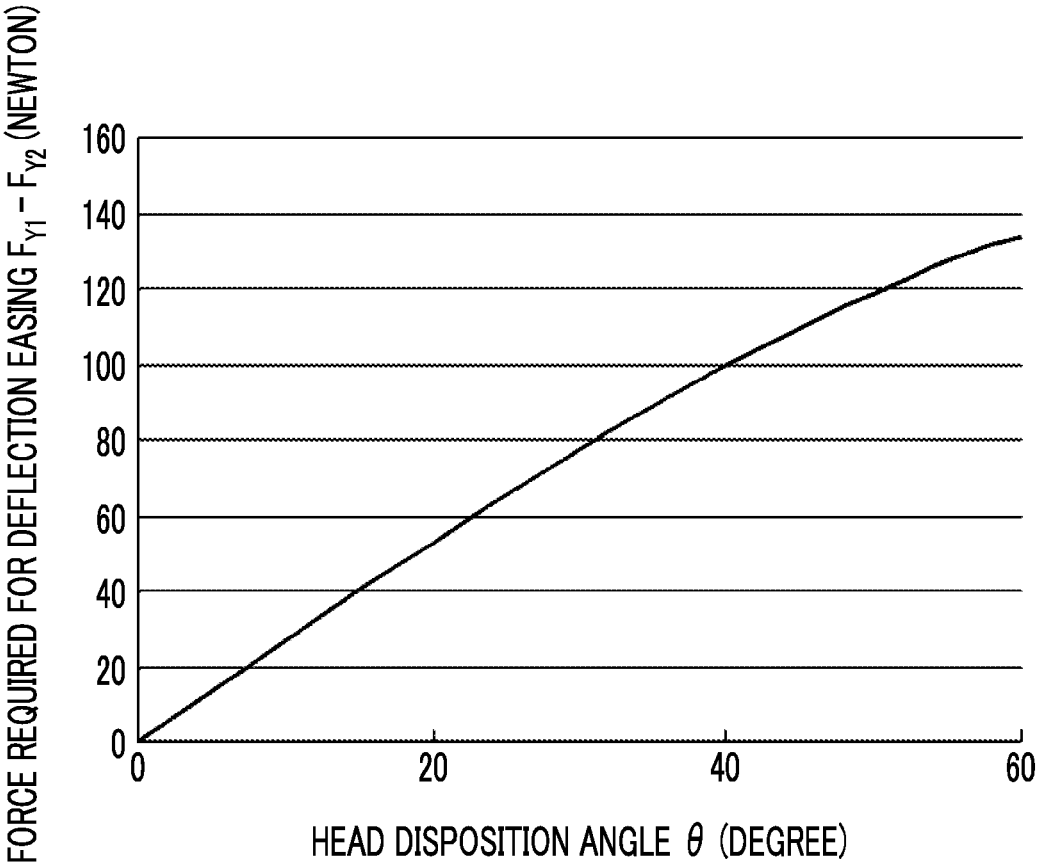
FIG. 20 is a graph showing the relationship between the disposition angle of the ink jet head and the force required for deflection easing.

FIG. 20 is a graph showing a relationship between the disposition angle of the ink jet head and a force required for deflection easing. A horizontal axis of the graph shown in FIG. 20 is the disposition angle of the ink jet head. The unit of the horizontal axis of the graph shown in FIG. 20 is the degree. A vertical axis of the graph shown in FIG. 20 is a value obtained by subtracting the magnitude $|F_{Y2}|$ of the fourth reaction $F_{Y2}$ from the magnitude $|F_{Y1}|$ of the second reaction $F_{Y1}$ shown in FIG. 18. The unit of the vertical axis of the graph shown in FIG. 20 is the newton.

Figure 21:
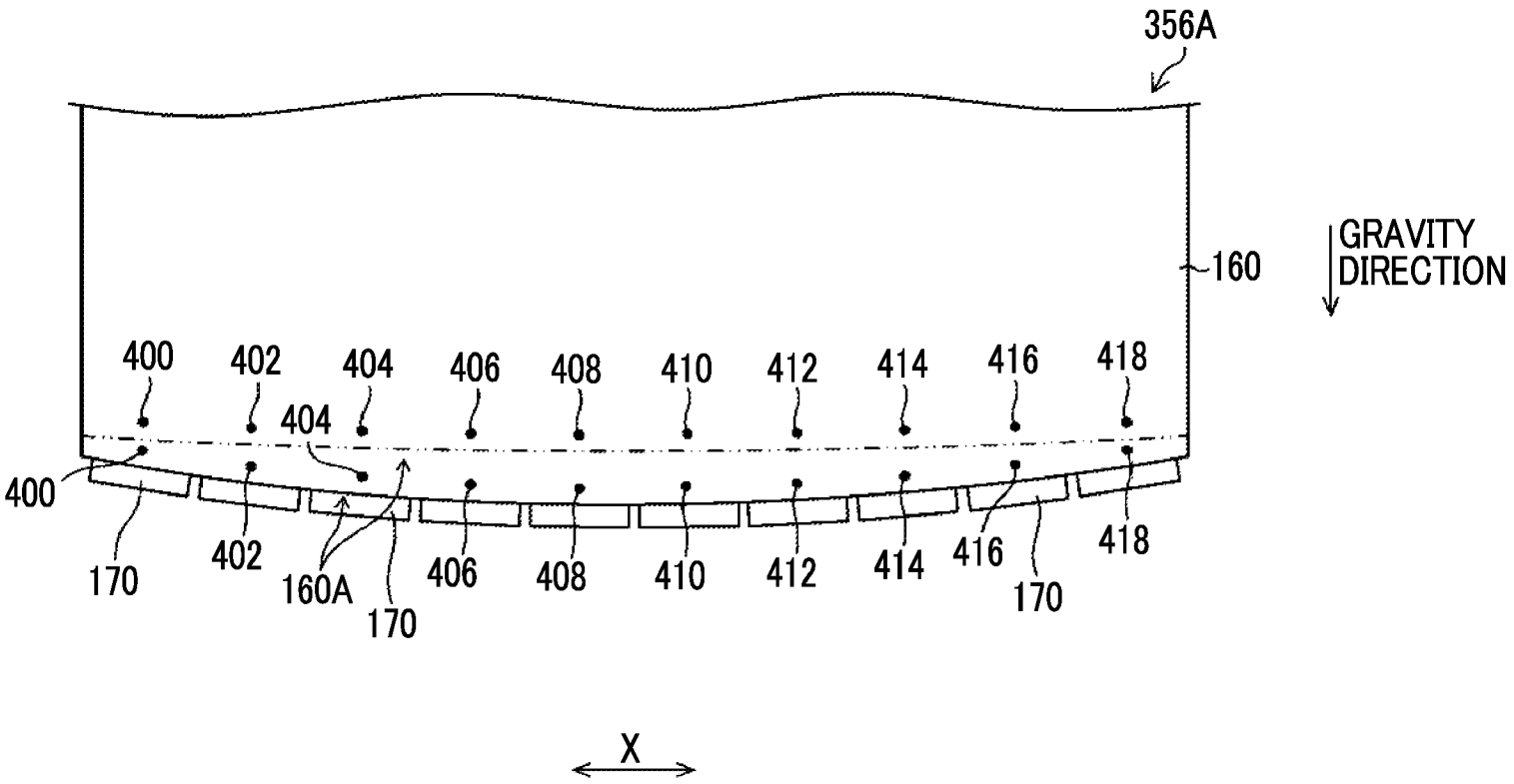
FIG. 21 is an explanatory view of a method for measuring the force required for deflection easing shown in FIG. 18 and FIG. 19.

FIG. 21 is an explanatory view of a method for measuring a force required for deflection easing shown in FIG. 18 and FIG. 19. FIG. 21 is a view of the liquid ejecting head 356A seen in the horizontal direction. A direction of vertically penetrating the page of FIG. 21 is the horizontal direction.

A measurement point 400, a measurement point 402, a measurement point 404, a measurement point 406, a measurement point 408, a measurement point 410, a measurement point 412, a measurement point 414, a measurement point 416, and a measurement point 418 illustrated in FIG. 21 are measurement points at positions of the head modules 200 in the gravity direction, respectively.

Hereinafter, in a case where it is not required to differentiate between the measurement point 400, the measurement point 402, the measurement point 404, the measurement point 406, the measurement point 408, the measurement point 410, the measurement point 412, the measurement point 414, the measurement point 416, and the measurement point 418, reference signs will be omitted.

A three-dimensional measuring machine is applicable in measuring of the measurement points. It is sufficient that the three-dimensional measuring machine applied in measuring of the measurement point can measure the position of each measurement point in the gravity direction. The illustration of the three-dimensional measuring machine is omitted.

From a perspective of stability of measurement in which the three-dimensional measuring machine is used, each measurement point illustrated in FIG. 21 is set at a position closer to each head module 170 of the head module supporting member 160. It is preferable that each measurement point be set at each head module 170 insofar as each measurement point can be set at each head module 170.

First, the liquid ejecting head 356A adjusted to a disposition angle which is actually used is prepared. Next, in a state where the first deflection suppressing unit 357D, the second deflection suppressing unit 357E, the third deflection suppressing unit 357F, and the fourth deflection suppressing unit 357G illustrated in FIG. 18 are not adjusted, the position of each measurement point in the gravity direction, which is illustrated in FIG. 21 is measured.

A state where the first deflection suppressing unit 357D, the second deflection suppressing unit 357E, the third deflection suppressing unit 357F, and the fourth deflection suppressing unit 357G illustrated in FIG. 18 are not adjusted may be a deflection non-eased state where the deflection of the liquid ejecting head 356A is not within a predetermined range.

In addition, in a state where the first deflection suppressing unit 357D, the second deflection suppressing unit 357E, the third deflection suppressing unit 357F, and the fourth deflection suppressing unit 357G are not adjusted, the first deflection suppressing unit 357D, the second deflection suppressing unit 357E, the third deflection suppressing unit 357F, and the fourth deflection suppressing unit 357G may come into a state of not being mounted on the liquid ejecting head 356A.

Next, in a state where the first deflection suppressing unit 357D, the second deflection suppressing unit 357E, the third deflection suppressing unit 357F, and the fourth deflection suppressing unit 357G illustrated in FIG. 18 are adjusted and deflection is eased the most, the position of each measurement point in the gravity direction illustrated in FIG. 21 is measured.

For example, a state where a value obtained by subtracting a measured value of the measurement point 408 from a measured value of the measurement point 400 is minimum is applicable to the state where deflection is eased the most. In addition, a state where a value obtained by subtracting a measured value of the measurement point 410 from a measured value of the measurement point 418 is minimum is applicable as the state where deflection is eased the most. A two-dot chain line shown in FIG. 21 indicates the head module supporting surface 110A in the state where deflection is eased the most.

A value obtained by subtracting the magnitude $|F_{Z2}|$ of the third reaction $F_{Z2}$ from the magnitude $|F_{Z1}|$ of the first reaction $F_{Z1}$ shown in FIG. 18, which corresponds to the state where deflection is eased the most, is set as a force required for deflection easing in the graph shown in FIG. 19. In addition, a value obtained by subtracting the magnitude $|F_{Y2}|$ of the fourth reaction $F_{Y2}$ from the magnitude $|F_{Y1}|$ of the second reaction $F_{Y1}$, which corresponds to the state where deflection is eased the most, is set as a force required for deflection easing in the graph shown in FIG. 20.

Although one measurement point is illustrated for each head module 170 in FIG. 21, a plurality of measurement points may be set for each head module 170. On the other hand, a measurement point may not be set for each head module 170. It is sufficient that measurement points are set at least at both end portions of the liquid ejecting head 356A in the longitudinal direction and a middle portion of the liquid ejecting head 356A in the longitudinal direction.

The both end portions of the liquid ejecting head 356A in the longitudinal direction are within an area where both ends of the liquid ejecting head 356A in the longitudinal direction are included and are within an area having a distance determined in advance from the both ends of the liquid ejecting head 356A in the longitudinal direction to the inside. The distance determined in advance is determined from a perspective of measurement.

The middle portion of the liquid ejecting head 356A in the longitudinal direction is within an area where the middle of the liquid ejecting head 356A in the longitudinal direction is included, and within an area determined in advance having a distance from the middle of the liquid ejecting head 356A in the longitudinal direction.

Out of forces required for deflection easing shown in FIG. 19 and FIG. 20, a force required for deflection easing at a disposition angle other than the disposition angle of the liquid ejecting head 356A which is actually used can be derived from simulation.

Forces required for deflection easing shown in FIG. 19 and FIG. 20 include actual values at two types of disposition angles that are actually used and a value derived from simulation.

[Modification Example of Eighth Embodiment]

FIG. 22 is an explanatory view of a deflection easing function of a deflection suppressing unit according to a modification example of the eighth embodiment. The illustration of reference signs of configuration elements of the first deflection suppressing unit 357D, the second deflection suppressing unit 357E, and the fourth deflection suppressing unit 357G is omitted in FIG. 22.

The third deflection suppressing unit 357F included in the liquid ejecting head 356A illustrated in FIG. 18 is removed from a liquid ejecting head 356B illustrated in FIG. 22, and the third reaction $F_{Z2}$ is 0 newton.

Instead of the adjustment of the first reaction $F_{Z1}$ and the adjustment of the third reaction $F_{Z2}$ shown in FIG. 18, the adjustment of the position of the first deflection suppressing unit 357D in the transporting direction of the recording medium and the adjustment of the magnitude $|F_{Z1}|$ of the first reaction $F_{Z1}$ which is caused by the first deflection suppressing unit 357D are applied to the liquid ejecting head 356B illustrated in FIG. 22.

That is, by adjusting the magnitude $|F_{Z1}|$ of the first reaction $F_{Z1}$ caused by the first deflection suppressing unit 357D and adjusting a distance $Y_A$ from an intersection point between a straight line 184 passing through the centroid of the liquid ejecting head 356B, which is the straight line 184 orthogonal to the top surface 160B of the head module supporting member 160, and the top surface 160B of the head module supporting member 160 to a position where the first reaction $F_{Z1}$ acts on the top surface 160B of the head module supporting member 160, deflection, in which a portion of the liquid ejecting head 356B on a lower side of the position 110E where the head module supporting member 160 is fixed is twisted, is eased.

The position where the first reaction $F_{Z1}$ acts on the top surface 160B of the head module supporting member 160 is a position where the first deflection suppressing unit 357D is disposed on the top surface 160B of the head module supporting member 160, and is an intersection point between a bisector of the first deflection suppressing unit 357D in the longitudinal direction and a bisector of the first deflection suppressing unit 357D in the traverse direction.

In other words, the first deflection suppressing unit 357D is disposed on the top surface 160B of the head module supporting member 160 at a position spaced apart from the intersection point between the straight line 184 and the top surface 160B of the head module supporting member 160 by the distance $Y_A$ in a direction orthogonal to the longitudinal direction of the first deflection suppressing unit 357D, which is the direction parallel to the top surface 160B of the head module supporting member 160.

The longitudinal direction of the first deflection suppressing unit 357D is an embodiment of the first direction. The direction orthogonal to the longitudinal direction of the first deflection suppressing unit 357D, which is the direction parallel to the top surface 160B of the head module supporting member 160, is an embodiment of the second direction.

<Operation Effect of Eighth Embodiment>

In the deflection suppressing unit according to the eighth embodiment, both of deflection in the direction orthogonal to the longitudinal direction of the liquid ejecting head 356B, which is a direction having a component of the gravity direction, and deflection, in which a portion on the lower side of the position 110E where the head module supporting member 110 is fixed is twisted, can be eased.

The deflection suppressing unit according to the eighth embodiment is also applicable to the ink jet head 356C, the ink jet head 356M, the ink jet head 356Y, and the ink jet head 356K which are illustrated in FIG. 13 and are disposed in the oblique direction with respect to the horizontal plane.

Ninth Embodiment

[Description of Technical Problem]

Figure 23:
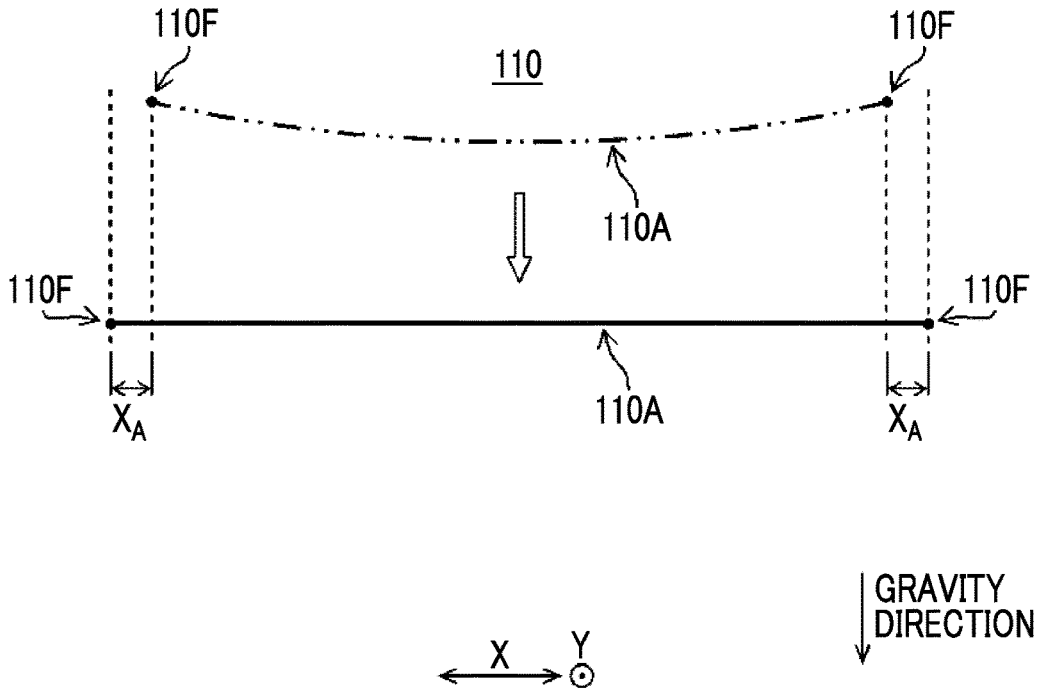
FIG. 23 is an explanatory view of a problem of a ninth embodiment.

FIG. 23 is an explanatory view of a problem of the ninth embodiment. FIG. 23 is a schematic view of the head module supporting surface 110A of the head module supporting member 110. The deflection of the head module supporting member 110 and the deflection of the head module supporting surface 110A in the following description can be used interchangeably with the deflection of the liquid ejecting head.

The head module supporting surface 110A illustrated with a two-dot chain line in FIG. 23 is in a state where deflection is not eased. The head module supporting surface 110A illustrated with a solid line in FIG. 23 is in a state where deflection is eased. An arrow line illustrated in FIG. 23 indicates that the deflection of the head module supporting surface 110A changes due to the deflection easing function.

As illustrated in FIG. 23, in a case where the deflection of the head module supporting member 110 in the gravity direction is eased, the positions of both ends 110F of the head module supporting member 110 in longitudinal direction move to the outside.

A reference sign $X_A$ shown in FIG. 23 indicates the moving distances of the both ends 110F of the head module supporting member 110 in the longitudinal direction. For example, in a case where deflection of approximately 10 micrometers is eased, the both ends 110F of the head module supporting member 110 in the longitudinal direction move to the outside by approximately 1 nanometer.

If the deflection of the head module supporting member 110 in the gravity direction is eased in a case where the both ends of the deflection suppressing unit 112 in the longitudinal direction are fixed to the both ends of the head module supporting member 110 in the longitudinal direction as illustrated in FIG. 6, the position of the both ends of the head module supporting member 110 in the longitudinal direction do not move to the outside and the easing of deflection of the head module supporting member 110 in the gravity direction is limited.

It can be avoided that the easing of deflection of the head module supporting member 110 in the gravity direction is limited by using a deflection suppressing unit according to the ninth embodiment of which the description is to be made.

[Configuration of Deflection Suppressing Unit]

Figure 24:
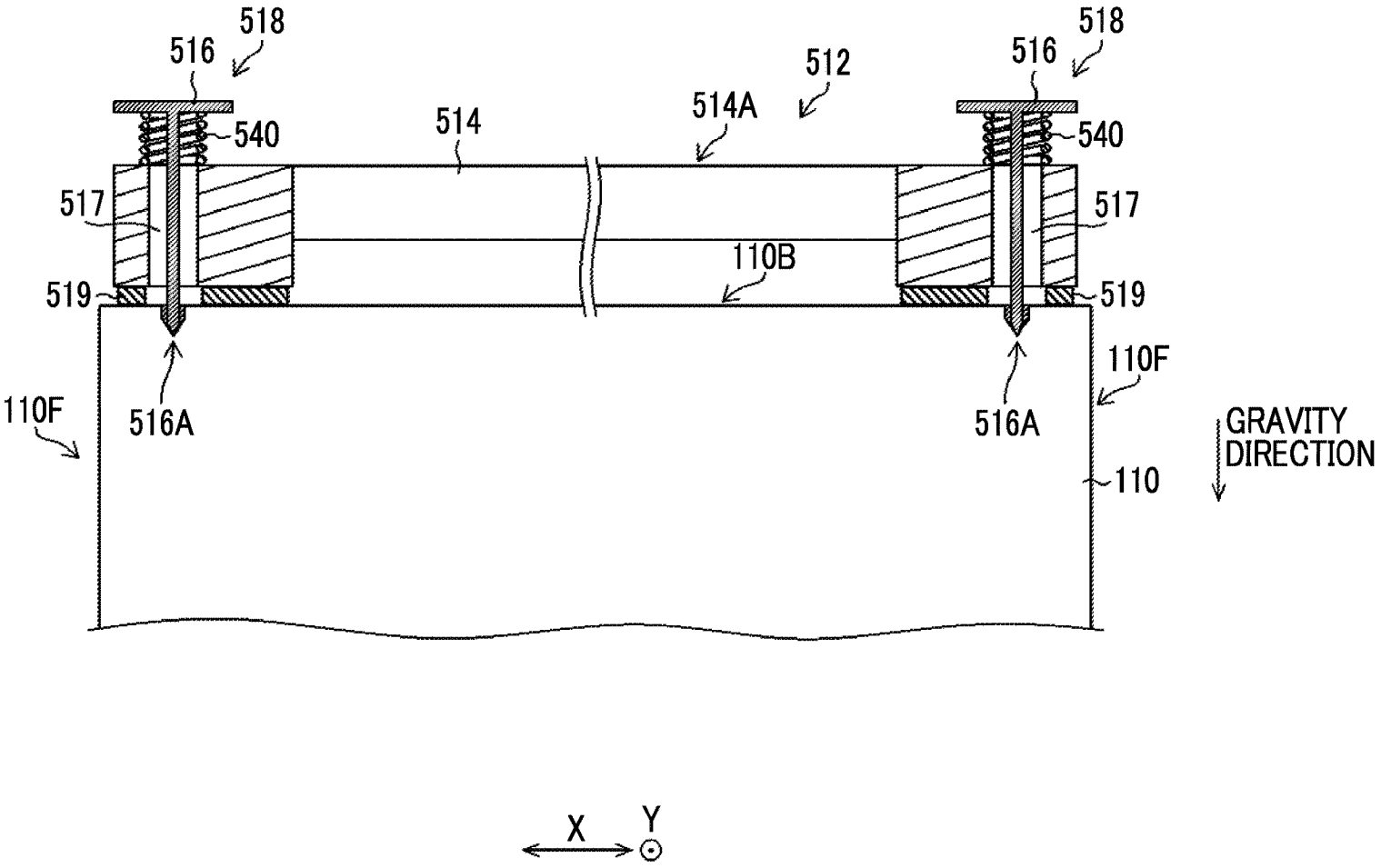
FIG. 24 is a schematic configuration view of a deflection suppressing unit according to the ninth embodiment.

FIG. 24 is a schematic configuration view of the deflection suppressing unit according to the ninth embodiment. As for a deflection suppressing unit 512 illustrated in FIG. 24, the deflection suppressing unit 512 and the head module supporting member 110 are connected to each other by moving mechanism 518 illustrated in FIG. 24, unlike the deflection suppressing unit 112 and the head module supporting member 110 fixed to each other by the screws 118 illustrated in FIG. 6.

The moving mechanisms 518 each are configured so as to include a hole portion 517, an intermediate connection unit 516, a compression spring 540, and a sliding member 519 which are provided in both end portions of a sacrifice member 514 in the longitudinal direction. The hole portions 517 are through-holes obtained by the sacrifice member 514 being penetrated in a direction orthogonal to a top surface 514A of the sacrifice member 514.

The same structures as the intermediate connection unit 116 and the compression spring 140 illustrated in FIG. 6 are applicable to the intermediate connection unit 516 and the compression spring 540. In addition, the same connecting structure between the intermediate connection unit 116 and the compression spring 140 illustrated in FIG. 6 is applicable to a connecting structure between the intermediate connection unit 516 and the compression spring 540 illustrated in FIG. 24.

A connecting structure which is the same as the connecting structure between the intermediate connection unit 116 and the head module supporting member 110 illustrated in FIG. 6 is applicable to the connecting structure between the intermediate connection unit 516 and the head module supporting member 110 illustrated in FIG. 24.

Lower ends 516A of the intermediate connection units 516 illustrated in FIG. 24 are fixed to the top surface 110B of the head module supporting member 110. Fixation by a screw and fixation by a joining member such as an adhesive are applicable to fixation between the lower ends 516A of the intermediate connection units 516 and the top surface 110B of the head module supporting member 110.

The sliding members 519 are provided at the both end portions of the sacrifice member 514 in the longitudinal direction. The sliding members 519 abut against the top surface 110B of the head module supporting member 110. By causing the head module supporting member 110 to slide with respect to the sacrifice member 514 via the sliding members 519, the both ends 110F of the head module supporting member 110 in the longitudinal direction are movable to the outside. The illustration of an intermediate connection unit disposed at a middle position in the sacrifice member 514 in the longitudinal direction and a compression spring is omitted in FIG. 24.

Figure 25:
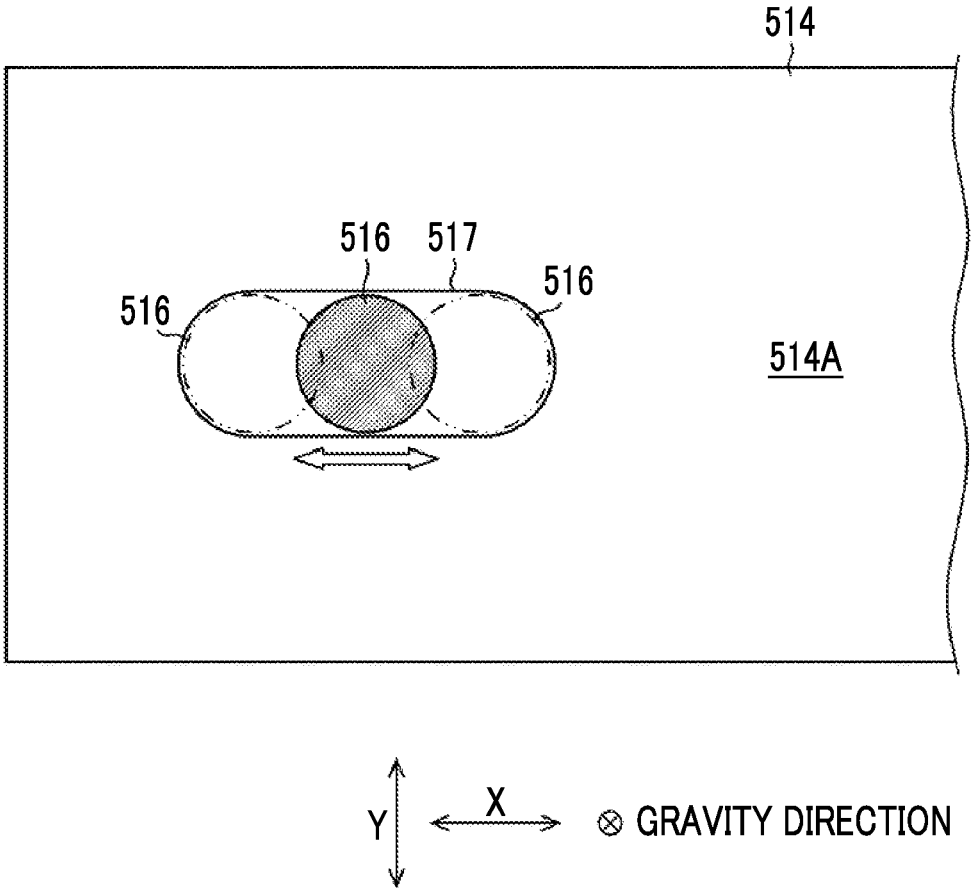
FIG. 25 is a partially enlarged view of the deflection suppressing unit according to the ninth embodiment.

FIG. 25 is a partially enlarged view of the deflection suppressing unit according to the ninth embodiment. FIG. 25 is a view of the sacrifice member 514 seen from a side of the top surface 514A of the sacrifice member 514. FIG. 25 illustrates the planar shape of the hole portion 517 provided in one end portion of the sacrifice member 514 in the longitudinal direction. The illustration of the compression spring 540 and portions connected to the compression spring 540 of the intermediate connection unit 516 illustrated in FIG. 24 is omitted in FIG. 25.

An arrow line illustrated in FIG. 25 indicates a moving direction of the intermediate connection unit 516, which is a long axis direction of the hole portion 517. The long axis direction of the hole portion 517 shown in FIG. 25 is a direction parallel to the longitudinal direction of the sacrifice member 514.

Although illustration thereof is omitted in FIG. 25, a hole portion having the same structure as the hole portion 517 illustrated in FIG. 25 is provided also in the other end portion of the sacrifice member 514 in the longitudinal direction.

As illustrated in FIG. 25, the planar shape of the hole portion 517 in the sacrifice member 514 is an oval shape. The oval shape is a shape obtained by making pieces of a rectangle semicircular arcs. The length of the hole portion 517 in a short axis direction corresponds to the diameter of the intermediate connection unit 516.

In a state where the intermediate connection unit 516 is insertable into the hole portion 517 and the intermediate connection unit 516 is inserted in the hole portion 517, the length of the hole portion 517 in the short axis direction is determined based on a condition that the movement of the intermediate connection unit 516 in the short axis direction of the hole portion 517 is restricted and a condition that the intermediate connection unit 516 is movable in the long axis direction of the hole portion 517.

The length of the hole portion 517 in long axis direction is determined based on the moving distances of the both ends of the head module supporting member 110 in a case where the deflection of the head module supporting member 110 in the gravity direction is eased.

Circles illustrated with two-dot chain lines in FIG. 25 indicate the intermediate connection unit 516 in a case where the intermediate connection unit is moved to the both ends of the hole portion 517 in the longitudinal direction. In addition, a circle hatched with diagonal lines shows the intermediate connection unit 516 which is at the middle position in the hole portion 517.

That is, the both ends of the head module supporting member 110 can be moved within an area having the length of the hole portion 517 in the long axis direction in a case where the deflection of the head module supporting member 110 in the gravity direction is eased.

Although the hole portion 517 of which the long axis direction is a direction parallel to the longitudinal direction of the sacrifice member 514 is given as an example in FIG. 25, the hole portion 517 of which the long axis direction is a direction intersecting the longitudinal direction of the sacrifice member 514 may be provided.

First Modification Example

Figure 26:
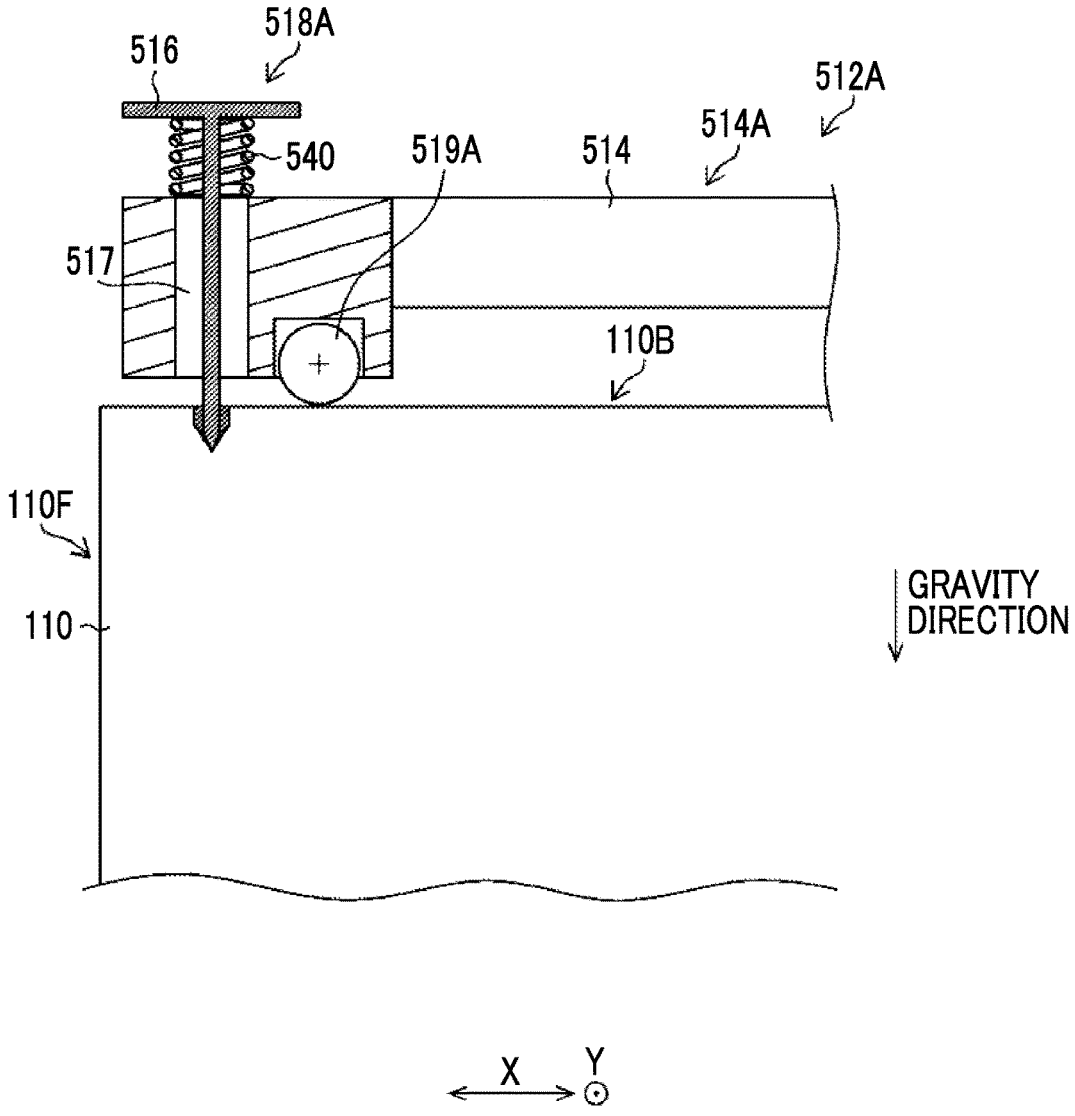
FIG. 26 is a schematic configuration view of a deflection suppressing unit according to a first modification example of the ninth embodiment.

FIG. 26 is a schematic configuration view of a deflection suppressing unit according to a first modification example of the ninth embodiment. One end of a deflection suppressing unit 512A in the longitudinal direction is illustrated in an enlarged manner in FIG. 26.

A moving mechanism 518A according to the first modification example illustrated in FIG. 26 includes rolling members 519A instead of the sliding members 519 illustrated in FIG. 25. Rollers having a length corresponding to the length of the sacrifice member 514 in the traverse direction is applicable to the rolling members 519A. A plurality of spheres disposed in the traverse direction of the sacrifice member 514 are applicable to the rolling members 519A.

Although the illustration of the other end of the sacrifice member 514 is omitted in FIG. 26, a moving mechanism having the same structure and function as the moving mechanism 518A illustrated in FIG. 26 is also provided at the other end of the sacrifice member 514.

In the deflection suppressing unit according to the first modification example, resistance against the deflection suppressing unit 512A in a case where the both ends 110F of the head module supporting member 110 are moved is reduced compared to the deflection suppressing unit 512 illustrated in FIG. 25.

On the other hand, a simpler structure can be applied to the moving mechanism 518 in the deflection suppressing unit 512 illustrated in FIG. 25 compared to the rolling members 519A illustrated in FIG. 26 and a structure in which the rolling members 519A formed in the sacrifice member 514 are supported are supported.

Second Modification Example

Figure 27:
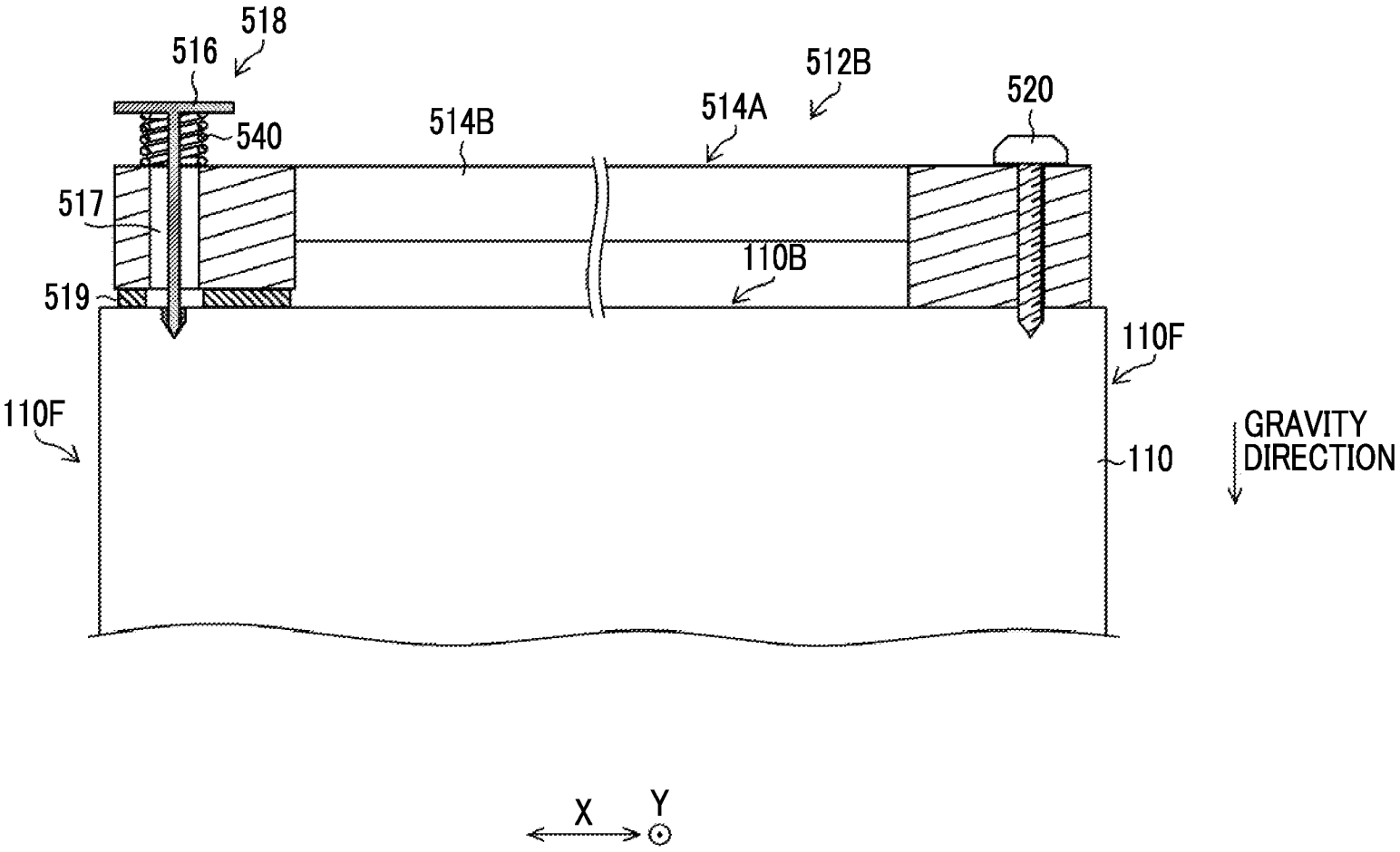
FIG. 27 is a schematic configuration view of a deflection suppressing unit according to a second modification example of the ninth embodiment.

FIG. 27 is a schematic configuration view of a deflection suppressing unit according to a second modification example of the ninth embodiment. One end of a deflection suppressing unit 512B in the longitudinal direction illustrated in FIG. 27 is connected to the top surface 110B of the head module supporting member 110 by the intermediate connection unit 516.

In addition, the other end of the deflection suppressing unit 512B in the longitudinal direction is connected to the top surface 110B of the head module supporting member 110 by a fixing member 520. The illustration of the intermediate connection unit 116 disposed at a middle position in the longitudinal direction of the deflection suppressing unit 512B is omitted also in FIG. 27.

A screw is applicable to the fixing member 520. Instead of the fixing member 520, the sacrifice member 514B and the head module supporting member 110 may be joined together by a joining member such as an adhesive.

In the deflection suppressing unit 512B according to the second modification example, one end of the head module supporting member 110 in the longitudinal direction can be moved to the outside in a case where the deflection of the head module supporting member 110 in the gravity direction is eased.

The structure of the other end of the deflection suppressing unit 512B in the longitudinal direction according to the second modification example is simpler compared to the deflection suppressing unit 512 illustrated in FIG. 23. By making the structure of the other end simple, manufacturing costs of the deflection suppressing unit 512B can be reduced.

On the other hand, in the deflection suppressing unit 512 illustrated in FIG. 24, each of the both ends of the head module supporting member 110 can be moved to the outside in the longitudinal direction, and the movement area of the both ends of the head module supporting member 110 can be made larger compared to the deflection suppressing unit 512B illustrated in FIG. 27.

In addition, in the deflection suppressing unit 512 illustrated in FIG. 24, the position accuracy of the head module supporting member 110 can be improved compared to the deflection suppressing unit 512B illustrated in FIG. 27.

<Operation Effect of Ninth Embodiment>

In the deflection suppressing unit according to the ninth embodiment, since the both ends of the head module supporting member 110 in the longitudinal direction are movable to the outside in a case where the deflection of the head module supporting member 110 in the gravity direction is eased, it can be avoided that the easing of deflection of the head module supporting member 110 in the gravity direction is limited, and the deflection of the head module supporting member 110 in the gravity direction can be sufficiently eased.

The deflection suppressing unit according to the ninth embodiment is also applicable to the ink jet head 356C, the ink jet head 356M, the ink jet head 356Y, and the ink jet head 356K which are illustrated in FIG. 13 and are disposed in the oblique direction with respect to the horizontal plane.

[Apparatus Application Example]

Figure 17:
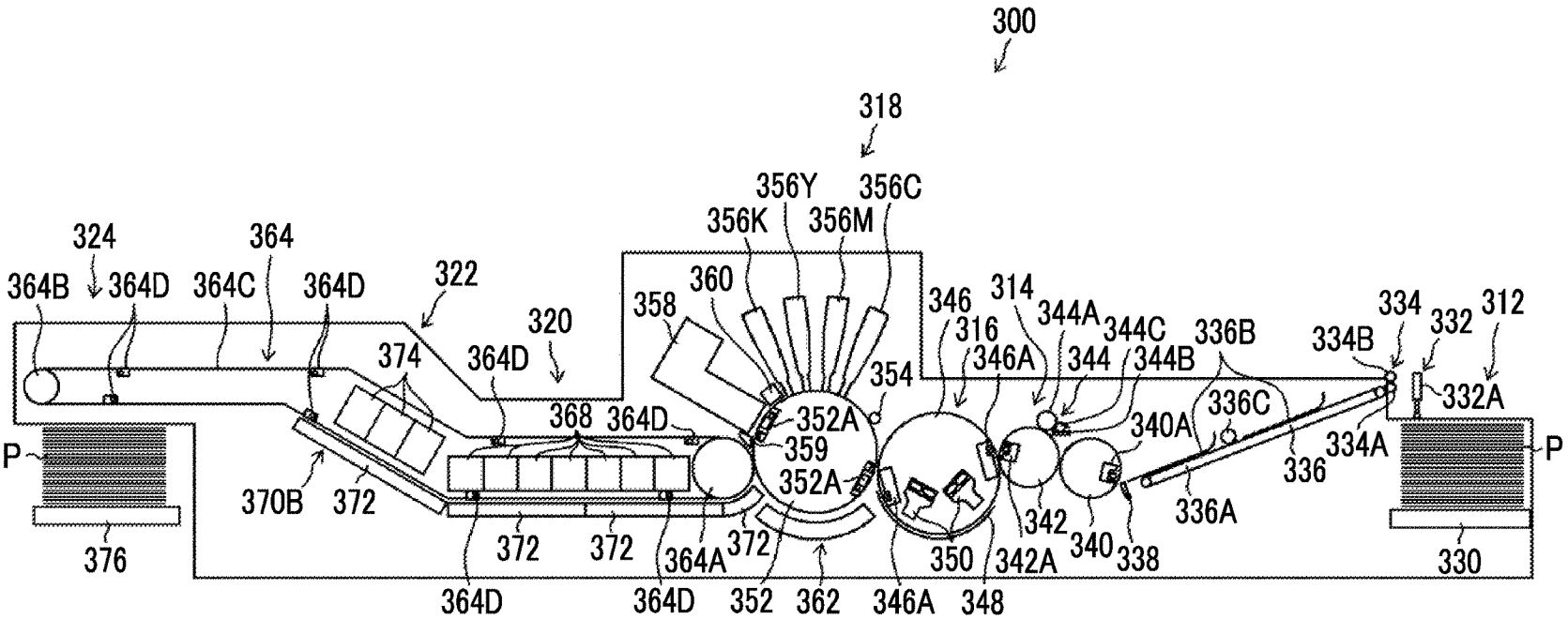
FIG. 17 is an overall configuration view of an ink jet recording apparatus.

Next, the description of an apparatus application example of the liquid ejecting head described above will be made. FIG. 17 is an overall configuration view of the ink jet recording apparatus. In FIG. 17, the same configurations as FIG. 13 will be assigned with the same reference signs.

An ink jet recording apparatus 300 illustrated in FIG. 17 is a device including the ink jet head 356C, the ink jet head 356M, the ink jet head 356Y, and the ink jet head 356K which are illustrated in FIG. 13, and the deflection suppressing unit 357 according to the sixth embodiment is applied to the ink jet head 356C, the ink jet head 356M, the ink jet head 356Y, and the ink jet head 356K. The illustration of the deflection suppressing unit 357 is omitted in FIG. 17.

The ink jet recording apparatus 300 illustrated in FIG. 17 is an ink jet recording apparatus that records an image onto sheets of paper P in an ink jet method, using an aqueous UV ink, which is a UV curable-type ink in which an aqueous medium is used.

UV is an abbreviation for ultraviolet light. The paper P of FIG. 17 is an embodiment of a recording medium.

The ink jet recording apparatus 300 is configured so as to include a paper feeding unit 312 that feeds the paper P, a treatment liquid applying portion 314 that applies a treatment liquid onto the front surface of the paper P fed from the paper feeding unit 312, a treatment liquid dry processing portion 316 that performs dry processing onto the paper P on which the treatment liquid is applied by the treatment liquid applying portion 314, the image forming unit 318 that records an image onto the front surface of the paper P, on which dry processing is carried out by the treatment liquid dry processing portion 316, using an aqueous UV ink in an ink jet method, an ink dry processing portion 320 that performs dry processing onto the paper P on which the image is recorded by the image forming unit 318, a UV irradiation processing unit 322 that performs the irradiation of UV light to fix the image onto the paper P dry-processed by the ink dry processing portion 320, and a paper outputting unit 324 that outputs the paper P which is UV irradiation-processed by the UV irradiation processing unit 322.

UV light is synonymous with ultraviolet light. UV light and ultraviolet light are embodiments of actinic light.

<Paper Feeding Unit>

The paper feeding unit 312 is configured so as to include a paper feeding stand 330, a sucker device 332, a pair of paper feeding rollers 334, a feeder board 336, a front guard 338, and a paper feeding drum 340, and the paper P loaded on the paper feeding stand 330 is fed to the treatment liquid applying portion 314 one by one.

The paper P loaded on the paper feeding stand 330 is raised one by one from the top in turn using a suction fit 332A of the sucker device 332, and is fed to an area between a pair of upper and lower roller 334A and roller 334B of the pair of paper feeding rollers 334.

The paper P fed to the pair of paper feeding rollers 334 is sent out forward by the pair of upper and lower roller 334A and roller 334B, and is placed on the feeder board 336. The paper P placed on the feeder board 336 is transported by a tape feeder 336A provided on a transport surface of the feeder board 336.

Then, in the process of transporting, the paper is pressed against the transport surface of the feeder board 336 by a retainer 336B and a guide roller 336C, and thus roughness is corrected. By a leading end of the paper abutting against the front guard 338, the inclination of the paper P transported by the feeder board 336 is corrected, and after then, the paper is handed over to the paper feeding drum 340. Then, a leading end portion of the paper is gripped by a gripper 340A of the paper feeding drum 340 and the paper is transported to the treatment liquid applying portion 314.

<Treatment Liquid Applying Portion>

The treatment liquid applying portion 314 is configured so as to include a treatment liquid applying drum 342 that transports the paper P and a treatment liquid applying unit 344 that applies a predetermined treatment liquid onto the front surface of the paper P transported by the treatment liquid applying drum 342, and applies the treatment liquid onto the front surface of the paper P.

A treatment liquid having a function of aggregating color materials in an aqueous UV ink to be jetted onto the paper P by the image forming unit 318 at the back is applied as the treatment liquid to be applied onto the front surface of the paper P. By applying the treatment liquid and jetting the aqueous UV ink to the front surface of the paper P, high-quality printing can be performed without causing a landing interference even when general-purpose printing paper is used.

The paper P handed over from the paper feeding drum 340 of the paper feeding unit 312 is handed over to the treatment liquid applying drum 342. The treatment liquid applying drum 342 rotates with the leading end of the paper P gripped by a gripper 342A to wind and transport the paper P around a circumferential surface. In the specification, gripping is synonymous with clutching.

By an application roller 344A, to which a certain amount of the treatment liquid measured from a treatment liquid tank 344B by a measuring roller 344C is applied, pressing and abutting against the front surface of the paper P in the process of transporting, the treatment liquid is applied onto the front surface of the paper P. As a form of application of the treatment liquid, other forms such as an ink jet method and application by a blade can also be applied without being limited to roller application.

<Treatment Liquid Dry Processing Portion>

The treatment liquid dry processing portion 316 is configured so as to include a treatment liquid dry processing drum 346 that transports the paper P, a paper transporting guide 348 that supports the back surface of the paper P, and a treatment liquid dry processing unit 350 that blows hot air to the front surface of the paper P transported by the treatment liquid dry processing drum 346 and dries the front surface of the paper, and carries out dry processing onto the front surface of the paper P to which the treatment liquid is applied.

The leading end of the paper P handed over from the treatment liquid applying drum 342 of the treatment liquid applying portion 314 to the treatment liquid dry processing drum 346 is gripped by a gripper 346A included in the treatment liquid dry processing drum 346.

In addition, the back surface of the paper P is supported by the paper transporting guide 348 in a state where the front surface, which is a surface to which the treatment liquid is applied, faces the inside. By rotating the treatment liquid dry processing drum 346 in this state, the paper P is transported.

In the process of transporting the paper using the treatment liquid dry processing drum 346, hot air is blown to the front surface of the paper P from the treatment liquid dry processing unit 350 provided on the inside of the treatment liquid dry processing drum 346, dry processing is carried out on the paper P, a solvent component in the treatment liquid is removed, and an ink aggregate layer is formed on the front surface of the paper P.

<Image Forming Unit>

The image forming unit 318 is configured as to mainly include the drawing drum 352 that transports the paper P, a paper pressing roller 354 that presses the paper P transported by the drawing drum 352 to bring the paper P into close contact with the circumferential surface of the drawing drum 352, the ink jet head 356C, the ink jet head 356M, the ink jet head 356Y, and the ink jet head 356K, which jet each color of ink droplets, including cyan, magenta, yellow, and black, onto the paper P, an inline sensor 358 that reads an image recorded on the paper P, a mist filter 360 that captures ink mist, and a drum cooling unit 362, and jets each color of ink droplets, including cyan, magenta, yellow, and black, onto the front surface of the paper P on which a treatment liquid layer is formed to draw a color image onto the front surface of the paper P.

Various ejecting methods such as a piezoelectric method in which an ink is ejected with the use of deflection deformation of a piezoelectric element, a thermal method in which an ink is heated to cause a film boiling phenomenon and the ink is ejected, and an electrostatic method in which an electrostatic force is caused to act on a charged ink and the ink is landed onto a recording medium can be applied to the ink jet head applied in this example.

In addition, a line type head, in which nozzles are formed over a length corresponding to the entire length of the paper P in a main scanning direction orthogonal to the transporting direction, which is the entire width of the paper P, is applied to the ink jet head applied in this example.

The leading end of the paper P handed over from the treatment liquid dry processing drum 346 of the treatment liquid dry processing portion 316 to the drawing drum 352 is gripped by a gripper 352A included in the drawing drum 352. By causing the paper P to pass under the paper pressing roller 354, the paper P comes into close contact with the circumferential surface of the drawing drum 352.

By a negative pressure generated in an adsorption hole formed in the circumferential surface of the drawing drum 352 acting on the paper to hold the paper, the paper P which is in close contact with the circumferential surface of the drawing drum 352 is adsorption-held by the circumferential surface of the drawing drum 352.

By jetting each color of ink droplets, including cyan, magenta, yellow, and black, from each of the ink jet head 356C, the ink jet head 356M, the ink jet head 356Y, and the ink jet head 356K onto the paper P that is adsorption-held and transported by the circumferential surface of the drawing drum 352 in a case where the paper passes through an ink jetting region directly below the ink jet head 356C, the ink jet head 356M, the ink jet head 356Y, and the ink jet head 356K, a color image is drawn on the front surface.

An ink jetted on the front surface of the paper P is fixed on the front surface of the paper P by reacting with the ink aggregate layer formed on the front surface of the paper P without causing feathering and bleeding, and a high-quality image is formed on the front surface of the paper P.

In a case where the paper P, on which the image is formed by the ink jet head 356C, the ink jet head 356M, the ink jet head 356Y, and the ink jet head 356K, passes through a reading region of the inline sensor 358, the image formed on the front surface is read.

The image is read by the inline sensor 358 if necessary, and the inspection of an image abnormality, including the inspection of an image defect such as ejecting failure and density unevenness, is performed from image reading data. The paper P passed through the reading region of the inline sensor 358 passes under a guide 359 after adsorption is released, and is handed over to the ink dry processing portion 320. In the specification, drawing can be replaced by image formation or printing.

<Ink Dry Processing Portion>

The ink dry processing portion 320 is configured so as to include an ink dry processing unit 368 that carries out dry processing with respect to the paper P transported by a chain gripper 364, carries out dry processing with respect to the paper P after image formation, and removes a liquid component left on the front surface of the paper P.

A form, in which a heat source such as a halogen heater and an infrared heater and a fan that blows air, gas, or fluid heated by the heat source to the paper P are included, is given as a configuration example of the ink dry processing unit 368.

The leading end of the paper P handed over from the drawing drum 352 of the image forming unit 318 to the chain gripper 364 is gripped by a gripper 364D included in the chain gripper 364.

The chain gripper 364 has a structure in which a pair of endless chains 364C is wound around a first sprocket 364A and a second sprocket 364B.

In addition, a trailing end of the back surface of the paper P is adsorption-held by a paper holding surface of a guide plate 372 disposed so as to be spaced apart by a certain distance to the chain gripper 364.

<UV Irradiation Processing Unit>

The UV irradiation processing unit 322 that functions as actinic light irradiation means is configured so as to include a UV irradiation unit 374, and irradiates an image recorded by using an aqueous UV ink with ultraviolet light to fix the image on the front surface of the paper P.

A form in which an ultraviolet light source that generates UV light and an optical system that functions as means for condensing UV light and means for deflecting UV light are included is given as a configuration example of the UV irradiation unit 374.

In a case where the paper P transported by the chain gripper 364 arrives at a UV light irradiation region of the UV irradiation unit 374, UV irradiation processing is carried out by the UV irradiation unit 374 provided inside the chain gripper 364.

That is, the paper P, which is transported by the chain gripper 364 with the leading end being gripped by the gripper and the trailing end of the back surface being adsorption-held by the paper holding surface, is irradiated with UV light from the UV irradiation unit 374 disposed at a position corresponding to the front surface of the paper P on a transport route of the paper P. Curing reaction is triggered and the image irradiated with UV light is fixed on the front surface of the paper P.

The paper P on which UV irradiation processing is carried out is sent to the paper outputting unit 324 via an inclined transport route 370B. A cooling processing unit that carries out cooling processing with respect to the paper P passed through the inclined transport route 370B may be included.

<Paper Outputting Unit>

The paper outputting unit 324 that collects the paper P on which the series of image formation processing is performed is configured so as to include a paper output stand 376 on which the paper P is stacked and collected.

The gripper 364D of the chain gripper 364 releases the paper P to the paper output stand 376, and stacks the paper P on the paper output stand 376. The paper P released from the chain gripper 364 is stacked and collected on the paper output stand 376. The paper output stand 376 includes a paper guard (not illustrated) such that the paper P is neatly stacked on the paper output stand. A front paper guard, a rear paper guard, and a lateral paper guard are given as examples of the paper guard.

In addition, the paper output stand 376 is provided so as to be capable of elevating and lowering by using a paper output stand elevating and lowering device (not illustrated). The driving of the paper output stand elevating and lowering device is controlled in tandem with an increase and decrease in the number of sheets of the paper P stacked on the paper output stand 376, and the paper output stand elevating and lowering device elevates and lowers the paper output stand 376 such that the paper P positioned the uppermost is positioned at a certain height at all times.

A configuration, in which a system control unit that comprehensively controls each unit of the apparatus, a control unit that individually controls each unit of the apparatus based on a command signal sent out from the system control unit, an image processing unit that carries out image processing such as color conversion with respect to input image data, density correction, and halftone to generate dot data, a drive voltage generating unit that generates a drive voltage of the ink jet head based on the dot data, and a head driving unit that supplies the drive voltage to the ink jet head to operate the ink jet head are included, is given as a configuration example of a control unit of the ink jet recording apparatus 300 illustrated in FIG. 17.

Although the ink jet recording apparatus is given as an example of the liquid ejecting apparatus in the specification, the liquid ejecting apparatus can also be widely applied to an ink jet method pattern forming apparatus that performs electrical wiring formation and mask pattern formation, which are for industrial application, without being limited to an ink jet recording apparatus for graphic application.

Configuration requirements of the embodiments of the invention described above can be appropriately altered, added and removed without departing from the spirit of the invention. Without being limited to the embodiments described above, a number of modifications to the invention can be made by those who are skilled in the art within the technical scope of the invention.

EXPLANATION OF REFERENCES

21, 21A, 21B, 21C, 21D, 356, 356A, 356B: liquid ejecting head
100: recording medium
110, 160: head module supporting member
110A: head module supporting surface
110B, 114E, 157B, 160B, 514A: top surface
110C, 114A: middle position
110D: female threaded portion
110E: fixed position
110F: both ends
111: attachment units
112, 112B, 112C, 112D, 357, 357C, 357M, 357Y, 357K, 512, 512A, 512B: deflection suppressing unit
114, 114B, 154, 514, 514B: sacrifice member
114C: tip portion
114D: base end portion
116, 156, 516: intermediate connection unit
116A: horizontal portion
116B: vertical portion
118, 130: screws
120, 120A: manifold housing
120B: bottom plate
122: recording medium transporting unit
122A, 352C: rotation axis
122B, 352B: outer circumferential surface
124: connection member
126: main body frame
132: head portion
134: threaded portion
136: end portion connecting member
140, 540: compression spring
154A, 154D: first sacrifice member
154B, 154E: second sacrifice member
154F: third sacrifice member
154G: fourth sacrifice member
156A, 156D: first intermediate connection member
156B, 156E: second intermediate connection member
156F: third intermediate connection member
156G: fourth intermediate connection member
157: angle adjusting member
157A: bottom surface
161, 162: rib
161A: second deflection suppressing unit attached surface
162A: fourth deflection suppressing unit attached surface
170, 200: head modules
180: centroid
182, 184, 186, 188: straight line
210: flow path structure
214: ink supply path
216: individual supply path
218: pressure chamber
220: nozzle communication path
226: circulation individual flow path
228: circulation common flow path
230: piezoelectric element
231: piezoelectric layer
232: ink supplying chamber
236: ink circulation chamber
252: supply side individual flow path
256: collection side individual flow path
264: upper electrode
265: lower electrode
266: diaphragm
267: adhesive layer
275: nozzle plate
277: liquid ejecting surface
280: nozzle opening
281: nozzle unit
300, 301: ink jet recording apparatus
312: paper feeding unit
314: treatment liquid applying unit
316: treatment liquid dry processing portion
318: image forming unit
320: ink dry processing portion
322: irradiation processing unit
324: paper outputting unit
330: paper feeding stand
332: sucker device
332A: suction fit
334: pair of paper feeding roller
334A, 334B: roller
336: feeder board
336A: tape feeder
336B: retainer
336C: guide roller
338: front guard
340: paper feeding drum
340A, 342A, 346A, 352A, 364D: gripper
342: treatment liquid applying drum
344: treatment liquid applying unit
344A: application roller
344B: treatment liquid tank
344C: measuring roller
346: treatment liquid dry processing drum
348: paper transporting guide
350: treatment liquid dry processing unit
352: drawing drum, transporting drum
354: paper pressing roller
356C, 356M, 356Y, 356K: ink jet head
357A, 357D: first deflection suppressing unit
357B, 357E: second deflection suppressing unit
357F: third deflection suppressing unit
357G: fourth deflection suppressing unit
358: inline sensor
359: guide
360: mist filter
362: drum cooling unit
364: chain gripper
364A: first sprocket
364B: second sprocket
364C: chain
368: ink dry processing unit
370B: inclined transport route
372: guide plate
374: irradiation unit
376: paper output stand
400, 402, 404, 406, 408, 410, 412, 414, 416, 418: measurement point
517: hole portion
518, 518A: moving mechanism
519: sliding member
519A: rolling member
520: fixing member

What is claimed is:

1. A liquid ejecting head comprising:

a head module that includes an ejecting element ejecting a liquid;

a head module supporting member that supports the head module with a head module supporting surface facing a gravity direction or a head module supporting surface in an obliquely downward direction having a component of the gravity direction, and has a structure in which a longitudinal direction of the head module supporting member is a first direction; and a deflection suppressing unit that has a structure in which a longitudinal direction of the deflection suppressing unit is the first direction, and is disposed on a top surface of the head module supporting member, which is a surface opposite to the head module supporting surface, wherein the deflection suppressing unit comprises a deflection absorption unit that is an elastic body of which a longitudinal direction is a direction parallel to the first direction or a direction obliquely intersecting the first direction, and has both end portions in the longitudinal direction that are connected to both end portions of the top surface of the head module supporting member in the first direction, a head module supporting member connection unit of which one end is connected to an intermediate position between the both end portions of the deflection absorption unit in the first direction and the other end is connected to the top surface of the head module supporting member, and a biasing force applying unit that applies a biasing force, which is a force that deflects the deflection absorption unit in a deflection direction of the head module supporting member, to the deflection absorption unit.

2. The liquid ejecting head according to claim 1, wherein the biasing force applying unit comprises a spring that is disposed between the deflection absorption unit and the head module supporting member connection unit, which is the spring of which one end is supported by the deflection absorption unit and the other end is supported by the head module supporting member connection unit, and applies the biasing force to the deflection absorption unit by a force of repulsion of the spring.

3. The liquid ejecting head according to claim 1, wherein the biasing force applying unit comprises a male screw that connects the head module supporting member and the head module supporting member connection unit together, and applies the biasing force to the deflection absorption unit by the male screw being inserted into a female threaded portion formed in the top surface of the head module supporting member and the male screw being tightened.

4. The liquid ejecting head according to claim 1, further comprising:

an external flow path that is disposed outside the head module, and communicates with an internal flow path of the head module; and an external flow path accommodating unit that accommodates the external flow path, and is disposed on the top surface of the head module supporting member, wherein the deflection suppressing unit is disposed between the head module supporting member and the external flow path accommodating unit.

5. The liquid ejecting head according to claim 1, further comprising:

an external flow path that is disposed outside the head module, and communicates with an internal flow path of the head module; and an external flow path accommodating unit that accommodates the external flow path, and is disposed on the top surface of the head module supporting member, wherein the deflection suppressing unit is disposed on a surface of the external flow path accommodating unit, which is opposed to the top surface of the head module supporting member.

6. The liquid ejecting head according to claim 1, wherein the deflection absorption unit is disposed on a side of the head module supporting member in an opposite direction to the gravity direction, and the biasing force applying unit applies the biasing force in a direction parallel to the gravity direction to the deflection absorption unit.

7. The liquid ejecting head according to claim 1, wherein the deflection suppressing unit comprises a first deflection absorption unit and a first head module supporting member connection unit are disposed in a direction intersecting the gravity direction, and a second deflection suppressing unit of which a second deflection absorption unit and a second head module supporting member connection unit are disposed in a direction intersecting the gravity direction, and intersecting the direction where the first deflection absorption unit and the first head module supporting member connection unit are disposed, and the biasing force applying unit applies a first biasing force in a direction parallel to the disposition direction of the first deflection absorption unit and the first head module supporting member connection unit with respect to the first deflection absorption unit, and applies a second biasing force in a direction parallel to the disposition direction of the second deflection absorption unit and the second head module supporting member connection unit with respect to the second deflection absorption unit.

8. The liquid ejecting head according to claim 7, wherein the first deflection suppressing unit is disposed at a position spaced apart from an intersection point between a straight line passing through a centroid of the liquid ejecting head in a direction orthogonal to a liquid ejecting surface of the liquid ejecting head, and the top surface of the head module supporting member by a distance determined in advance in a second direction orthogonal to the first direction and parallel to the top surface of the head module supporting member.

9. The liquid ejecting head according to claim 7, wherein the deflection suppressing unit comprises a third deflection suppressing unit of which a third deflection absorption unit and a third head module supporting member connection unit are disposed in the direction intersecting the gravity direction, the third deflection suppressing unit being disposed so as to be spaced apart from the first deflection suppressing unit by a distance determined in advance in a second direction orthogonal to the first direction and parallel to the top surface of the head module supporting member, and the biasing force applying unit applies a third biasing force in a direction which is the same as the direction of the first biasing force.

10. The liquid ejecting head according to claim 9, wherein the third deflection suppressing unit is disposed at a position spaced apart from an intersection point between a straight line passing through a centroid of the liquid ejecting head in a direction orthogonal to a liquid ejecting surface of the liquid ejecting head, and the top surface of the head module supporting member by a distance determined in advance in the second direction orthogonal to the first direction and parallel to the top surface of the head module supporting member.

11. The liquid ejecting head according to claim 7, wherein the deflection suppressing unit comprises a fourth deflection suppressing unit of which a fourth deflection absorption unit and a fourth head module supporting member connection unit are disposed in a direction intersecting the gravity direction and intersecting the direction where the first deflection absorption unit and the first head module supporting member connection unit are disposed, the fourth deflection suppressing unit being disposed at a position opposed to the second deflection suppressing unit in the second direction orthogonal to the first direction and parallel to the top surface of the head module supporting member, and the biasing force applying unit applies a fourth biasing force in a direction parallel to the second biasing force, which is an opposite direction to the second biasing force.

12. The liquid ejecting head according to claim 1, wherein the deflection absorption unit is disposed on a side of the centroid of the liquid ejecting head in the opposite direction to the gravity direction.

13. The liquid ejecting head according to claim 1, wherein the deflection suppressing unit comprises a moving mechanism that supports at least one of both ends of the head module supporting member in the longitudinal direction so as to be movable to an outside in the longitudinal direction of the head module supporting member.

14. The liquid ejecting head according to claim 1, wherein a plurality of the head modules are provided.

15. The liquid ejecting head according to claim 14, wherein the plurality of head modules are arranged in a line in the first direction.

16. The liquid ejecting head according to claim 14, wherein the plurality of head modules are arranged in a line in the first direction over a length that is equal to or larger than an entire length of a recording medium, to which the liquid ejected from the head modules is applied, in the first direction.

17. A liquid ejecting apparatus comprising:

a recording medium transporting unit that transports a recording medium; and a liquid ejecting head that ejects a liquid to be applied to the recording medium, wherein the liquid ejecting head includes the liquid ejecting head according to claim 1.

18. The liquid ejecting apparatus according to claim 17, wherein the liquid ejecting head is disposed in a direction orthogonal to a direction where the recording medium is transported by the recording medium transporting unit as the first direction.

19. The liquid ejecting apparatus according to claim 17, wherein a plurality of the liquid ejecting heads are provided, and the plurality of liquid ejecting heads are arranged in the direction where the recording medium is transported by the recording medium transporting unit.

* * * * *